US009201336B2

(12) United States Patent
Endou et al.

(10) Patent No.: US 9,201,336 B2
(45) Date of Patent: Dec. 1, 2015

(54) DEVELOPING DEVICE AND IMAGE FORMING APPARATUS INCLUDING A TONER BEARING MEMBER HAVING A PREDETERMINED RELATIONSHIP WITH TONER

(71) Applicants: Osamu Endou, Kanagawa (JP); Yasuyuki Ishii, Tokyo (JP); Yoshiko Ogawa, Tokyo (JP); Yuuji Ishikura, Kanagawa (JP); Hideyasu Seki, Kanagawa (JP); Toshio Koike, Tokyo (JP); Akihiro Kawakami, Tokyo (JP)

(72) Inventors: Osamu Endou, Kanagawa (JP); Yasuyuki Ishii, Tokyo (JP); Yoshiko Ogawa, Tokyo (JP); Yuuji Ishikura, Kanagawa (JP); Hideyasu Seki, Kanagawa (JP); Toshio Koike, Tokyo (JP); Akihiro Kawakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/760,595

(22) Filed: Feb. 6, 2013

(65) Prior Publication Data

US 2013/0209143 A1 Aug. 15, 2013

(30) Foreign Application Priority Data

Feb. 13, 2012 (JP) ..... 2012-028432
Mar. 16, 2012 (JP) ..... 2012-060876

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
USPC ..... 399/284, 272, 274, 279, 281
See application file for complete search history.

(56) References Cited

U.S. PATENT DOCUMENTS 4,011,834 A * 3/1977 Stephan ..... 399/284
4,780,741 A * 10/1988 Wada et al. ..... 399/274
4,836,136 A * 6/1989 Natsuhara ..... 399/276
5,328,792 A * 7/1994 Shigemori et al. ..... 430/110.3
5,502,552 A * 3/1996 Iwata et al. ..... 399/222
5,750,302 A * 5/1998 Ogawa et al. ..... 430/106.2
6,115,575 A * 9/2000 Kinoshita et al. ..... 399/286

(Continued)

FOREIGN PATENT DOCUMENTS

JP 2003-057940 2/2003
JP 2004-212642 A 7/2004

(Continued)

OTHER PUBLICATIONS

U.S. Appl. No. 13/608,298, filed Sep. 10, 2012.

(Continued)

*Primary Examiner* — G. M. Hyder
(74) *Attorney, Agent, or Firm* — Oblon, McClelland, Maier & Neustadt, L.L.P.

(57) ABSTRACT

A developing device including: a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, and wherein a non-electrostatic adhesive force between the toner and the surface of the toner bearing member is less than 9.0 nN.

26 Claims, 37 Drawing Sheets

(56) References Cited

U.S. PATENT DOCUMENTS

| | | | | |
|---|---|---|---|---|
| 8,041,276 | B2 * | 10/2011 | Ogino | 399/302 |
| 8,391,755 | B2 * | 3/2013 | Nakagawa et al. | 399/266 |
| 2002/0085863 | A1 * | 7/2002 | Nakamura et al. | 399/286 |
| 2003/0123909 | A1 * | 7/2003 | Akashi et al. | 399/286 |
| 2004/0191665 | A1 * | 9/2004 | Watanabe et al. | 430/124 |
| 2004/0228648 | A1 * | 11/2004 | Yanagida et al. | 399/100 |
| 2006/0153600 | A1 * | 7/2006 | Huang | 399/284 |
| 2006/0177239 | A1 | 8/2006 | Koike et al. | |
| 2007/0086811 | A1 | 4/2007 | Tsukamoto et al. | |
| 2007/0110481 | A1 * | 5/2007 | Yamada et al. | 399/279 |
| 2008/0124138 | A1 | 5/2008 | Kosugi et al. | |
| 2008/0298852 | A1 * | 12/2008 | Yamada | 399/279 |
| 2008/0298853 | A1 * | 12/2008 | Yamada et al. | 399/279 |
| 2009/0022523 | A1 | 1/2009 | Kadota et al. | |
| 2009/0029281 | A1 * | 1/2009 | Kikushima | 430/111.3 |
| 2009/0067889 | A1 * | 3/2009 | Nakagawa et al. | 399/266 |
| 2009/0290901 | A1 | 11/2009 | Ishii et al. | |
| 2010/0098464 | A1 * | 4/2010 | Suzuki et al. | 399/286 |
| 2011/0064432 | A1 | 3/2011 | Horike et al. | |
| 2012/0213557 | A1 | 8/2012 | Yamaguchi et al. | |
| 2012/0219326 | A1 | 8/2012 | Koike et al. | |
| 2013/0216277 | A1 * | 8/2013 | Endou et al. | 399/284 |
| 2013/0243499 | A1 * | 9/2013 | Ishikura et al. | 399/284 |

FOREIGN PATENT DOCUMENTS

| | | | |
|---|---|---|---|
| JP | 2008-299015 | | 12/2008 |
| JP | 2009-122642 | A | 6/2009 |
| JP | 4502146 | | 4/2010 |
| JP | 2010-262316 | | 11/2010 |
| JP | 2011-118240 | A | 6/2011 |

OTHER PUBLICATIONS

U.S. Appl. No. 13/608,240, filed Sep. 10, 2012.
U.S. Appl. No. 13/760,595, filed Feb. 6, 2013.
Japanese Information Offer Form issued on Jun. 19, 2015 in Japanese Patent Application No. 2012-028432 with English translation.
Office Action issued Sep. 1, 2015 in Japanese Patent Application No. 2012-028432.

* cited by examiner

DEVELOPING DEVICE AND IMAGE FORMING APPARATUS INCLUDING A TONER BEARING MEMBER HAVING A PREDETERMINED RELATIONSHIP WITH TONER

BACKGROUND OF THE INVENTION

1. Field of the Invention

The present invention relates to a developing device and an image forming apparatus.

2. Description of the Related Art

Recently, a demand for high-speed output of a color image is increased in a color printer using a one-component developer. For example, a high-speed output is also demanded in a color image forming apparatus in which a plurality of color image forming units are disposed in parallel for forming a color image.

FIG. 1 is a schematic sectional view of one exemplary color image forming apparatus, which is a color printer. This image forming apparatus includes latent electrostatic image bearing members (901Y, 901M, 901C and 901K) on which a latent electrostatic image is formed, and a developing device 902 which supplies a toner to the latent electrostatic image bearing member. The developing device 902 includes a developing roller 921 which is made of an elastic body and configured to abut against the latent electrostatic image bearing member, followed by supplying a small-particle diameter toner with an average particle diameter of 6 μm or less to the latent electrostatic image which has been formed on the latent electrostatic image bearing member to thereby visualize the latent electrostatic image; a toner supplying roller 922 which is configured to supply the toner to the developing roller 921; and a toner layer-regulating member 923 which is configured to abut against the developing roller 921 to thereby thin down a toner layer on the developing roller 921. The image forming apparatus further includes a cleaning device 904 which is configured to remove the toner remaining on the latent electrostatic image bearing member after a toner image is transferred to an intermediate transfer belt 903.

Once the color image forming apparatus shown in FIG. 1 is activated and starts printing, the latent electrostatic image bearing members (901Y, 901M, 901C and 901K) are rotated. Firstly, a charging device uniformly charges surfaces of the latent electrostatic image bearing members (901Y, 901M, 901C and 901K). An exposing device having a write optical system then irradiates an optical image to thereby form a latent electrostatic image on the latent electrostatic image bearing members (901Y, 901M, 901C and 901K). The developing device 902 supplies the toner to the latent electrostatic image to thereby form the toner image. Then, the toner image is conveyed to a primary transfer nip portion between the latent electrostatic image bearing members (901Y, 901M, 901C and 901K) and an intermediate transfer belt 903, where the toner image is transferred to the intermediate transfer belt 903. The toner image is transferred from each of the latent electrostatic image bearing members for yellow (Y), cyan (C), magenta (M), and black (B) to the intermediate transfer belt 903, resulting in forming a four-color toner image. The four-color toner image is conveyed to a secondary transfer nip portion in which a secondary transfer roller 905 is provided, and transferred to transfer paper P. The four-color toner image on the transfer paper P is heated and pressured by a fixing device 906 to thereby be fixed on the transfer paper P.

FIG. 2 illustrates the developing device 902 shown in FIG. 1 in detail. The developing device 902 contains a predetermined amount of a non-magnetic one-component toner. This toner is supplied to the toner supplying roller 922 which is disposed below the developing device 902 and which is made of foam. The toner supplying roller 922 and the developing roller 921 are rotated at a predetermined linear velocity ratio in a direction indicated by an arrow in FIG. 2 to thereby supply the toner from the toner supplying roller 922 to the developing roller 921. The developing roller 921 is generally made of an elastic member (e.g., rubber) or metal having a blasted surface. A surface of the developing roller is roughened in order to ensure conveyance of the toner.

The toner adhered on the developing roller 921 is negatively charged through friction at a blade nip portion between the toner layer-regulating member 923 and the developing roller 921. Notably, as the toner layer-regulating member 923, so-called doctor blade is typically used. Specifically, a folded portion is formed by folding a metal plate and allowed to abut against the developing roller 921. A needed amount of toner layer is formed on the developing roller 921 at downstream of the blade nip portion in a rotation direction. The developing roller 921 comes into contact with the latent electrostatic image bearing member 901, and rotates at a predetermined linear velocity ratio $\eta$ to a linear velocity of the latent electrostatic image bearing member 901 (linear velocity of the developing roller/linear velocity of the latent electrostatic image bearing member), to thereby supply the toner to the latent electrostatic image bearing member 901. Thus, a toner image is formed on the latent electrostatic image bearing member 901.

Recently, a demand for high-image quality is increased also in a color image forming apparatus using a one-component developing device which is small-sized and suitable for lowering cost. Accordingly, the one-component developing device is also required to increase image quality by means of a small particle diameter toner.

However, the small particle diameter toner is easily aggregated under a stress. As a result, aggregates of the toner are produced at a blade nip portion between a regulating blade (toner layer-regulating member) and a developing roller, whereby the toner stays at the blade nip portion. Then, the toner sticks firmly to the regulating blade, which is problematic.

In order to solve the above problem, there has been proposed a developing device including a toner bearing member which bears a toner on its surface, which develops with the toner a latent electrostatic image on a latent electrostatic image bearing member, and which has convex portions regularly arranged on the surface, wherein a ten-point average roughness of the convex portions is smaller than a value obtained by subtracting a value three times as large as standard deviation in a particle size distribution of the toner from a volume average particle diameter of the toner; and an image forming apparatus including the developing device (see Japanese Patent Application Laid-Open (JP-A) No. 2008-299015). In this proposed technology, the problem in which the toner sticks firmly to the regulating blade has been solved by using the toner bearing member which has regularly arranged convex portions on its surface.

However, in this proposed technology, a desired developability cannot be achieved in spite of controlling an electric charge amount of the toner, that is, developing efficiency is unsatisfactory, which is problematic.

Thus, at present, keen demand has arisen for a developing device which can achieve satisfactory developing efficiency.

SUMMARY OF THE INVENTION

The present invention aims to solve the above existing problems and achieve the following objects. That is, an object of the present invention is to provide a developing device being capable of achieving satisfactory developing efficiency.

Means for solving the above problem are as follows.

A developing device of the present invention includes:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, wherein a non-electrostatic adhesive force between the toner and the surface of the toner bearing member is less than 9.0 nN (nanonewtons).

The present invention can solve the above existing problems and can provide a developing device being capable of achieving satisfactory developing efficiency.

Figure 1:
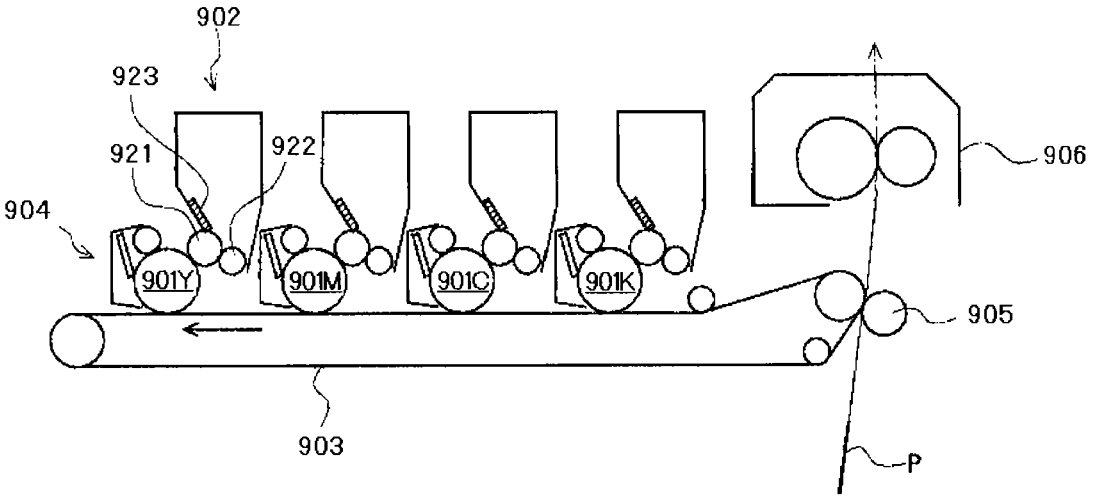
FIG. 1 is a schematic sectional view of one exemplary color image forming apparatus.
Figure 2:
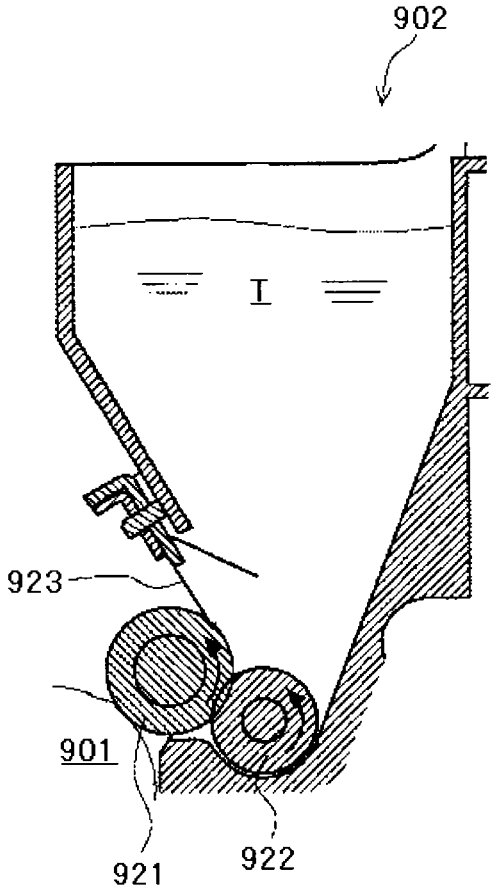
FIG. 2 is an enlarged view of a developing device in the color image forming apparatus shown in FIG. 1.

DETAILED DESCRIPTION OF THE INVENTION (Developing Device)

A developing device of the present invention includes at least a toner bearing member and regulating member; and, if necessary, further includes other members.

The toner bearing member is configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and has regularly arranged convex portions on the surface thereof.

A non-electrostatic adhesive force between the toner and the surface of the toner bearing member is less than 9.0 nN.

The present inventors have discovered the following problem. In a developing device which has regularly arranged convex portions on its surface and which performs a development process with being in contact with a regulating member, and an image forming apparatus and an image forming method using the developing device, a toner does not stick firmly to the regulating member even when a small particle diameter toner is used, but developability is deteriorated, that is, developing efficiency is unsatisfactory.

The present inventors have further studied the above problem and discovered that, in the case where an amplitude of an AC voltage is not so large, developability is deteriorated due to high non-electrostatic adhesive force between a toner and a toner bearing member. In addition, when the amplitude of the AC voltage is increased, a potential in a non-image area on a latent electrostatic image bearing member becomes very different from a maximum potential of a developing bias, leading to an electric discharge and thus an image noise at the non-image area. The present inventors also discovered that an adhesive force between a toner and a toner bearing member is affected by an electric charge amount of the toner, therefore, for example, an average electric charge amount (q/m) of the toner is preferably about −30 (μC/g) to about −40 (μC/g). However, even when the electric charge amount of the toner is controlled so as to fall within the above range, in the case where the non-electrostatic adhesive force between the toner and the toner regulating member is increased, a desired developability cannot be achieved.

The present inventors further studied based on the above finding and discovered that a certain degree of non-electrostatic adhesive force between a toner and a toner bearing member can provide satisfactory developing efficiency, which has completed the present invention.

The non-electrostatic adhesive force between the toner and the surface of the toner bearing member is less than 9.0 nN. When the non-electrostatic adhesive force is less than 9.0 nN, developing efficiency is excellent, specifically developing efficiency is 70% or more. When the non-electrostatic adhesive force is 9.0 nN or more, developing efficiency is deteriorated. As a result, ID (image density) of an image on a recording medium is decreased below an acceptable range.

The non-electrostatic adhesive force can be measured as follows. A plate of which material is the same as that of a surface layer of the toner bearing member is laminated on a measurement base and uncharged toner is adhered to the measurement base. The measurement base is mounted in a holder and set in a rotor of a centrifuge. When the rotor starts rotating, a centrifugal force is applied to the toner. At the time when the centrifugal force is larger than an adhesive force between the toner and the measurement base, the toner is released from the base and moved to a receiving base. After competition of centrifugation, particle diameters of the toner adhered onto the receiving base are measured using an optical microscope and an image processing device.

Based on the measurement results, the centrifugal force having been applied to the toner is calculated.

A method for controlling the non-electrostatic adhesive force so as to be less than 9.0 nN is not particularly limited and may be appropriately selected depending on the intended purpose. Example thereof includes a method in which acrylic beads having small-particle diameters are mixed with a surface-coating resin to thereby form fine convex portions on the surface of the toner bearing member.

<Toner Bearing Member>

The toner bearing member is not particularly limited and may be appropriately selected depending on the intended purpose, so long as it is configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member.

A voltage in which an alternating current (AC) component is superimposed on a direct current (DC) component is preferably applied to the toner bearing member.

A material of the toner bearing member is not particularly limited and may be appropriately selected depending on the intended purpose. Examples thereof include an aluminum alloy and an iron alloy. The surface of the toner bearing member may be plated or may be coated with a resin. In other words, the surface of the toner bearing member may be formed with a plating or with the resin. The surface is preferably coated with the resin from the viewpoint of being capable of decreasing the non-electrostatic adhesive force between the toner and the surface of the toner bearing member to a greater extent. Also, decreasing the non-electrostatic adhesive force can decrease a developing linear velocity ratio, which can suppress the toner from being deteriorated to thereby enable a long service life.

Example of the plating includes a Ni-plating. The resin is not particularly limited and may be appropriately selected depending on the intended purpose, but a fluorine-based resin is preferred in that it can decrease the non-electrostatic adhesive force between the toner and the surface of the toner bearing member to a greater extent. Commercially available resins may be used. Example thereof includes LUMIFLON (product of Asahi Glass Co., Ltd., fluorine-based resin).

On the surface of the toner bearing member, a film is preferably formed by any of a vapor deposition treatment, a chemical-conversion treatment and resin coating.

Suitable example of the film formed by the vapor deposition treatment includes a DLC (diamond like carbon) film.

Suitable example of the chemical-conversion treatment includes a molybdic acid treatment.

In the resin coating, the resultant film preferably contains lubricant powder. Examples of the lubricant powder include PTFE (polytetrafluoroethylene) and $MOS_2$.

Suitable example of the film formed with the resin coating includes a PTFE-dispersed resin film.

A shape of the toner bearing member is not particularly limited and may be appropriately selected depending on the intended purpose, but is preferably cylindrical. The cylindrical toner bearing member may be referred to as a developing roller.

An outer diameter of the developing roller is not particularly limited and may be appropriately selected depending on the intended purpose. It is preferably 5 mm to 30 mm, more preferably 8 mm to 25 mm, particularly preferably 10 mm to 20 mm.

The toner bearing member has regularly arranged convex portions on its surface.

A shape of the convex portion is not particularly limited and may be appropriately selected depending on the intended purpose. Example of thereof includes a trapezoidal shape in which a base line is longer than an upper line in a cross-section orthogonal to a rotation center axis direction of the toner bearing member (may be referred to as a forward tapered shape).

The regular arrangement is not particularly limited and may be appropriately selected depending on the intended purpose. Example thereof includes a latticed arrangement.

A method for forming the convex portions is not particularly limited and may be appropriately selected depending on the intended purpose. Example thereof includes a rolling method.

One exemplary convex portion now will be explained with reference to the drawings.

Figure 24:
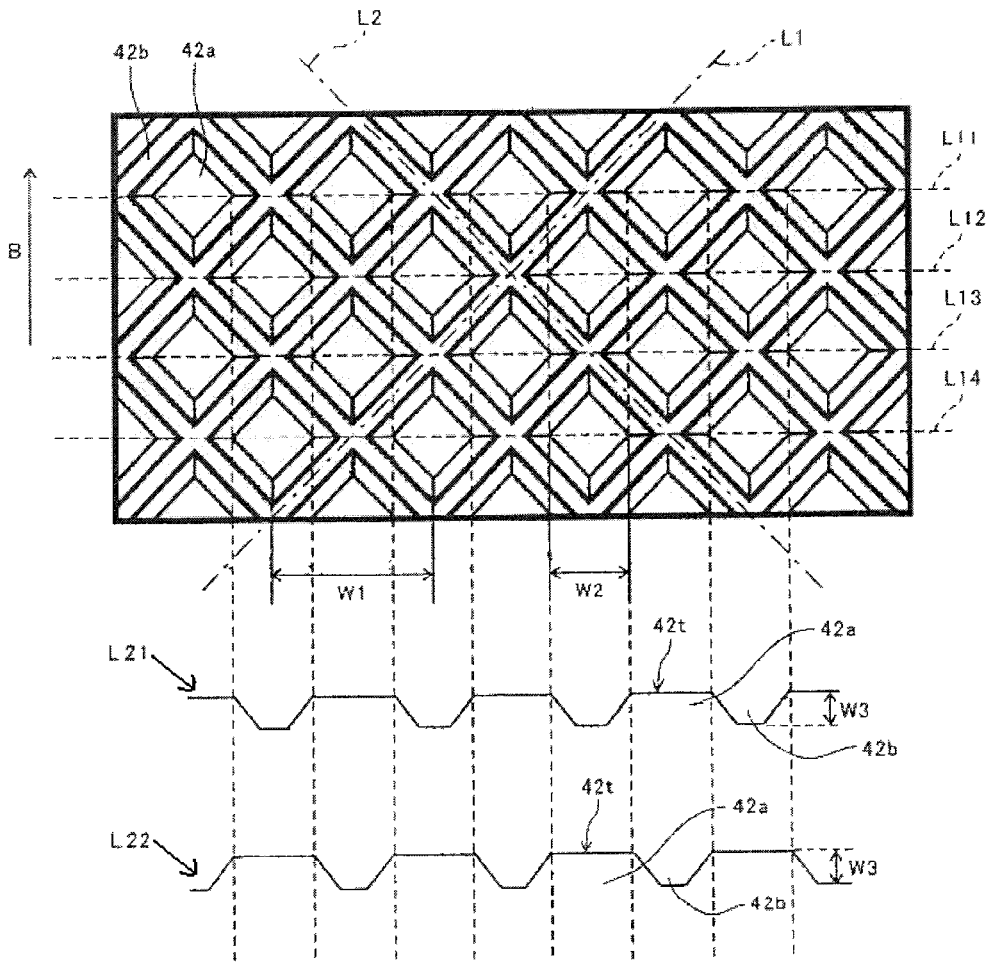
FIG. 24 is an enlarged schematic view and an enlarged sectional view of a surface of one exemplary toner bearing member.

FIG. 24 is an enlarged schematic view and two enlarged sectional views (L21 and L22) of a surface of one exemplary toner bearing member. In FIG. 24, the toner bearing member has, on its surface, regularly arranged convex portions 42*a* and concave portions 42*b* which are depressed relative to the convex portions 42*a*. The convex portions 42*a* are surrounded by a first groove L1 and a second groove L2. The first groove L1 and the second groove L2 are spiral grooves of which winding directions are different from each other. The sectional view L21 is a sectional view of a cross-section taken along L11 and L13. The sectional view L22 is a sectional view of a cross-section taken along L12 and L14. The convex portions 42*a* have a trapezoidal shape in which a base line is longer than an upper line (top face 42*t*) in the sectional views L21 and L22. The first groove L1 and the second groove L2 are inclined at a predetermined angle relative to an axial direction of the developing roller 42 (L1 and L2 are both inclined at 45° in FIG. 24, but not limited thereto).

A linear velocity of the surface of the toner bearing member when it is rotationally moved is not particularly limited and may be appropriately selected depending on the intended purpose. It is preferably 75 mm/s to 1,000 mm/s, more preferably 100 mm/s to 750 mm/s, particularly preferably 150 mm/s to 500 mm/s.

Example of a developing bias under a developing condition includes an AC bias of which frequency is 5.1 kHz and which is square waves having a 50% duty cycle.

Example of an AC component of an electric field under the developing condition includes 8.5 kV/mm.

<Regulating Member>

The regulating member is not particularly limited and may be appropriately selected depending on the intended purpose, so long as it is a member configured to regulate an amount of the toner to be moved towards the developing region. Example thereof includes a doctor blade.

A material of the regulating member is preferably metal. In other words, the regulating member is preferably formed with metal. Examples of the metal include stainless steel (SUS) and phosphor bronze.

A shape, size or structure of the regulating member is not particularly limited and may be appropriately selected depending on the intended purpose.

The regulating member preferably includes a plate-like member having a first end held by a blade holder (hereinafter the first end may be referred to simply as "end) and a second end that contacts the convex portions formed in the surface of the toner bearing member (hereinafter the second end may be referred to as "free end".)

The plate-like member is preferably a blade.

<Other Members>

Examples of the other members include a toner storing portion and a toner supplying member.

—Toner Storing Portion—

The toner storing portion is not particularly limited and may be appropriately selected depending on the intended purpose, so long as it is can store the toner.

—Toner Supplying Member—

The toner supplying member is not particularly limited and may be appropriately selected depending on the intended purpose, so long as it is a member configured to supply the toner to the surface of the toner bearing member. Example thereof includes a supplying roller. The toner supplying member will be below-exemplified in detail with reference to figures.

<Toner>

The toner contains at least a binder resin and a colorant; and, if necessary, further contains other ingredients such as a releasing agent, a charge controlling agent and an external additive.

The toner may be a monochrome toner or a color toner. The toner may contain a releasing agent in order to allow the toner to adapt to an oilless system in which a toner-sticking prevention oil is not applied onto a fixing roller.

—Binder Resin—

The binder resin is not particularly limited and may be appropriately selected depending on the intended purpose. Examples thereof include polystyrene resins, homopolymers of styrene or substituted products thereof (e.g., polyvinyltoluene resins), styrene-p-chlorostyrene copolymers, styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-α-methyl chloromethacrylate copolymers, styreneacrylonitrile copolymers, styrene-vinyl methyl ether copolymers, styrene-vinyl methyl ketone copolymers, styrene-butadiene copolymers, styrene-isoprene copolymers, styrene-maleic acid copolymers, styrene-maleic acid ester copolymers, polymethyl methacrylates, polybutyl methacrylates, polyvinyl chloride resins, polyvinyl acetate resins, polyethylene resins, polypropylene resins, polyester resins, polyurethane resins, epoxy resins, polyvinyl butyral resins, polyacrylic acid resins, rosin, modified rosin, terpene resins, phenolic resins, aliphatic hydrocarbons, aromatic petroleum resins, chlorinated paraffins and paraffin waxes. These may be used alone or in combination. Among them, particularly preferred are polyester resins from the viewpoint of capable being of decreasing the toner in melt viscosity while ensuring storage stability as compared with styrene-based resins and acrylic-based resins.

The polyester resins can be obtained, for example, through a polycondensation reaction between alcohol components and carboxylic acid components.

The alcohol components are not particularly limited and may be appropriately selected depending on the intended purpose. Example thereof include diols (e.g., polyethylene glycol, diethylene glycol, triethylene glycol, 1,2-propylene glycol, 1,3-propylene glycol, 1,4-propylene glycol, neopentyl glycol, 1,4-butenediol), 1,4-bis(hydroxymethyl)cyclohexane, bisphenol A, hydrogenated bisphenol A, etherified bisphenols (e.g., polyoxyethylene bisphenol A, polyoxypropylene bisphenol A), dihydric alcohol monomers in which the aforementioned diols are substituted with a C3-C22 saturated or unsaturated hydrocarbon group, other dihydric alcohol monomers, trihydric or higher alcohol monomers (e.g., sorbitol, 1,2,3,6-hexantetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethyrol ethane, trimethyrol propane, 1,3,5-trihydroxymethyl benzene).

The carboxylic acid components are not particularly limited and may be appropriately selected depending on the intended purpose. Examples thereof include monocarboxylic acids (e.g., palmitic acid, stearic acid and oleic acid); divalent organic acid monomer (e.g., maleic acid, fumaric acid, measaconic acid, citraconic acid, terephthalic acid, cyclohexane dicarboxylic acid, succinic acid, adipic acid, sebacic acid, malonic acid, divalent organic acid monomers in which the aforementioned acids are substituted with a C3-C22 saturated or unsaturated hydrocarbon group, and anhydrides thereof), dimer acids of lower alkylester and linoleic acid, trivalent or higher carboxylic acid monomers (e.g., 1,2,4-benzenetricarboxylic acid, 1,2,5-benzenetricarboxylic acid, 2,5,7-napthalenetricarboxylic acid, 1,2,4-naphthalenetricarboxylic acid, 1,2,4-butanetricarboxylic acid, 1,2,5-hexanetricarboxylic acid, 3,3-dicarboxylmethyl butanoic acid, tetracarboxylmethylmethane, 1,2,7,8-octanetetracarboxylic acid, Enpol trimer acid, and anhydrides thereof).

A ratio of the alcohol components and the carboxylic acid components is not particularly limited and may be appropriately selected depending on the intended purpose. For example, an equivalent ratio ([OH]/[COOH]) of hydroxyl groups [OH] to carboxyl groups [COOH] is preferably 2/1 to 1/1, more preferably 1.5/1 to 1/1, particularly preferably 1.3/1 to 1.02/1.

Example of the polycondensation reaction between the alcohol components and the carboxylic acid components includes a reaction in which the alcohol components and the carboxylic acid components are heated to 150° C. to 280° C. in the presence of a known esterification catalyst (e.g., tetrabutoxytitanate or dibutyltinoxide) with, if necessary, appropriately reducing a pressure to remove produced water to thereby obtain a hydroxyl group-containing polyester.

A hydroxyl value of the polyester resins is preferably 5 mgKOH/g or higher.

An acid value of the polyester resins is preferably 1 mgKOH/g to 30 mgKOH/g, more preferably 5 mgKOH/g to 20 mgKOH/g. When the polyester resins have the acid value, the toner is easily negatively charged and improved in low temperature fixability due to high affinity between the toner and recording paper during fixing. However, when the acid value is higher than 30 mgKOH/g, the toner may be degraded in charge stability, particularly depending on a change in the working environment.

A mass average molecular weight of the polyester resins is not particularly limited and may be appropriately selected depending on the intended purpose, but is preferably 10,000 to 400,000, more preferably 20,000 to 200,000. When the mass average molecular weight is less than 10,000, offset resistance may be deteriorated. When the mass average molecular weight is greater than 400,000, low temperature fixability may be deteriorated.

—Colorant—

The colorant is not particularly limited and may be appropriately selected from any known dyes or pigments depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These may be used alone or in combination.

An amount of the colorant contained in the toner is not particularly limited and may be appropriately selected depending on the intended purpose, but is preferably 1% by mass to 15% by mass, more preferably 3% by mass to 10% by mass.

The colorant may be mixed with a resin to form a masterbatch. The resin is not particularly limited and may be appropriately selected from any known resins depending on the intended purpose. Examples of the resin include polymers of styrene or substituted products thereof, styrene-based copolymers, polymethyl methacrylates, polybutyl methacrylates, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffins, and paraffin waxes. These may be used alone or in combination.

—Releasing Agent—

The releasing agent is not particularly limited and may be appropriately selected from any known releasing agents depending on the intended purpose. Examples thereof include waxes.

Examples of the waxes include carbonyl group-containing waxes, polyolefin waxes and long-chain hydrocarbons. These may be used alone or in combination. Among them, the carbonyl group-containing waxes are preferred.

Examples of the carbonyl group-containing waxes include polyalkanoic acid esters, polyalkanol esters, polyalkanoic acid amides, polyalkylamides and dialkylketones. Examples of the polyalkanoic acid esters include carnauba waxes, montan waxes, trimethylolpropane tribehenate, pentaerythritol tetrabehenate, pentaerythritol diacetate di behenate, glycerin tribehenate and 1,18-octadecanediol distearate. Examples of the polyalkanol esters include tristearyl trimellitate and distearyl maleate. Example of the polyalkanoic acid amides includes dibehenyl amide. Example of the polyalkylamides includes tristearyl trimellitate amides. Example of the dialkylketones includes distearylketones. Among these carbonyl group-containing waxes, polyalkanoic acid esters are particularly preferred.

Examples of the polyolefin waxes include polyethylene waxes and polypropylene waxes.

Examples of the long-chain hydrocarbons include paraffin waxes and sasol waxes.

An amount of the releasing agent contained is preferably 5% by mass to 15% by mass relative to all ingredients of the toner.

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid and metal salts of salicylic acid derivatives.

An amount of the charge controlling agent contained is not particularly limited and may be appropriately selected depending on the intended purpose, but is preferably 0.1 parts by mass to 10 parts by mass, more preferably 0.2 parts by mass to 5 parts by mass, per 100 parts by mass of the toner.

—External Additive—

The external additive is not particularly limited and may be appropriately selected depending on the intended purpose. Examples thereof include inorganic particles and resin particles. Examples of the inorganic particles include silica, titanium oxide, alumina, silicon carbide, silicon nitride and boron nitride. Examples of the resin particles include polymethyl methacrylate particles which are obtained through soap-free emulsification polymerization and which has an average particle diameter of 0.05 μm to 1 μm; and polystyrene particles which are obtained through soap-free emulsification polymerization and which has an average particle diameter of 0.05 μm to 1 μm. These may be used alone or in combination. Among them, preferred is metal oxide particles, and more preferred are hydrophobized silica or hydrophobized titanium oxide. When the toner contains the hydrophobized silica in combination with the hydrophobized titanium oxide, and an amount of the hydrophobized titanium oxide added is larger than that of the hydrophobized silica, the toner being excellent in charge stability to humidity can be obtained.

The toner is preferably a toner obtained by treating toner base particles with silica and titanium oxide serving as the external additives.

The toner is preferably a toner obtained by treating toner base particles with oil-treated silica serving as the external additive.

The oil-treated silica is preferably contained in an amount of 1.4 parts by mass to 2.8 parts by mass per 100 parts by mass of the toner base particles from the viewpoint of being capable of reducing the non-electrostatic adhesive force between the toner and the surface of the toner bearing member.

Example of the silica includes oil-treated silica. Example of the oil-treated silica includes silicone-treated silica. The silicone-treated silica is a silica of which surface is treated with silicone oil.

A method for treating the surface is not particularly limited and may be appropriately selected depending on the intended purpose.

Examples of the silicone oil include dimethyl silicone oil, methyl hydrogen silicone oil and methylphenyl silicone oil.

Commercially available silicone-treated silica can be used. Examples of the commercially available silicone-treated silica include RY200, R2T200S, NY50 and RY50 (all products of Nippon Aerosil Co., Ltd.)

—Other Ingredients—

The other ingredients are not particularly limited and may be appropriately selected depending on the intended purpose. Examples thereof include a flowability improving agent, a cleanability improving agent, a magnetic material and metal soap.

The flowability improving agent is an agent which can improve hydrophobic properties through surface treatment and can prevent flowability or chargeability from being degraded under high humidity environment. Examples thereof include silane coupling agents, silylation agents, silane coupling agents having a fluorinated alkyl group, organotitanate-based coupling agents, aluminum-based coupling agents, silicone oils, and modified silicone oils.

The cleanability improving agent is added to the toner in order to facilitate removal of a developer remaining on a post-transferred latent electrostatic image bearing member and an intermediate transfer member. Examples thereof include fatty acid metal salts and polymer particles produced through soap-free emulsification polymerization. Examples of the fatty acid metal salts include zinc stearate, calcium stearate, and stearic acid. Examples of the polymer particles produced through soap-free emulsification polymerization include polymethyl methacrylate particles produced through soap-free emulsification polymerization and polystyrene particles produced through soap-free emulsification polymerization. The polymer particles are preferably has a relatively narrow particle size distribution. Suitable volume average particle diameter of the polymer particle is 0.01 μm to 1 μm.

The magnetic material is not particularly limited and may be appropriately selected from any known magnetic materials depending on the intended purpose. Examples thereof include iron powder, magnetite and ferrite. Among them, preferred are those being white from the viewpoint of color tone.

—Toner Producing Method—

A toner producing method is not particularly limited and may be appropriately selected from any conventionally known toner producing methods depending on the intended purpose. Examples thereof include a kneading-pulverization method, a polymerization method, a dissolution-suspension method and a spray-granulation method.

—Kneading-Pulverization Method—

The kneading-pulverization method is a method in which toner materials containing at least a binder resin and a colorant are melt-kneaded, followed by pulverizing and classifying to thereby produce the toner base particles.

In the melt-kneading, the toner materials are mixed together, followed by melt-kneading in a melt-kneader. For example, single- or twin-screw continuous kneaders and batch kneaders with a roll mill can be used as the melt-kneader. Suitable examples thereof include a KTY-type twin-screw extruder (product of Kobe Steel, Ltd.), a TEM-type extruder (product of TOSHIBA MACHINE CO., LTD.), a twin-screw extruder (product of KCK Co., Ltd.), a PCM-type twin-screw extruder (product of Ikegai Co., Ltd) and a ko-kneader (product of Buss Corporation). The melt-kneading is preferably performed under appropriate conditions so as not to cut a molecular chain of the binder resin. Specifically, a melt-kneading temperature is determined based on a softening point of the binder resin. When the temperature is much higher than the softening point, the molecular chain of the binder resin is considerably cut. When the temperature is much lower than the softening point, the dispersion may not proceed well.

In the pulverization, the resultant kneaded product is pulverized. Specifically, the kneaded product is preferably rough-pulverized, and then fine-pulverized. The kneaded product is preferably pulverized by allowing it to collide against a collision plate in a jet stream, or pulverized by allowing it to collide with each other in a jet stream, or pulverized by passing it through a narrow gap between a mechanically rotating rotor and a stator.

In the classifying, the resultant pulverized product is classified to separate particles having a predetermined particle diameter. The classifying can be performed by removing fine particles using, for example, a cyclone, a decanter or a centrifuge.

After completing the pulverizing and the classifying, the pulverized product may be classified by the action of a centrifugal force in an air stream to thereby produce toner base particles having a predetermined particle diameter.

Subsequently, the toner base particles are treated with an external additive. The toner base particles and the external additive are mixed and stirred together using a mixer, whereby the resultant crushed external additive covers surfaces of the toner base particles. At this process, it is important from the viewpoint of durability that the external additive (e.g., inorganic particles or resin particles) is adhered onto the toner base particles uniformly and tightly.

—Polymerization Method—

A toner producing method by the polymerization method includes a method in which toner materials containing at least a colorant and a modified polyester resin being capable of forming a urea or urethane bond are dissolved or dispersed in an organic solvent, the resultant solution or dispersion are dispersed in an aqueous medium, followed by subjecting to polyaddition reaction, removing the solvent in the resultant dispersion liquid, and washing to thereby obtain a toner.

Example of the modified polyester resin being capable of forming a urea or urethane bond includes an isocyanate group-containing polyester prepolymer which can be produced through a reaction of a polyisocyanate compound (PIC) and a terminal-carboxyl or -hydroxyl group of polyester. A modified polyester resin which can be produced by allowing a molecular chain thereof to be cross-linked and/or elongated through a reaction of the polyester prepolymer and amines may improve hot offset resistance while maintaining low temperature fixability.

Examples of the polyisocyanate compound (PIC) include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic-aliphatic diisocyanates (e.g., $\alpha,\alpha,\alpha',\alpha'$-tetramethylxylylene diisocyanate); isocyanates; and those obtained by blocking the aforementioned polyisocyanates with, for example, a phenol derivative, oxime or caprolactam. These may be used alone or in combination.

A ratio of the polyisocyanate compound (PIC) is preferably 5/1 to 1/1, more preferably 4/1 to 1.2/1, particularly preferably 2.5/1 to 1.5/1, in terms of an equivalent ratio ([NCO]/[OH]) of isocyanate groups [NCO] to hydroxyl groups [OH].

The number of isocyanate groups contained per one molecule of the isocyanate group-containing polyester prepolymer (A) is preferably 1 or more, more preferably 1.5 to 3 on average, particularly preferably 1.8 to 2.5 on average.

An amount of the polyisocyanate compound (PIC) contained in the isocyanate group-containing polyester prepolymer (A) is not particularly limited and may be appropriately selected depending on the intended purpose, but is preferably 0.5% by mass to 40% by mass, more preferably 1% by mass to 30% by mass, particularly preferably 2% by mass to 20% by mass. When the amount is less than 0.5% by mass, hot offset resistance may be deteriorated, which may be disadvantageous in achieving both heat resistance storageability and low temperature fixability. When the amount is greater than 40% by mass, low temperature fixability may be deteriorated.

Examples of the amines (B) which is reacted with the polyester prepolymer include divalent amine compounds (B1), trivalent or higher amine compounds (B2), amino alcohols (B3), aminomercaptans (B4), amino acids (B5), and amino-blocked products (B6) of the amines (B1) to (B5).

Examples of the divalent amine compounds (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminecyclohexane and isophoronediamine); and aliphatic diamines (e.g., ethylenediamine, tetramethylenediamine and hexamethylenediamine).

Examples of the trivalent or higher amine compounds (B2) include diethylenetriamine and triethylenetetramine.

Examples of the amino alcohols (B3) include ethanolamine and hydroxyethylaniline.

Examples of the aminomercaptans (B4) include aminoethyl mercaptan and aminopropyl mercaptan.

Examples of the amino acids (B5) include aminopropionic acid and aminocaproic acid.

Examples of the amino-blocked products (B6) of the amines (B1) to (B5) include ketimine compounds and oxazolidine compounds derived from the amines (B1) to (B5) and ketones (e.g., acetone, methyl ethyl ketone and methyl isobutyl ketone). Among these amines (B), particularly preferred are B1 and a mixture of B1 and a small amount of B2.

A ratio of the amines (B) is preferably 1/2 to 2/1, more preferably 1.5/1 to 1/1.5, particularly preferably 1.2/1 to 1/1.2, in terms of an equivalent ratio ([NCO]/[NHx]) of isocyanate groups [NCO] in the isocyanate group-containing polyester prepolymer (A) to amino groups [NHx] in the amines (B).

The toner producing method by the polymerization method as described above can produce spherical toner particles having small particle diameters at low costs with less environmental load.

The disperser used for the dispersion is not particularly limited and may be appropriately selected depending on the intended purpose. Examples thereof include a low-speed shearing disperser, a high-speed shearing disperser, a friction disperser, a high-pressure jetting disperser or an ultrasonic disperser.

Among them, the high-speed shearing disperser is preferred in that dispersoids (oil droplets) can be controlled so as to have a particle diameter of 2 μm to 20 μm.

When the high-speed shearing disperser is used, dispersion conditions such as a rotating speed, a dispersion time or a dispersion temperature may be appropriately selected depending on the intended purpose.

The rotating speed is not particularly limited and may be appropriately selected depending on the intended purpose, but is preferably 1,000 rpm to 30,000 rpm, more preferably 5,000 rpm to 20,000 rpm.

The dispersion time is not particularly limited and may be appropriately selected depending on the intended purpose, but is preferably 0.1 min to 5 min in the case of a batch manner.

The dispersion temperature is not particularly limited and may be appropriately selected depending on the intended purpose, but is preferably 0° C. to 150° C., more preferably from 40° C. to 98° C. under pressure. Generally, the higher dispersion temperature is, the easier dispersoids are dispersed.

An amount of the aqueous medium used when the toner materials are dispersed in the aqueous medium is not particularly limited and may be appropriately selected depending on the intended purpose. It is preferably 50 parts by mass to 2,000 parts by mass, more preferably 100 parts by mass to 1,000 parts by mass, per 100 parts by mass of the toner materials.

A method for removing the organic solvent from the dispersion liquid is not particularly limited and may be appropriately selected depending on the intended purpose. There can be employed a method in which the entire system is gradually increased in temperature to evaporate off the organic solvent contained in the oil droplets. Alternatively, there can be employed a method in which the dispersion liquid is sprayed to a dry atmosphere to thereby evaporate off the organic solvent contained in the oil droplets.

Removal of the organic solvent results in forming the toner base particles. The toner base particles may be washed, dried, and further classified. The toner base particles may be classified by removing fine particles using, for example, a cyclone, a decanter or a centrifuge in liquid. Alternatively, post-dried toner base particles may be classified.

The resultant toner base particles may be mixed with particles such as the external additive and the charge controlling agent. At this time, mechanical impact can be applied in order to prevent the external additive from being exfoliated from the surfaces of the toner base particles.

A method for applying the mechanical impact is not particularly limited and may be appropriately selected depending on the intended purpose. Examples thereof include a method in which impact is applied to a mixture using a high-speed rotating blade and a method in which a mixture is caused to pass through a high-speed airflow for acceleration to thereby allow particles to collide with each other or against an appropriate collision plate.

A device used in applying the mechanical impact is not particularly limited and may be appropriately selected depending on the intended purpose. Examples thereof include ONGMILL (product of Hosokawa Micron Corp.), a modified I-type mill (product of Nippon Neumatic Co., Ltd.) so as to reduce the pulverizing air pressure, HYBRIDIZATION SYSTEM (product of Nara Machinery Co., Ltd.), CRYPTRON SYSTEM (production of Kawasaki Heavy Industries, Ltd.) and an automatic mortar.

The toner preferably has an accelerated aggregation rate of 40% or less. The accelerated aggregation rate of toner is measured as follows.

[Measurement Device]

Powder Tester (product of Hosokawa Micron Corp.)

[Measurement Method]

A measurement sample is left in a thermostat bath (35±2° C., 24±1 hours).

Measurement is performed using the Powder Tester.

Three types of sieves with different opening sizes are used (e.g., 75 μm, 44 μm and 22 μm).

The aggregation rate is calculated from an amount of the toner remaining on each sieve according to the following expressions:

{(weight of toner remaining on an upper sieve)/(collected amount of sample)}×100, {(weight of toner remaining on a middle sieve)/(collected amount of sample)}×100×3/5,and {(weight of toner remaining on a lower sieve)/(collected amount of sample)}×100×1/5.

A total of the three values calculated from the above expressions is determined as the accelerated aggregation rate (%).

The accelerated aggregation rate of the toner is an index determined as follows: the three types of sieves with different opening sizes described above are stacked in order from a sieve with larger opening size to a sieve with smaller opening size, and then particles are placed on an uppermost sieve and are sieved under constant vibration, followed by measuring the weight of the toner remaining on each sieve.

An average circularity of the toner is not particularly limited and may be appropriately selected depending on the intended purpose, but is preferably 0.90 or more, more preferably 0.90 to 1.00.

The average circularity can be as follows.

A circularity "a" is defined as a value calculated according to the following Expression (1). This circularity is indicative of the degree of unevenness of each toner particle. When the toner particle is perfectly spherical, the circularity is 1.00. Meanwhile, the more complex the surface shape of the toner particle becomes, the smaller the circularity is.

$$\text{Circularity } a = L0/L \qquad \text{Expression (1)}$$

In Expression (1), L0 denotes a circumferential length of a circle having the same projected area as that of the particle, and L denotes a circumferential length of projected particle image.

When the average circularity is in the range of 0.90 to 1.00, the surface of toner particles is smooth, and the area where the toner particles are in contact with one another and the area where the toner particles are in contact with the latent electrostatic image bearing member are small, so that excellent transferability can be obtained.

When the average circularity is in the range of 0.90 to 1.00, the toner particles do not have corners, so that the torque with which a developer (toner) is agitated in a developing device can be reduced and the driving for agitation can be stabilized, which can prevent abnormal images from occurring.

Also, since the toner particles which form dots do not include angular toner particles, pressure is uniformly applied to the entire toner particles when they are transferred and pressed against a transfer medium, and thus absence of toner particles hardly arises during the transfer.

Further, since the toner particles are not angular, the toner particles themselves have little abrasive power, which can prevent the surface of the latent electrostatic image bearing member or a charging member from being damaged or abraded.

A method for measuring the average circularity now will be explained. The average circularity can be measured using a flow-type particle image analyzer FPIA-1000 (product of Toa Medical Electronics Co., Ltd.).

Specifically, 0.1 mL to 0.5 mL of a surfactant (preferably alkylbenzene sulfonate) is added as a dispersant into 100 mL to 150 mL of water in a container, from which solid impurities have previously been removed. Then, about 0.1 g to about 0.5 g of a measurement sample is added thereto. The suspension liquid in which the sample is dispersed is subjected to dispersing treatment by an ultrasonic disperser for about 1 min to about 3 min, and the concentration of the dispersed liquid is adjusted such that the number of particles of the sample is 3,000 per microliter to 10,000 per microliter. In this state, the shape and particle size of the toner are measured using the analyzer.

The volume average particle diameter of the toner is not particularly limited and may be appropriately selected depending on the intended purpose. It is preferably 3 μm to 8 μm from the viewpoint of being capable of reproducing fine dots of 600 dpi (dots per inch) or more (1 inch=25.4 mm). When the volume average particle diameter falls within this range, excellent dot reproducibility can be obtained because the toner contains particles which are sufficiently small in diameter with respect to fine dots of a latent image. When the volume average particle diameter is less than 3 μm, a phenomenon easily arises in which there is a decrease in developing efficiency and blade cleanability. When it is greater than 8 μm, it may be difficult to suppress raggedness of lines and letters.

A ratio (Dv/Dn) of the volume average particle diameter (Dv) to a number average particle diameter (Dn) is not particularly limited and may be appropriately selected depending on the intended purpose. It is preferably 1.00 to 1.40. The closer the value of the ratio (Dv/Dn) is to 1.00, the sharper the particle size distribution is. In such a toner having a small particle diameter and a narrow particle size distribution, charge amounts of the toner are uniformly distributed, resulting in a high-quality image with less fogging and high transferring efficiency in an electrostatic transfer mode.

Next, a method for measuring the particle size distribution of toner particles will be explained. Examples of a measuring device for measuring the particle size distribution of toner particles in accordance with the Coulter counter method include COULTER COUNTER TA-II and COULTER MULTISIZER II (both products are of Coulter Corporation). The specific measurement procedure is given below.

First, 0.1 mL to 5 mL of a surfactant (preferably alkylbenzene sulfonate) is added as a dispersant into 100 mL to 150 mL of an electrolytic aqueous solution. Here, the electrolytic aqueous solution means an approximately 1% by mass NaCl aqueous solution prepared using a primary sodium chloride. For the preparation, ISOTON-II (product of Coulter Corporation) can be used, for example. Then, 2 mg to 20 mg of a measurement sample is added. The electrolytic aqueous solution in which the sample is suspended is subjected to dispersing treatment by an ultrasonic disperser for about 1 min to about 3 min, then the volume of the toner or toner particles and the number of the toner particles are measured by the measuring device using apertures of 100 μm each, and the volume distribution and the number distribution are calculated. The volume average particle diameter (Dv) and the number average particle diameter (Dn) of the toner can be calculated from these distributions obtained.

As channels, the following 13 channels are used, and particles having diameters of equal to or greater than 2.00 μm but less than 40.30 μm are targeted: a channel of 2.00 μm or greater but less than 2.52 μm; a channel of 2.52 μm or greater but less than 3.17 μm; a channel of 3.17 μm or greater but less than 4.00 μm; a channel of 4.00 μm or greater but less than 5.04 μm; a channel of 5.04 μm or greater but less than 6.35 μm; a channel of 6.35 μm or greater but less than 8.00 μm; a channel of 8.00 μm or greater but less than 10.08 μm; a channel of 10.08 μm or greater but less than 12.70 μm; a channel of 12.70 μm or greater but less than 16.00 μm; a channel of 16.00 μm or greater but less than 20.20 μm; a channel of 20.20 μm or greater but less than 25.40 μm; a channel of 25.40 μm or greater but less than 32.00 μm; and a channel of 32.00 μm or greater but less than 40.30 μm.

A shape factor of the toner is not particularly limited and may be appropriately selected depending on the intended purpose. A shape factor SF-1 is preferably 100 to 180, and a shape factor SF-2 is preferably 100 to 180.

The shape factors SF-1 and SF-2 can be determined as follows. FE-SEM images of a toner are taken by FE-SEM (S-4200, product of Hitachi, Ltd.) Among the FE-SEM images, 300 images are randomly sampled. Image information of the sampled images are introduced to an image analyzer (LUZEX AP, product of Nireco Corporation) via an interface, followed by analyzing and calculating according to the following expressions. The resultant values are defined as SF-1 and SF-2, respectively. The values of SF-1 and SF-2 are preferably determined by LUZEX, but any other FE-SEM devices and image analyzers can be used so long as similar analysis results can be obtained.

$$SF\text{-}1=(L^2/A)\times(\pi/4)\times 100$$

$$SF\text{-}2=(P^2/A)\times(1/4\pi)\times 100$$

In the above expressions, L denotes an absolute maximum length of the toner; A denotes a projected area of the toner; and P denotes a maximum circumferential length of the toner. When a toner has a spherical shape, both the values of SF-1 and SF-2 are 100. As the values become larger than 100, the shape of the toner changes from the spherical shape to an undefined shape. Particularly, SF-1 is an index of an entire shape (such as ellipse or sphere) of the toner, and SF-2 is an index of the degree of unevenness of the toner surface.

Next, there will be explained a suitable shape of the toner.

Figure 3A:
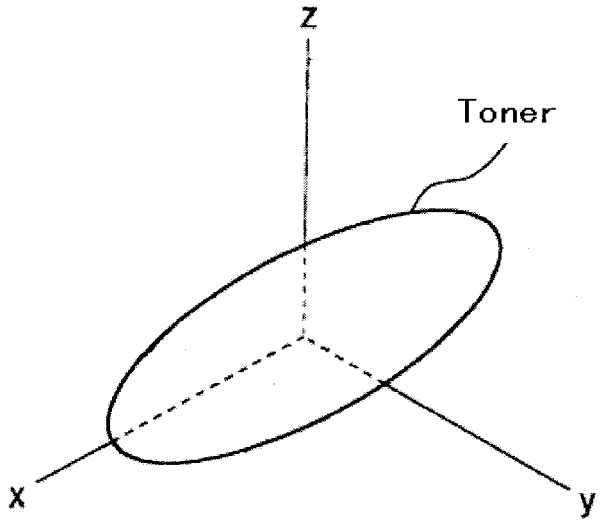
FIG. 3A is a schematic view of one exemplary shape of a toner used in the present invention (1/3).
Figure 3B:
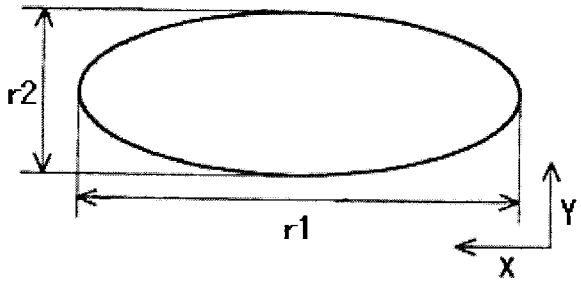
FIG. 3B is a schematic view of one exemplary shape of a toner used in the present invention (2/3).
Figure 3C:
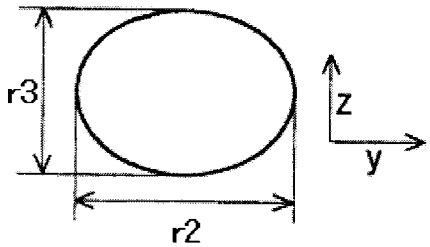
FIG. 3C is a schematic view of one exemplary shape of a toner used in the present invention (3/3).

FIGS. 3A to 3C are a schematic view of one exemplary shape of a toner used in the present invention. In FIGS. 3A to 3C, when the toner is defined by a long axis r1, a short axis r2, and a thickness r3, where r1≥r2≥r3, the toner has preferably a ratio of the short axis r2 to the long axis r1 (r2/r1) (see FIG. 3B) of 0.5 to 1.0 and a ratio of the thickness r3 to the short axis r2 (r3/r2) (see FIG. 3C) of 0.7 to 1.0. When the ratio of the short axis r2 to the long axis r1 (r2/r1) is less than 0.5, the toner is deteriorated in dot reproducibility and developing efficiency due to its non-spherical shape, which may make it difficult to achieve a high-grade image quality. When the ratio of the thickness r3 to the short axis r2 (r3/r2) is less than 0.7, the toner has a more flattened shape, so that transfer rate may be lower than that of a spherical toner. Especially, when the ratio of the thickness r3 to the short axis r2 (r3/r2) is 1.0, the toner is a rotationally symmetric body of which rotation axis is the long axis, which can improve flowability.

Notably, the r1, the r2, and the r3 can be measured by observing the toner and taking its photographs with varying viewing angles under a scanning electron microscope (SEM).

(Image Forming Apparatus and Image Forming Method)

An image forming apparatus of the present invention includes at least a latent electrostatic image bearing member and a developing unit; and, if necessary, includes other units.

An image forming method of the present invention includes at least a developing step; and, if necessary, includes other steps.

The image forming method can be suitably performed with the image forming apparatus. The developing step can be performed with the developing unit.

<Latent Electrostatic Image Bearing Member>

In the latent electrostatic image bearing member, for example, its material, shape, structure or size is not particularly limited and may be appropriately selected depending on the intended purpose. Suitable example of the shape includes a drum shape. Examples of the material include inorganic photoconductors such as amorphous silicon or selenium; and organic photoconductors such as polysilane or phthalopolymethine. Among them, amorphous silicon is preferably used from the viewpoint from a long service life.

Example of the amorphous silicon photoconductors includes a photoconductor having a photoelectroconductive layer made of a-Si (amorphous silicon). The photoelectroconductive layer is formed on a support which has been heated to 50° C. to 400° C., using various film-forming methods such as a vacuum deposition method, a sputtering method, an ion-plating method, a thermal CVD (chemical vapor deposition) method, a photo-assisted CVD method and a plasma CVD method. Among them, the plasma CVD method is suitable in which source gas is decomposed by direct current, high-frequency or microwave glow discharge to thereby form an a-Si deposition film on the support.

A shape of the latent electrostatic image bearing member is not particularly limited and may be appropriately selected depending on the intended purpose, but is preferably cylindrical. An outer diameter of the cylindrical latent electrostatic image bearing member is not particularly limited and may be appropriately selected depending on the intended purpose. It is preferably 3 mm to 100 mm, more preferably 5 mm to 50 mm, particularly preferably 10 mm to 30 mm.

A linear velocity of the surface of the latent electrostatic image bearing member when it is rotationally moved is not particularly limited and may be appropriately selected depending on the intended purpose. It is preferably 50 mm/s to 500 mm/s, more preferably 100 mm/s to 300 mm/s, particularly preferably 125 mm/s to 200 mm/s.

<Developing Step and Developing Unit>

The developing unit is not particularly limited and may be appropriately selected depending on the intended purpose, so long as it is a unit configured to develop with a toner the latent electrostatic image which has been formed on the latent electrostatic image bearing member to thereby form a visible image and is the developing device of the present invention.

The developing step is not particularly limited and may be appropriately selected depending on the intended purpose, so long as it is a step of developing with a toner the latent electrostatic image which has been formed on the latent electrostatic image bearing member to thereby form a visible image. The developing step can be performed using the developing unit.

A distance (developing gap) between the surface of the toner bearing member and the surface of the latent electrostatic image bearing member in the developing region is not particularly limited and may be appropriately selected depending on the intended purpose. It is preferably 150 μm to 300 μm. When the distance is less than 150 μm, there is an increased risk of an electric discharge from the surface of the toner bearing member to the latent electrostatic image bearing member, so that an abnormal image may be formed in the electric-discharged area. When the distance is more than 300 μm, more strong power source is required because a larger developing bias is needed to be applied. Also, due to an increased electric field, a background smear may be occurred unless an electric potential contrast is increased on the surface of the latent electrostatic image bearing member.

Figure 5:
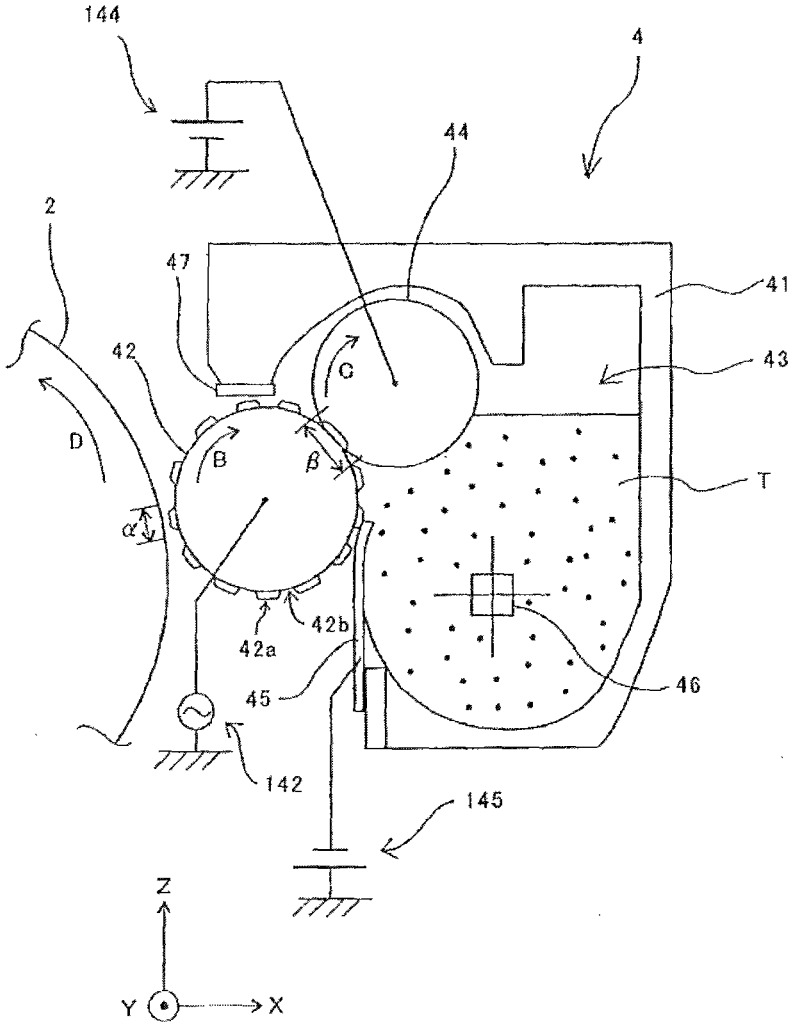
FIG. 5 is a schematic sectional view of one exemplary developing device of the present invention.

Notably, the distance means a distance between the top face 42*t* of the convex portion 42*a* on the developing roller 42 and the surface of the latent electrostatic image bearing member 2 in the developing region α, as shown in FIGS. 5 and 24.

<Other Units and Other Steps>

—Latent Electrostatic Image Forming Unit and Latent Electrostatic Image Forming Step—

The latent electrostatic image forming unit is not particularly limited and may be appropriately selected depending on the intended purpose, so long as it is a unit configured to form the latent electrostatic image on the latent electrostatic image bearing member. Example thereof includes a unit including at least a charging member configured to charge the surface of the latent electrostatic image bearing member and an exposing member configured to imagewise-expose the surface of the latent electrostatic image bearing member.

The latent electrostatic image forming step is not particularly limited and may be appropriately selected depending on the intended purpose, so long as it is a step of forming the latent electrostatic image on the latent electrostatic image bearing member. The latent electrostatic image forming step can be performed by charging the surface of the latent electrostatic image bearing member, followed by imagewise exposing, and can be performed with the latent electrostatic image forming unit.

—Charging member and Charging—

The charging member is not particularly limited and may be appropriately selected depending on the intended purpose. Examples thereof include contact-type chargers known per se having, for example, an electroconductive or semielectroconductive roller, brush, film or rubber blade; and non-contact-type chargers utilizing colona discharge such as corotron or scorotron.

The charging can be performed by applying a voltage to the surface of the latent electrostatic image bearing member using the charging member.

The charging member may have any shape such as a roller, a magnetic brush or a fur brush. The shape may be suitably selected according to the specification or configuration of the image forming apparatus.

When the magnetic brush is used as the charging member, the magnetic brush includes various ferrite particles such as Zn—Cu ferrite serving as the charging member, a non-magnetic electroconductive sleeve for supporting the ferrite particles, and a magnetic roller included in the non-magnetic electroconductive sleeve.

When the fur brush is used as the charging member, the fur brush may be made of a fur which has been electroconductive-treated with, for example, carbon, copper sulfide, a metal or a metal oxide. The fur is coiled around or mounted to a metal or other electroconductive-treated cores to thereby form the charging member.

The charging member is not limited to the aforementioned contact-type charging members. However, the contact-type charging members are preferably used from the viewpoint of producing an image forming apparatus in which an amount of ozone generated from the charging member is reduced.

—Exposing member and Exposing—

The exposing member is not particularly limited and may be appropriately selected depending on the intended purpose, so long as it can imagewise expose the surface of the latent electrostatic image bearing member which has been charged with the charging member. Examples of the exposing member include various exposing members such as a copy optical exposing member, a rod lens array exposing member, a laser optical exposing member and a liquid crystal shutter exposing member.

A light source used for the exposing member is not particularly limited and may be appropriately selected depending on the intended purpose. Examples thereof include any illuminant such as a fluorescent lamp, a tungsten lamp, a halogen lamp, a mercury lamp, a sodium lamp, a light-emitting diode (LED), a semiconductor laser (LD) and an electroluminescence (EL).

Also, a filter may be used for irradiating only light having a desired wavelength. Examples of the filter include various filters such as sharp-cut filter, a band-pass filter, an infrared cut filter, a dichroic filter, an interference filter and a color temperature conversion filter.

The exposing may be performed by imagewise exposing the surface of the latent electrostatic image bearing member using the exposing member.

A light backside method in which the backside of the latent electrostatic image bearing member is imagewise exposed to light may be adopted in the present invention.

—Transfer Unit and Transfer Step—

The transfer unit is not particularly limited and may be appropriately selected depending on the intended purpose, so long as it is a unit configured to transfer a visible image onto a recording medium. Suitable example thereof includes a unit including a primary transfer unit configured to transfer the visible image onto an intermediate transfer member to thereby form a composite transfer image, and a secondary transfer unit configured to transfer the composite transfer image onto the recording medium.

The transfer step is not particularly limited and may be appropriately selected depending on the intended purpose, so long as it is a step of transferring a visible image onto a recording medium. Suitable example thereof includes a step in which the visible image is primarily transferred to an intermediate transfer member and then secondarily transferred to the recording medium.

The transfer step can be performed by charging the latent electrostatic image bearing member using a transfer-charger, and can be performed with the transfer unit.

Here, when the secondarily transferred image on the recording medium is a color image formed with a plurality of color toners, toner images of each colors may be sequentially superposed on top of one another on the intermediate transfer member using the transfer unit to thereby form a composite image on the intermediate transfer member, and then the composite image on the intermediate transfer member may be secondarily transferred to the recording medium at one time using the intermediate transfer unit.

The intermediate transfer member is not particularly limited and may be appropriately selected from any known transfer members depending on the intended purpose. Suitable example thereof includes a transfer belt.

The transfer unit (the primary transfer unit and the secondary transfer unit) preferably includes a transfer device which transfers through charging the visible image which has been formed on the latent electrostatic image bearing member onto the recording medium. Examples of the transfer device include a corona transfer device employing corona discharge, a transfer belt, a transfer roller, a press transfer roller and an adhesive transfer device.

Notably, the recording medium is typically plain paper. However, the recording medium is not particularly limited and may be appropriately selected depending on the intended purpose, so long as it can transfer a developed but unfixed image. Example thereof includes a PET base film used as an OHP film.

—Fixing Unit and Fixing Step—

The fixing unit is not particularly limited and may be appropriately selected depending on the intended purpose, so long as it is a unit configured to fix a transfer image which has been transferred onto the recording medium. Suitable examples thereof include any known heating-pressing members. Examples of the heating-pressing members include a combination of a heating roller and a pressing roller; and a combination of a heating roller, a pressing roller and an endless belt.

The fixing step is not particularly limited and may be appropriately selected depending on the intended purpose, so long as it is a step of fixing a transfer image which has been transferred onto the recording medium. The fixing may be performed every after a toner image of each color is transferred onto the recording medium; or the fixing may be performed at one time after toner images of all colors are superposed on top of one another on the recording medium.

The fixing step can be performed with the fixing unit.

Usually, the heating with the heating-pressing member is preferably performed at 80° C. to 200° C.

Notably, in the present invention, for example, known light fixing devices may be used in addition to or instead of the fixing unit depending on the intended purpose.

The surface pressure at the fixing step is not particularly limited and may be appropriately selected depending on the intended purpose. It is preferably 10 $N/cm^2$ to 80 $N/cm^2$.

—Charge-Eliminating Unit and Charge-Eliminating Step—

The charge-eliminating unit is not particularly limited and may be appropriately selected depending on the intended purpose, so long as it is a unit configured to apply a charge-eliminating bias to the latent electrostatic image bearing member to thereby charge-eliminate the latent electrostatic image bearing member. Example thereof includes a charge-eliminating lamp.

The charge-eliminating step is not particularly limited and may be appropriately selected depending on the intended purpose, so long as it is a step of applying a charge-eliminating bias to the latent electrostatic image bearing member to thereby charge-eliminate the latent electrostatic image bearing member. The charge-eliminating step can be performed using the charge-eliminating unit.

—Cleaning Unit and Cleaning Step—

The cleaning unit is not particularly limited and may be appropriately selected depending on the intended purpose, so long as it is a unit configured to remove the toner remaining on the latent electrostatic image bearing member. Examples thereof include magnetic blush cleaners, electrostatic brush cleaners, magnetic roller cleaners, blade cleaners, brush cleaners and web cleaners.

The cleaning step is not particularly limited and may be appropriately selected depending on the intended purpose, so long as it is a step of removing the toner remaining on the latent electrostatic image bearing member. The cleaning step can be performed with the cleaning unit. Notably, a method in which the residual toner is uniformly charged by a rubbing member and then recovered by the developing roller may be adopted without using the cleaning unit.

—Recycling Unit and Recycling Step—

The recycling unit is not particularly limited and may be appropriately selected depending on the intended purpose, so long as it is a unit configured to recycle the toner which has been removed in the cleaning step to the developing device. Examples thereof include known conveyance units.

The recycling step is not particularly limited and may be appropriately selected depending on the intended purpose, so long as it is a step of recycling the toner which has been removed in the cleaning step to the developing device. The recycling step can be performed with the recycling unit.

—Controlling Unit and Controlling Step—

The controlling unit is not particularly limited and may be appropriately selected depending on the purpose, so long as it is a unit configured to control the operation of each of the above units. Examples thereof include devices such as a sequencer and a computer.

The controlling step is not particularly limited and may be appropriately selected depending on the purpose, so long as it is a step of controlling the operation of each of the above units. The controlling step can be performed with the controlling unit.

In the image forming apparatus and the image forming method, a voltage in which an alternating current (AC) component is superimposed on a direct current (DC) component is preferably applied between the electrostatic image bearing member and the toner bearing member. Because the toner bearing member has convex portions, so that gaps between the toner bearing member and the latent electrostatic image bearing member are uneven. In addition, when the AC component is superimposed on the DC component, the toner can more frequently reach the latent electrostatic image bearing member and can easily adhere onto the latent electrostatic image on the latent electrostatic image bearing member.

There now will be explained one exemplary developing device, image forming apparatus and image forming method according to the present invention with reference to figures.

[Image Forming Apparatus]

Figure 4:
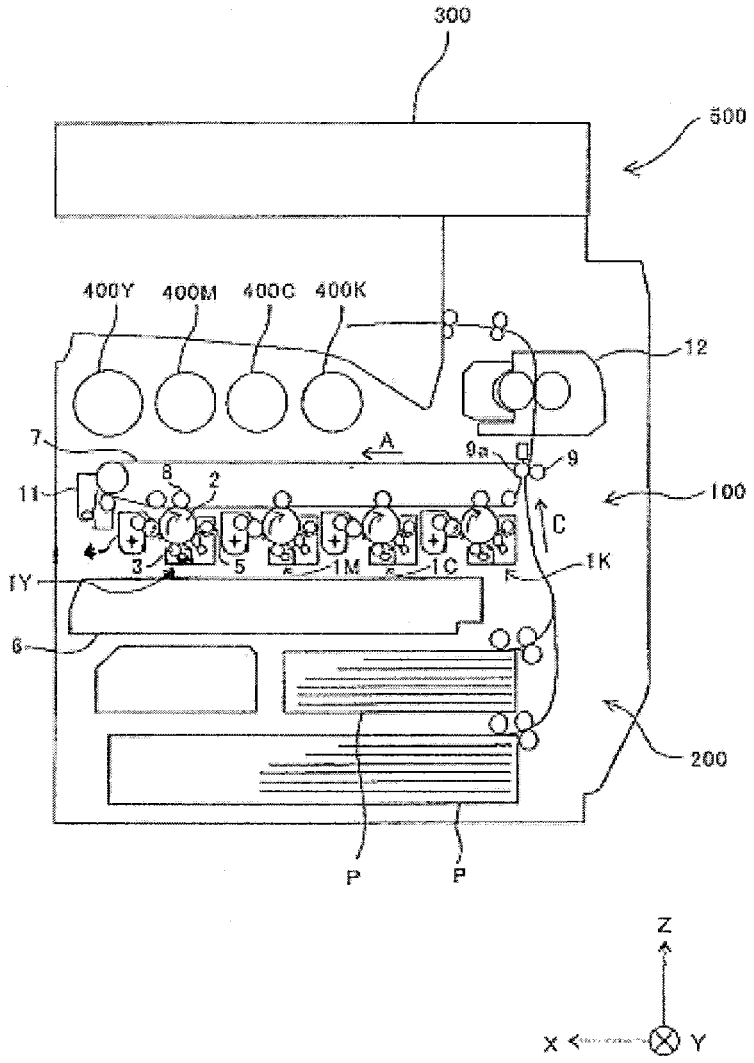
FIG. 4 is a schematic sectional view of one exemplary image forming apparatus of the present invention.

FIG. 4 is a schematic sectional view of one exemplary image forming apparatus of the present invention. A copier 500 shown in FIG. 4 includes a copying device main body (hereinafter may be referred to as a printer portion 100), a paper feeding table (hereinafter may be referred to as a paper feeding portion 200), and a scanner installed in the printer portion 100 (hereinafter may be referred to as a scanner portion 300).

The printer portion 100 includes a process cartridge 1 (1Y, 1M, 1C and 1K) which is composed of four process units, an intermediate transfer belt 7 serving as the intermediate transfer member which is stretched by a plurality of stretching rollers to move in a direction indicated by an arrow A shown in FIG. 4, an exposing device 6 serving as the exposing member, and a fixing device 12 serving the fixing unit.

In the four process cartridges, alphabets Y, M, C, and K described behind the reference numeral denotes yellow, magenta, cyan and black, respectively. The four process cartridges (1Y, 1M, 1C and 1K) have the same configuration as each other, except that toner used therein are different in color. Accordingly, hereinafter the four process cartridges will be described with the alphabets Y, M, C, and K omitted.

The process cartridge 1 has a unit configuration which integrally supports a latent electrostatic image bearing member 2, a charging member 3, a developing device 4 serving as the developing device, and a cleaning device 5 serving as the cleaning unit. Each process cartridge 1 can be detached from the main body of the copier 500 by removing a stopper (not shown).

The latent electrostatic image bearing member 2 rotates in a clockwise direction, that is, in a direction indicated by an arrow in FIG. 4. The charging member 3, which is a charging roller, is press-contacted with a surface of the latent electrostatic image bearing member 2, and is driven by a rotation of the latent electrostatic image bearing member 2. Upon forming an image, a predetermined bias is applied to the charging member 3 by a high voltage power supply (not shown) to thereby charge the surface of the latent electrostatic image bearing member 2. In the process cartridge 1, the charging member used is the roller-shaped charging member 3 being in contact with the surface of the latent electrostatic image bearing member 2, but not limited thereto. For example, non-contact-type charging utilizing colona discharge may be used.

The exposing device 6 exposes the surface of the latent electrostatic image bearing member 2 to light based on image information of a document image which has been read by the scanner portion 300 or an image information which has been inputted by an external device (e.g., personal computer) to thereby form the latent electrostatic image on the surface of the latent electrostatic image bearing member 2. The exposing device 6 in the printer portion 100 adopts a laser beam scanner mode using a laser diode, but other configuration such as those using a LED array may be used as the exposing member.

The cleaning device 5 cleans a transfer residual toner remaining on the surface of the latent electrostatic image bearing member 2 after the toner has passed through a position facing the intermediate transfer belt 7.

Four process cartridges 1 form toner images (visible images) of black, yellow, magenta and cyan on the corresponding latent electrostatic image bearing members 2. The four process cartridges 1 are disposed in parallel with each other in a surface-moving direction of the intermediate transfer belt 7. The four process cartridges 1 sequentially transfers the toner images which have been formed on the corresponding latent electrostatic image bearing members 2 to the intermediate transfer belt 7 so as to be superposed on top of one another to thereby form a visible image on the intermediate transfer belt 7.

In FIG. 4, primary transfer rollers 8 serving as the primary transfer unit are disposed at positions facing the latent electrostatic image bearing members 2 across the intermediate transfer belt 7. A primary transfer bias is applied to the primary transfer rollers 8 by the high voltage power supply (not shown) to thereby form primary transfer electric fields between the primary transfer rollers 8 and the latent electrostatic image bearing members 2. By the action of the primary transfer electric fields, the toner images which have been formed on the surfaces of the latent electrostatic image bearing members 2 are transferred to the surface of the intermediate transfer belt 7. One of the plurality of stretching rollers which stretch the intermediate transfer belt 7 is rotated by a drive motor (not shown) to thereby move the surface of the intermediate transfer belt 7 in the direction indicated by the arrow A in FIG. 4. The toner images are sequentially transferred on the moving surface of the intermediate transfer belt 7 so as to be superposed on top of one another to thereby form a full-color image on the surface of the intermediate transfer belt 7.

A secondary transfer roller 9 is disposed downstream of a position where the four process cartridges 1 face the intermediate transfer belt 7 in the surface-moving direction of the intermediate transfer belt 7 so as to face a secondary transfer facing roller 9*a*, which is one of the stretching rollers, across the intermediate transfer belt 7. Thus, a secondary transfer nip is formed between the secondary transfer roller 9 and the intermediate transfer belt 7. A predetermined voltage is applied between the secondary transfer roller 9 and the secondary transfer facing roller 9*a* to thereby form a secondary transfer electric field. At a time when transfer paper P, which is transfer material having been fed from the paper feeding portion 200 and conveyed in a direction indicated by an arrow C in FIG. 4, passes through the secondary transfer nip, the full-color image which has been formed on the surface of the intermediate transfer belt 7 is transferred to the transfer paper P by the action of the secondary transfer electric field which has been formed between the secondary transfer roller 9 and the secondary transfer facing roller 9*a*.

The fixing device 12 is disposed downstream of the secondary transfer nip in a conveying direction of the transfer paper P. The transfer paper P passes through the secondary transfer nip and then reaches the fixing device 12, where the full-color image which has been transferred on the transfer paper P is fixed with heating and pressuring by the fixing device 12. The transfer paper P on which the image has been fixed is discharged out of the copier 500.

Meanwhile, the toner which has not transferred to the transfer paper P at the secondary transfer nip and remains on the surface of the intermediate transfer belt 7 is collected by the transfer belt-cleaning device 11.

As shown in FIG. 4, above the intermediate transfer belt 7, toner bottles configured to store each color toner (400Y, 400M, 400C, and 400K) are detachably attached to the copier 500.

The toners stored in the toner bottles (400Y, 400M, 400C, and 400K) are supplied to the corresponding developing devices 4 by the corresponding toner supplying devices (not shown).

[Developing Device]

There now will be explained one exemplary developing device of the present invention.

FIG. 5 is a schematic sectional view of one exemplary developing device 4 of the present invention. FIG. 5 is a schematic sectional view of the developing device shown in FIG. 4 viewed from the back side.

Figure 6:
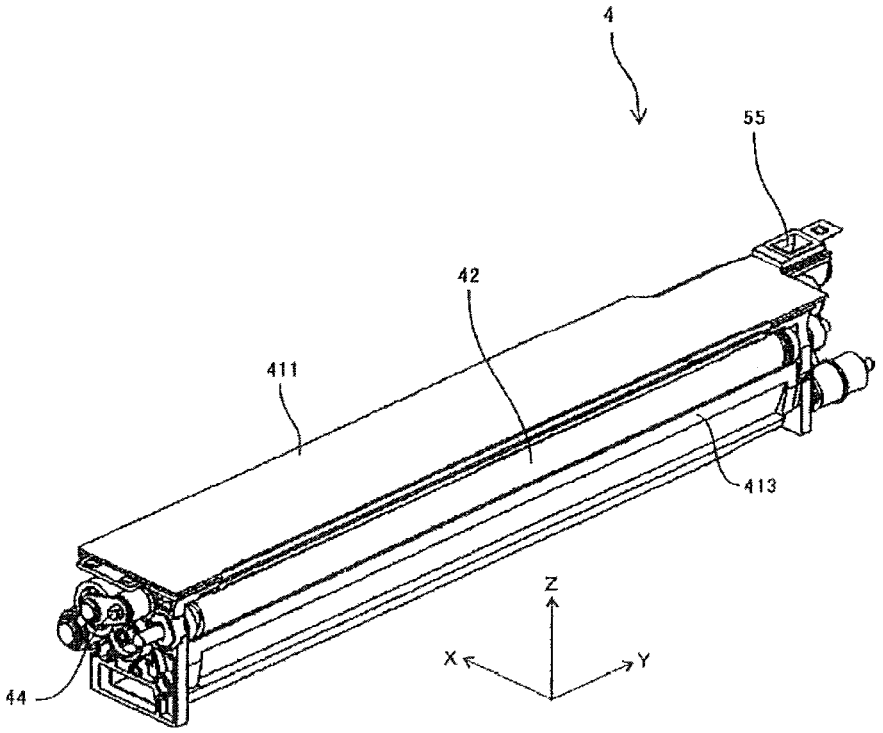
FIG. 6 is a schematic perspective view of one exemplary developing device of the present invention.
Figure 7:
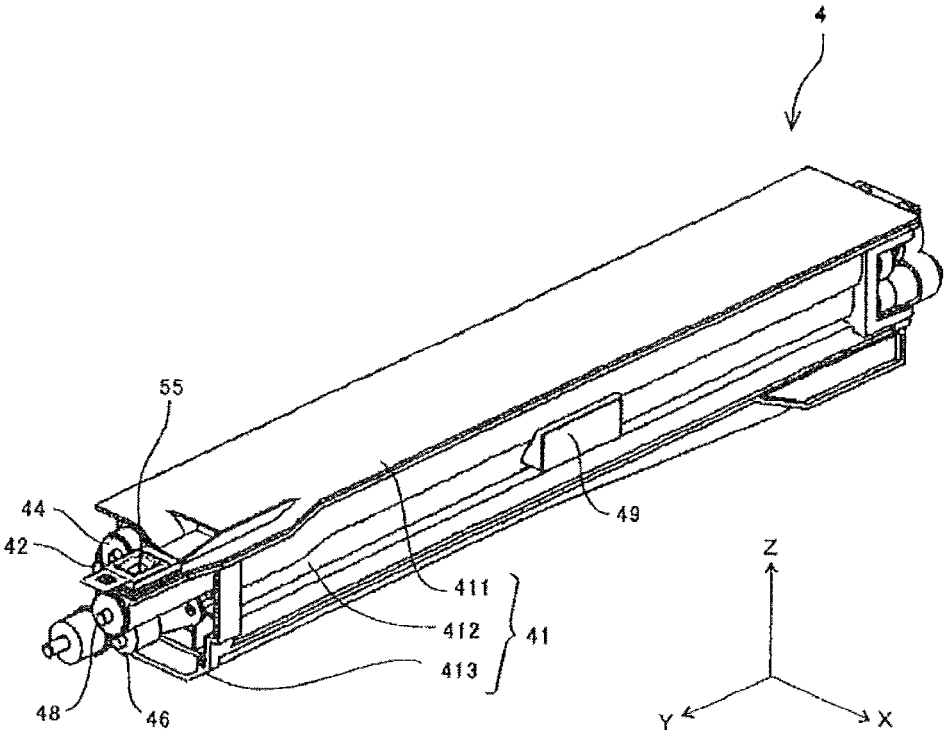
FIG. 7 is a schematic perspective view of one exemplary developing device of the present invention.

FIGS. 6 and 7 are schematic perspective views of one exemplary developing device 4 of the present invention. FIGS. 6 and 7 are schematic perspective views of the developing device 4 when looked down from different angles.

A developing casing 41 defining an outer shape of the developing device 4 is an assembly of an upper case 411, a middle case 412, and a lower case 413. The middle case 412 forms a toner storing portion 43. The upper case 411 is provided with a toner supplying port 55 which is a toner supplying portion communicating the toner storing portion 43 and an outside of the case. The upper case 411 is also provided with an inlet seal 47 which seals a gap between the upper case 411 and the developing roller 42 serving as the toner bearing member.

Figure 8:
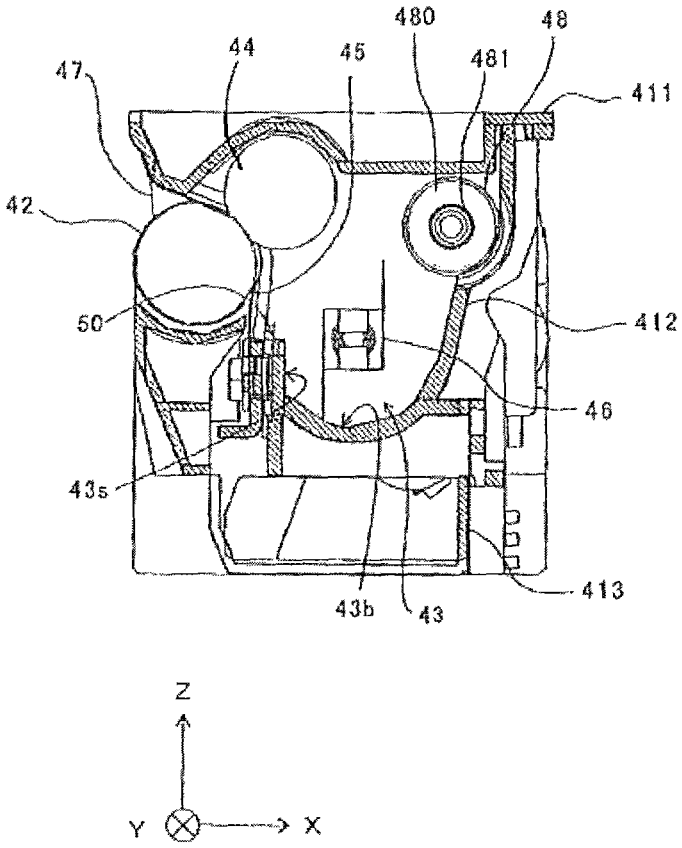
FIG. 8 is a schematic sectional view of the developing device viewed from the same direction as in FIG. 5.
Figure 9:
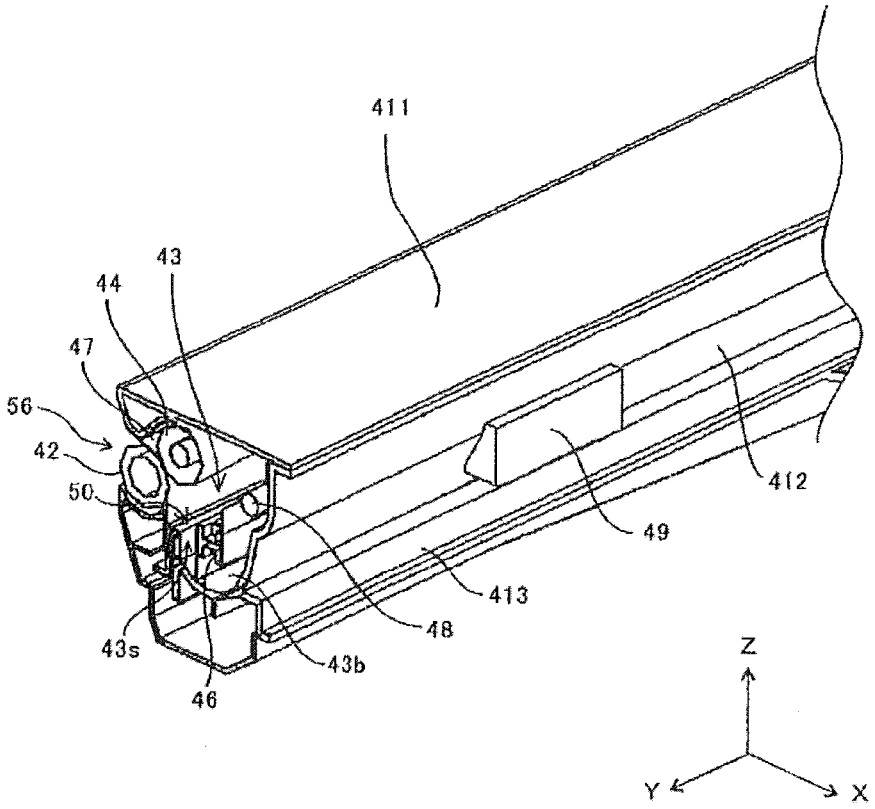
FIG. 9 is an enlarged schematic perspective view of a part of one exemplary developing device of the present invention.

FIG. 8 is a schematic sectional view of the developing device 4 viewed from the same direction as in FIG. 5. FIG. 9 is an enlarged schematic perspective view of a part of one exemplary developing device 4 of the present invention and an explanatory view of a cross-section taken along a Z-X surface.

The middle case 412 is provided with, for example, the developing roller 42, a supplying roller 44 serving as the toner supplying member, a doctor blade 45 serving as the regulating member, a paddle 46, a supplying screw 48 and a residual toner sensor 49.

The developing device 4 is provided with an opening 56 communicating an inside and an outside of the device along a longitudinal direction (Y-axis direction in FIG. 9). In the opening 56, there is provided a cylindrical developing roller 42 which bears and conveys the toner from the inside to the outside (developing region α facing the latent electrostatic image bearing member) of the developing device.

Figure 10:
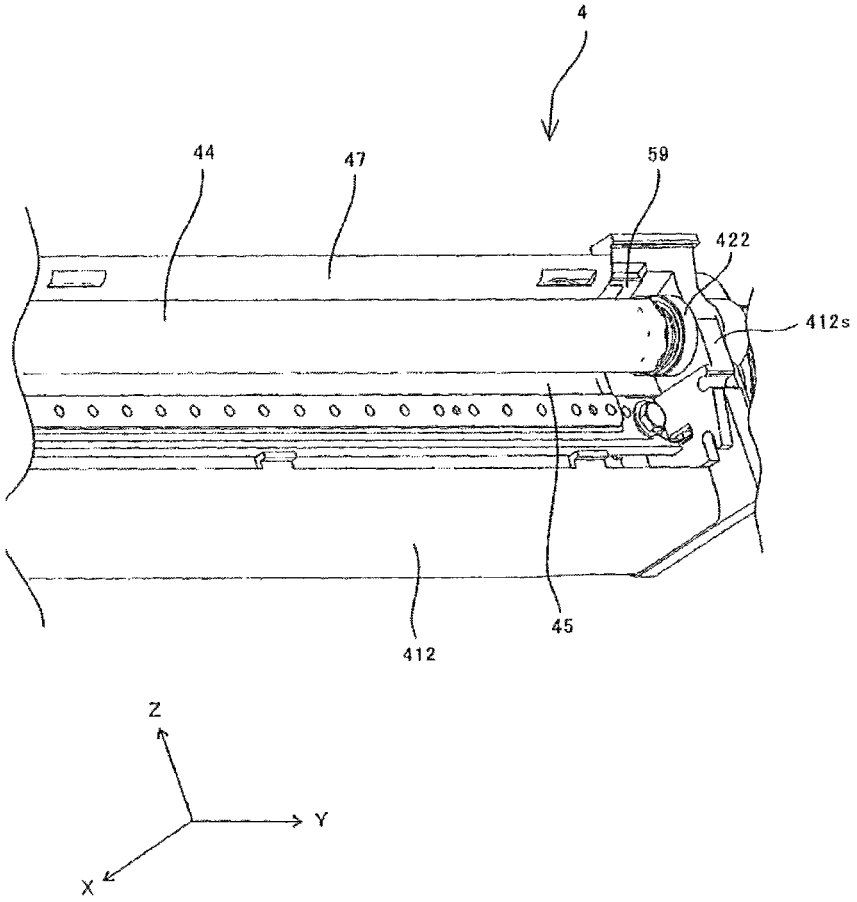
FIG. 10 is an enlarged schematic perspective view of the vicinity of one end of one exemplary developing device of the present invention.
Figure 11:
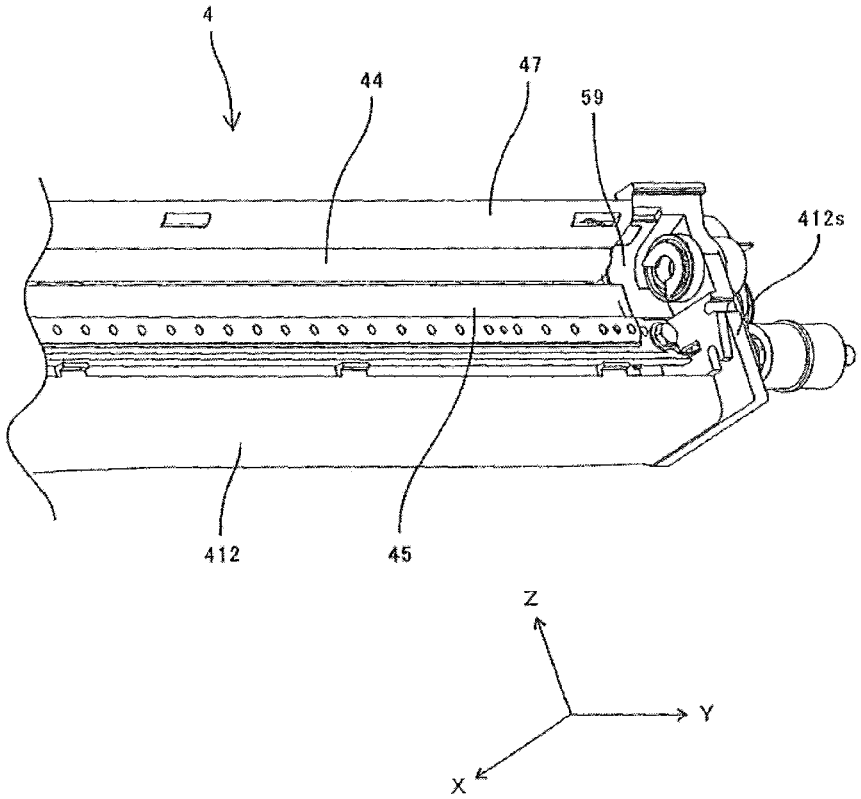
FIG. 11 is an enlarged perspective view of the developing device shown in FIG. 10 with the developing roller omitted.

FIG. 10 is an enlarged schematic perspective view of the vicinity of one end (back-side end in FIG. 4) of one exemplary developing device 4 of the present invention with the lower case 413 omitted. FIG. 11 is an enlarged perspective view of the developing device 4 shown in FIG. 10 with the developing roller 42 omitted.

Figure 12:
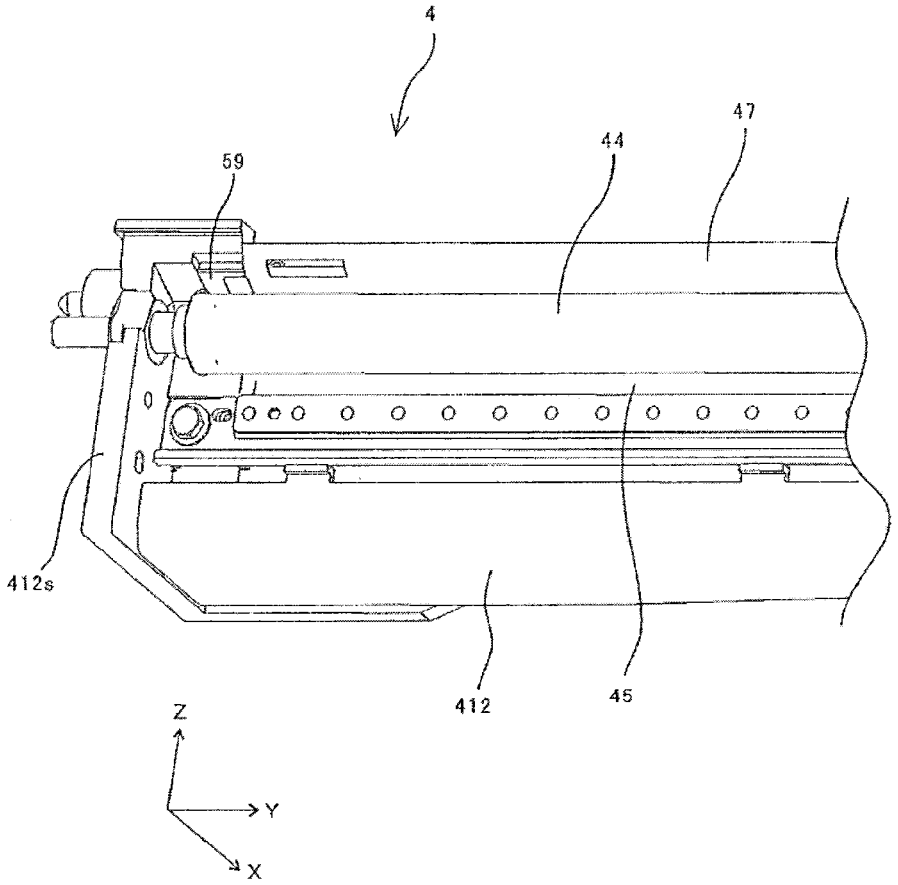
FIG. 12 is an enlarged schematic perspective view of the vicinity of the other end of one exemplary developing device of the present invention.
Figure 13:
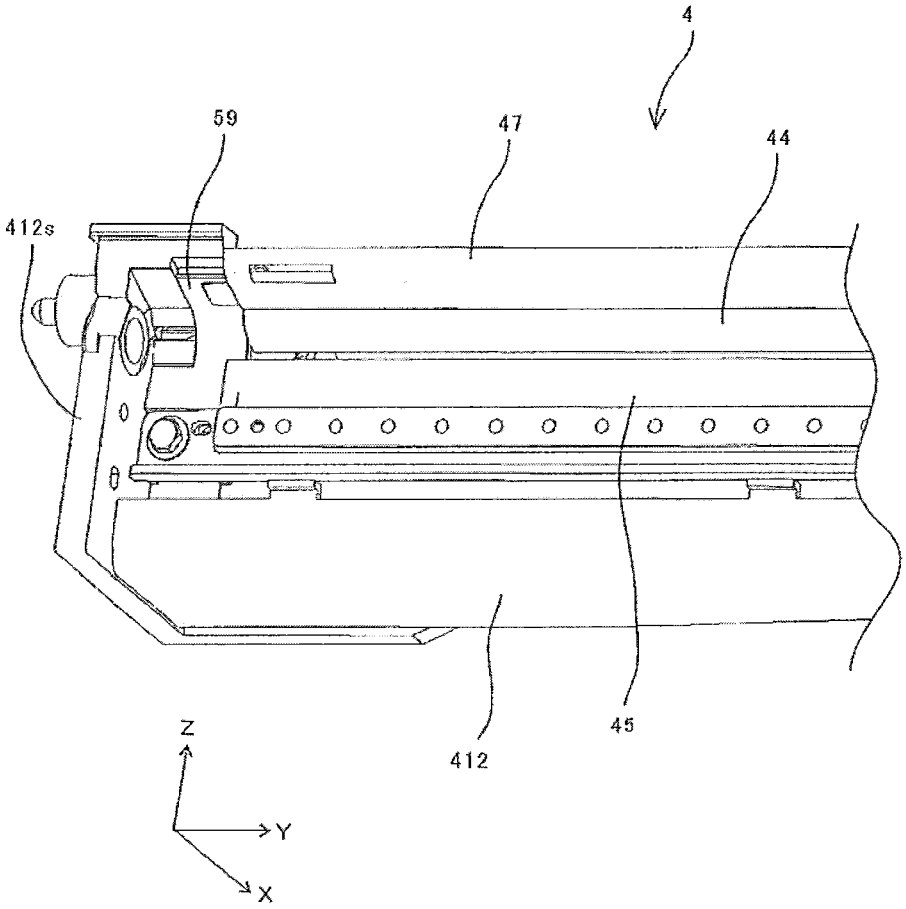
FIG. 13 is an enlarged perspective view of the developing device shown in FIG. 12 with the developing roller omitted.

FIG. 12 is an enlarged schematic perspective view of the vicinity of the other end (front-side end in FIG. 4) of one exemplary developing device 4 of the present invention with the lower case 413 omitted. FIG. 13 is an enlarged perspective view of the developing device 4 shown in FIG. 12 with the developing roller 42 omitted.

In the developing device 4, the supplying roller 44 is rotated and surface-moved in a direction indicated by an arrow C in FIG. 5 (clockwise direction in FIG. 5) to thereby convey a toner T stored in the toner storing portion 43 to a supplying nip β, which is a region facing the developing roller 42, and then supply the toner to the surface of the developing roller 42. The developing roller 42 is rotated and the surface thereof is moved in a direction indicated by an arrow B in FIG. 5 (clockwise direction in FIG. 5) while bearing the toner on its surface so that the toner is conveyed to a region facing the doctor blade 45 which regulates an amount of the toner on the developing roller 42 to a predetermined amount. At a region facing the developing roller 42, the doctor blade 45 abuts against the developing roller 42 in an opposite direction to a surface-moving direction of the developing roller 42, that is, an apical of the doctor blade 45 is located upstream of a base of the doctor blade 45 in a rotation direction of the developing roller 42. The toner of which amount has been regulated to the predetermined amount at the region facing the doctor blade 45 reaches the developing region α facing the latent electrostatic image bearing member 2 by the action of a rotation of the developing roller 42.

At the supplying nip β, a surface of the supplying roller 44 moves in an upward direction, and a surface of the developing roller 42 moves in a downward direction. Notably, in the developing device 4 of the present embodiment, the supplying roller 44 is in contact with the developing roller 42 at the supplying nip β.

At the developing region α, the toner T on the surface of the developing roller 42 moves to the surface of the latent electrostatic image bearing member 2 depending on a developing electric field generated by a potential difference between the developing bias applied from the developing bias power supply 142 to the developing roller 42 and a latent image on the latent electrostatic image bearing member 2. The toner adheres to a latent electrostatic image portion on the surface of the latent electrostatic image bearing member 2 to thereby develop the latent electrostatic image. The latent electrostatic image bearing member 2 is rotated in a direction indicated by an arrow D in FIG. 5 without contacting with the developing roller 42. Accordingly, at the developing region α, the surface-moving direction of the developing roller 42 is the same as that of the latent electrostatic image bearing member 2.

The developing bias power supply 142 is a voltage-applying portion which applies to the developing roller 42 an alternating voltage between a first voltage for directing the toner from the developing roller 42 to the latent electrostatic image bearing member 2 and a second voltage for directing the toner from the latent electrostatic image bearing member 2 to the developing roller 42 in order to develop with the toner the latent image which has been conveyed to the developing region α.

As will be below described in detail, the developing roller 42 has a regular concavo-convex shape throughout an outer surface thereof. In the concavo-convex shape, heights of convex portions 42*a* and depths of concave portions 42*b* from the top surfaces of the convex portions 42*a* are substantially uniform. In other words, the developing roller 42 has regularly arranged convex portions 42*a* on its surface.

At a upstream region in the rotation direction of the developing roller 42 within the supplying nip β, the supplying roller 44 collects the toner T which has not used for development at the developing region α, has passed through the developing region α and remains on the surface of the developing roller 42, whereby the surface of the developing roller 42 is refreshed. That is, the supplying roller 44 also functions as a collecting roller.

When the toner T comes into the concave portions 42*b* which are regularly formed on the surface of the developing roller 42, the toner T may be difficult to be collected. In addition, when the toner T remains on the developing roller 42 even after it has passed through both of the developing region α and the supplying nip β, the toner T sticks firmly to the developing roller 42 to thereby cause a toner filming. The toner filming varies electric charge amounts per unit area of the toner T on the developing roller 42 and toner amounts per unit area of the developing roller 42, which may cause ununiformity in toner concentration upon development.

In the developing device 4 of the present embodiment, the surface-moving direction of the developing roller 42 is the opposite to that of the supplying roller 44 at the supplying nip β where the developing roller 42 faces the supplying roller 44. Accordingly, at the supplying nip β, a difference between the linear velocity of the surface of the developing roller 42 and that of the surface of the supplying roller 44 gets greater, which can improve the supplying roller 44 in a collecting performance at the supplying nip β. Therefore, the toner can be prevented from remaining on the developing roller 42, can prevented from sticking firmly to the surface of the developing roller 42, and can prevent ununiformity in concentration upon development due to the toner-sticking to the surface of the developing roller 42.

As shown in FIG. 5, the supplying roller 44 is disposed above the toner storing portion 43 in the developing device 4 so that at least a part of the supplying roller 44 is located above the surface of the toner T within the toner supplying portion 43 in a stopped state in which the paddle 46 is not rotating. Moreover, a downstream region of the supplying nip β in the surface-moving direction of the supplying roller 44 (hereinafter may be referred to as a supplying nip-downstream region) is located above the surface of the toner T. As shown in FIG. 4 of JP-A No. 2007-178901, when the supplying nip-downstream region is filled with the toner, the toner filled in the supplying nip-downstream region prevents an additional toner from entering the supplying nip-downstream region, which may reduce a rate of the toner collected from the developing roller 42 at the supplying nip β. On the other hand, in the developing device 4 of the present embodiment, as shown in FIG. 5, the supplying nip-downstream region is located above the surface of the toner T, and thus is not filled with the toner. Therefore, the toner within the supplying nip-downstream region does not prevent the toner from being collected from the developing roller 42 at the supplying nip β, which can allow the toner to be efficiently collected and improve refreshing property of the toner.

Notably, in FIG. 5, a reference numeral 144 denotes a supplying bias power supply, and a reference numeral 145 denotes a doctor bias power supply.

[Toner Bearing Member]

There now will be explained the developing roller 42 serving as a toner bearing member.

Figure 14:
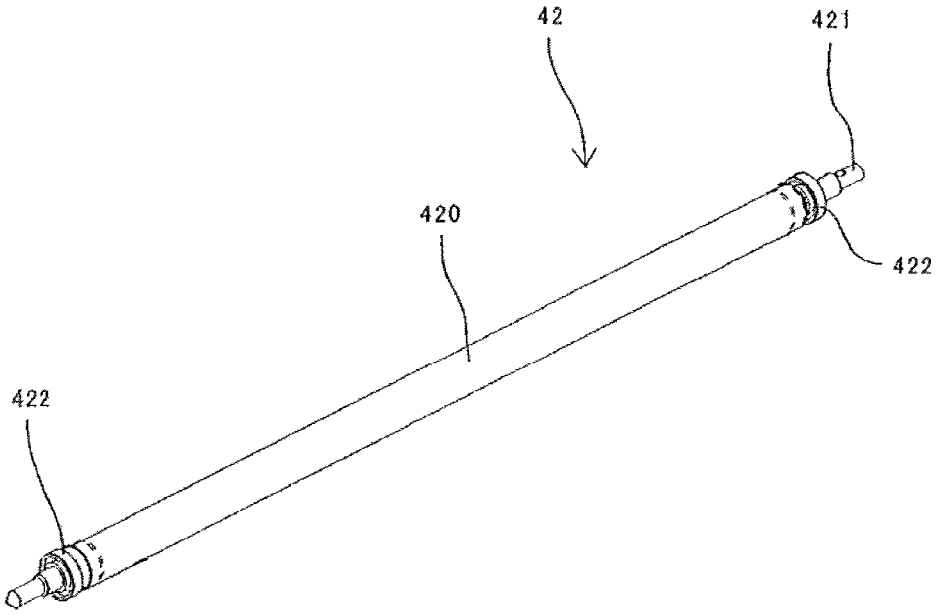
FIG. 14 is a schematic perspective view of one exemplary developing roller.
Figure 15:
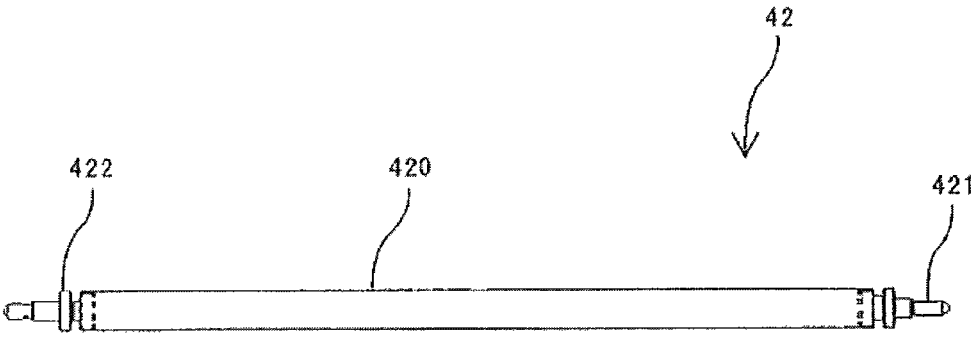
FIG. 15 is a schematic side view of one exemplary developing roller.
Figure 16A:
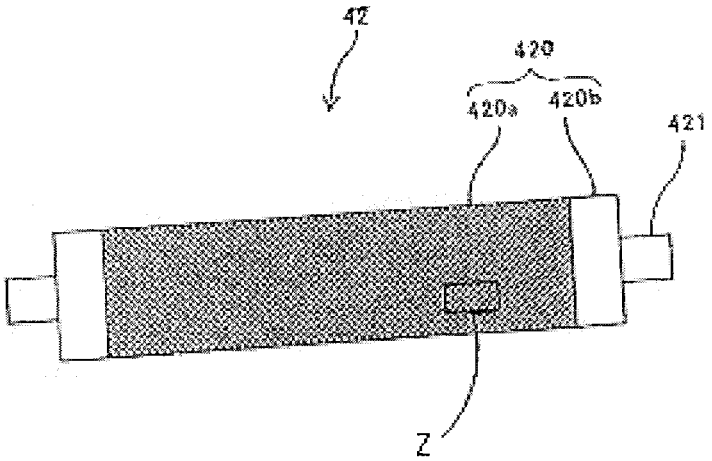
FIG. 16A is a general schematic view of the developing roller.
Figure 16B:
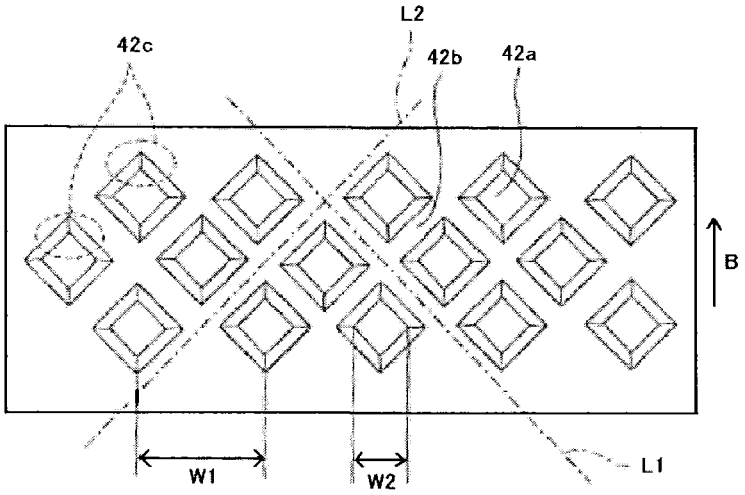
FIG. 16B is an enlarged view of a region Z on a surface of the developing roller shown in FIG. 16A.

FIG. 14 is a schematic perspective view of the developing roller 42. FIG. 15 is a schematic side view of the developing roller 42. FIGS. 16A and 16B are explanatory views of a surface shape of the developing roller 42. FIG. 16A is a general schematic view of the developing roller 42. FIG. 16B is an enlarged view of a region Z on a surface of the developing roller 42 shown in FIG. 16A.

The developing roller 42 has a configuration in which a developing roller axis 421 is surrounded by a developing roller cylindrical body 420 configured to bear the toner on its surface. The developing roller axis 421 is provided with spacers 422 in the vicinity of the outside of both axis-direction ends of the developing roller cylindrical body 420 in an axis direction.

The developing roller 42 is rotatable about the developing roller axis 421, and disposed so that the axis direction of the developing roller axis 421 is in parallel with the longitudinal direction of the developing device 4 (Y-axis direction in FIG. 5). Both axis-direction ends of the developing roller axis 421 in the developing roller 42 are rotatably attached to side-wall portions 412*s* of the middle case 412. A part of the surface of the developing roller 42 is exposed through the opening 56 to the outside of the developing device 4. The developing roller 42 rotates in a direction indicated by an arrow B in FIG. 5 so that the exposed surface of the developing roller 42 moves in an upward direction to thereby convey the toner.

The developing roller 42 maintains at a constant level a distance (developing gap) between the surface of the developing roller cylindrical body 420 and the surface of the latent electrostatic image bearing member 2 at the developing region c by allowing the spacers 422 provided in the vicinity of both axis-direction ends to come into contact with the surface of the latent electrostatic image bearing member 2.

The developing roller 42 is a member made of, for example, an aluminum alloy or an iron alloy.

The developing roller cylindrical body 420 in the developing roller 42, as shown in FIG. 16A, is separated into two parts (i.e., convex-forming portion 420*a* and non-convex-forming portion 420*b*) based on a difference of their surface structure.

The convex-forming portion 420*a* is a portion which contains a central portion in the axis direction of the developing roller 42, and of which surface has been subjected to concavo-convex processing for appropriately bearing the toner. In the present embodiment, so-called a rolling processing is used as the concavo-convex processing. The convex portions 42*a* is surrounded by the first groove L1 and the second groove L2 which are depressed relative to the convex portions 42*a* and which are spiral grooves of which winding directions are different from each other. In the developing roller 42 of the present embodiment, a pitch width W1 in the axis direction of the convex portion 42*a* is 80 μm, and an axis-direction length W2 on the top surface of the convex portion 42*a* is 40 μm. Additionally, a concave portion depth (may be referred to as "convex portion height"), which is a height from a bottom surface of the concave portion 42*b* which is depressed relative to the convex portion 42*a* to the top surface of the convex portion 42*a*, is 10 μm. These values of the pitch width W1, the axis-direction length on the top surface W2 and the concave portion depth are only an example and are not limited thereto.

In a cross-section passing through a central rotation axis of the developing roller 42, the surface of the non-convex-forming portion 420*b* may be located at the same height as the top surface of the convex portion 42*a* in the convex-forming portion 420*a*, or may be located at the same height as the bottom surface of the concave portion 42*b* in the convex-forming portion 420*a*. In other words, a distance from the central rotation axis of the developing roller 42 to the surface of the non-convex-forming portion 420*b* may be the same as a distance from the central rotation axis to the top surface of the convex portion 42*a* in the convex-forming portion 420*a*, or the distance from the central rotation axis to the surface of the non-convex-forming portion 420*b* may be the same as a distance from the central rotation axis to the bottom surface of the concave portion 42*b* in the convex-forming portion 420*a*.

The surface of the developing roller 42 is preferably made of a material which can normally charge the toner. Even when a low-charged toner is produced due to filming, the low-charged toner is driven out by thrown-up toner T and can be charged at non-filming portions in the convex portions 42*a* and the concave portions 42*b*, which can decrease the low-charged toner to thereby stabilize an image density.

In addition, the surface of the developing roller 42 is preferably made of material harder than that of the doctor blade 45 (blade member 450), which can suppress the convex portion 42*a* on the surface of the developing roller 42 from being shaved off by the doctor blade 45. Therefore, a volume of the concave portion 42*b* surrounded by the convex portion 42*a* and the doctor blade 45 is less likely to be changed, which stabilizes a m/a value (toner amount per unit area on the developing roller (may be referred to as M/A value)).

A height of the convex portion 42*a* on the developing roller 42 is preferably greater than a volume average particle diameter of the toner T to be used, which can allow the toner T having an average size to be contained entirely within the concave portion 42*b*. Accordingly, the toner is less likely to be excluded based on its size, so that the m/a value (toner amount per unit area on the developing roller) is stabilized against time-dependent change.

Meanwhile, in the previous configuration, the developing roller is an aluminum- or iron-roller of which surface is plated with nickel in order to prevent the developing roller 42 from being corroded or help the toner to be charged. Indeed, nickel plating is effective in preventing the developing roller 42 from being corroded or in helping the toner to be charged. However, nickel plating is ineffective in decreasing the non-electrostatic adhesive force between the surface of the aluminum roller and the toner.

For the purpose of verification, the non-electrostatic adhesive force between the surface of the toner bearing member and the toner was evaluated using the toner bearing members with various deposited films. The non-electrostatic adhesive force between the surface of the toner bearing member and the toner was measured as described above.

Figure 30:
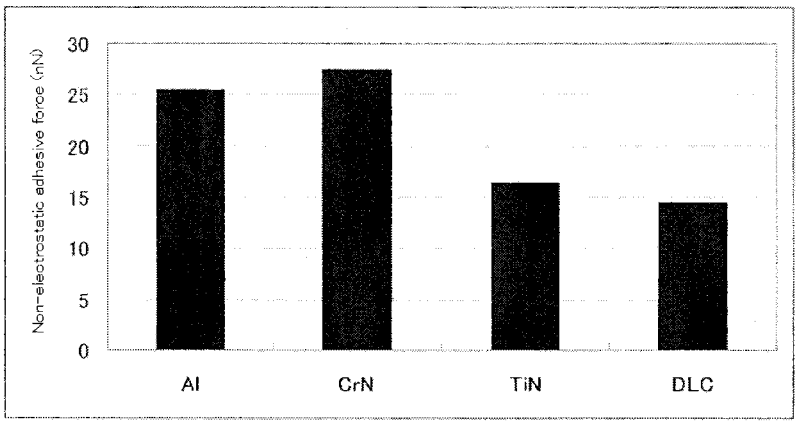
FIG. 30 is a graph representing measurement results of non-electrostatic adhesive forces for an untreated aluminum sample and various deposition-treated aluminum samples.

Measurement results of the non-electrostatic adhesive force for an untreated aluminum sample and aluminum samples deposited with any of CrN, TiN and DLC are shown in FIG. 30. The term "DLC" refers to a diamond-like carbon film. As can be seen from FIG. 30, CrN film has almost no effect on decreasing the non-electrostatic adhesive force. On the other hand, TiN film and DLC film have an effect on decreasing the non-electrostatic adhesive force.

Actually, the developing roller 42 deposited with the TiN or DLC resulted in decreasing the degree of time-dependent deterioration of developability as compared with the nickel-plated aluminum roller. Especially, the DLC film had a great effect. Notably, a value of the non-electrostatic adhesive force to the toner varies depending on the toner to be used.

Additionally, a chemical-conversion treatment method is also thought to be effective in decreasing the non-electrostatic adhesive force to the toner. For the purpose of verification, the non-electrostatic adhesive forces between the toner and various aluminum samples treated with any of zinc salt, molybdic acid and chromic acid were measured. A treatment agent for zinc salt was those used as a primer for aluminum cans. A surface treatment of aluminum or zinc with chromates referred to as chromate-conversion treatment, which is often used for improving corrosion resistance and enhancing adhesion to paint.

Figure 31:
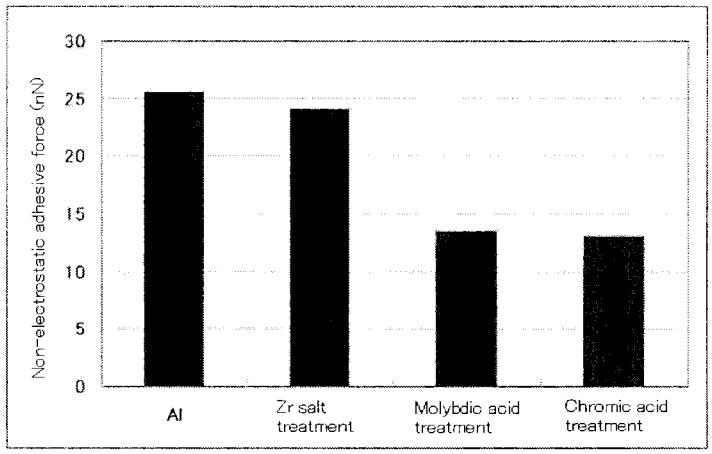
FIG. 31 is a graph representing measurement results of non-electrostatic adhesive forces for an untreated aluminum sample and various chemical-conversion treated aluminum samples.

Chromate-conversion treatment using hexavalent chromium are particularly excellent in corrosion resistance, but alternate products have been developed due to legal regulation of the hexavalent chromium. The molybdic acid treatment, which is one example of the alternate products, is also used for improving corrosion resistance of the aluminum surface and used as a primer or as a blackening agent. Measurement results of the non-electrostatic adhesive force between the toner and samples treated with any of zinc salt, molybdic acid and chromic acid are shown in FIG. 31. As can be seen from FIG. 31, zinc salt has almost no effect on decreasing the non-electrostatic adhesive force. On the other hand, molybdic acid and chromic acid have a great effect on decreasing the non-electrostatic adhesive force.

Coating an aluminum surface with a resin can control the toner in chargeability. A resin in which highly lubricant powder is dispersed may decrease the non-electrostatic adhesive force between the toner and the toner bearing member.

Figure 32:
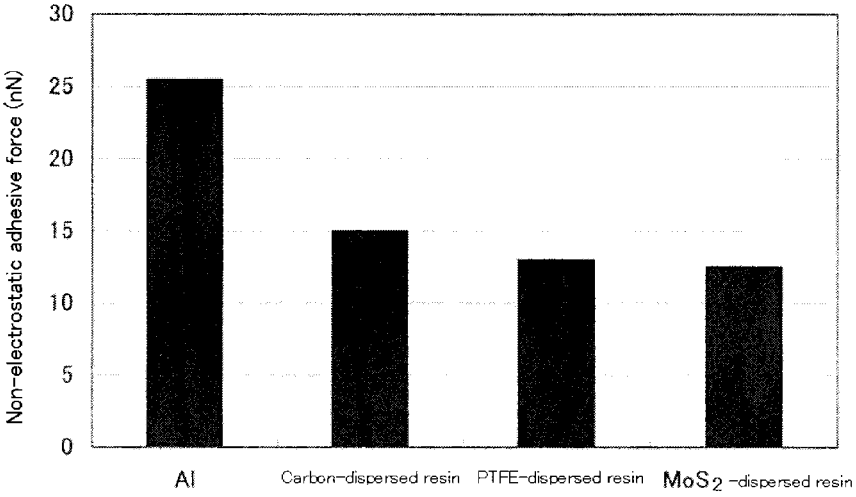
FIG. 32 is a graph representing measurement results of non-electrostatic adhesive forces for an uncoated aluminum sample and various resin-coated aluminum samples.

Measurement results of the non-electrostatic adhesive force between the toner and the aluminum surface coated with any of a carbon-dispersed resin, a PTFE (polytetrafluoroethylene)-dispersed resin and a $MoS_2$-dispersed resin are shown in FIG. 32. As can be seen from FIG. 32, all of the above-described three resins have an effect on decreasing the non-electrostatic adhesive force. The resins were evaluated for durability in a separate study. As a result, the PTFE-dispersed resin was found to be more durable than the $MoS_2$-dispersed resin.

[Toner Supplying Member]

Next, there will be explained a supplying roller 44 serving as the toner supplying member.

Figure 17:
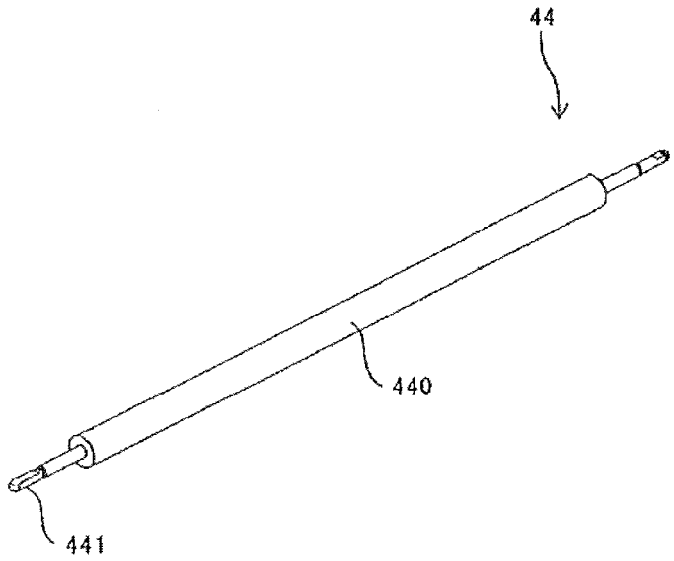
FIG. 17 is a schematic perspective view of one exemplary supplying roller.
Figure 18:
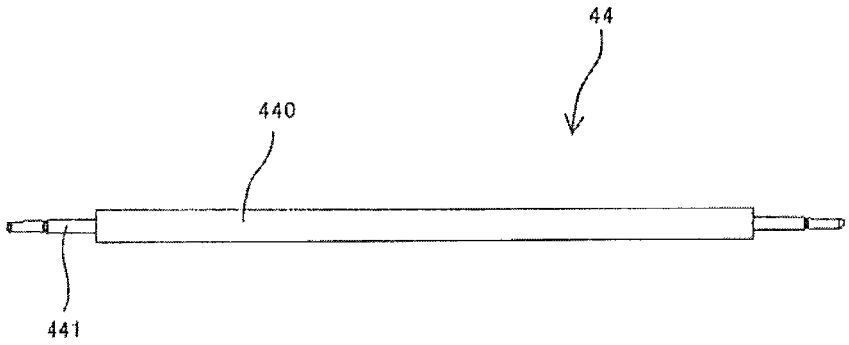
FIG. 18 is a schematic side view of one exemplary supplying roller.

FIG. 17 is a schematic perspective view of the supplying roller 44. FIG. 18 is a schematic side view of the supplying roller 44. A cylindrical supplying roller 44 is provided on a position closer to the developing roller 42 above the toner storing portion 43 within the developing device 4. The supplying roller 44 has a configuration in which a supplying roller axis 441 serving as an axis portion is surrounded by cylindrical foam. The cylindrical foam results in the supplying roller cylindrical body 440 configured to bear the toner on its surface.

The supplying roller 44 is rotatable about the supplying roller axis 441. The supplying roller axis 441 is rotatably attached to the side walls 412*s* of the middle case 412. The supplying roller 44 is disposed so that a part of a circumference surface of the supplying roller cylindrical body 440 is, at the supplying nip β, in contact with a circumference surface of the developing roller cylindrical body 420 in the developing roller 42.

As described above, the supplying roller 44 is rotated so that the surface thereof moves in an opposite direction to the surface-moving direction of the developing roller 42 at the supplying nip β where the supplying roller 44 faces the developing roller 42. In addition, in the developing device 4, as shown in FIG. 5, the supplying nip β is located above a position where the doctor blade 45 abuts against the developing roller 42.

The supplying roller cylindrical body 440 of the supplying roller 44 is made of a foamed material. Accordingly, a surface layer thereof to be come into contact with the developing roller 42 is a sponge-like layer on which numerous micropores are distributed, which allows the supplying roller 44 to easily contact a bottom of the concave portions 42*b* to thereby improve refreshing property of the toner on the developing roller 42.

An interlocking depth of the supplying roller 44 with the developing roller 42 ("radius of the developing roller 42"+ "radius of the supplying roller 44"—"center distance between the developing roller 42 and the supplying roller 44") is set to be greater than a height of the convex portion 42*a* on the developing roller 42, which can improve refreshing property of the toner on the concave portions 42*b*. When the interlocking depth of the supplying roller 44 with the developing roller 42 is much greater than the height of the convex portion 42*a*, the toner is pushed into the concave portions 42*b*, which causes aggregation. Therefore, the interlocking depth is needed to be set not to be too deep.

The foamed material used for the supplying roller cylindrical body 440 in the supplying roller 44 is controlled to have an electric resistance of $10^3\Omega$ to $10^{14}\Omega$.

A supplying bias is applied to the supplying roller 44 by a supplying bias power supply 144 to thereby assist the toner which has been pre-charged at the supplying nip β to be pressed against the developing roller 42. The supplying roller 44 rotates in a clockwise direction in FIGS. 5 and 8 to thereby apply the developer which has adhered to the surface of the supplying roller to the surface of the developing roller 42.

The supplying bias power supply 144 applies to the supplying roller 44 a DC voltage having an opposite polarity (positive polarity) to a polarity of the normally-charged toner (negative polarity in the case of the toner T of the present embodiment) and having more positive polarity than the AC voltage applied to the developing roller 42. In this case, the polarity of the voltage applied to the supplying roller 44 is more positive than that of the voltage applied to the developing roller 42 relative to the polarity of the normally-charged toner, which can form, at the supplying nip (3, an electric field attracting the toner T from the developing roller 42 to the supplying roller 44, and can improve refreshing property of the toner on the developing roller 42. When using the supplying bias power supply 144, an additional DC power supply is needed, leading to high cost. Therefore, the supplying bias power supply 144 may not be used depending on a specification of the developing device 4.

[Regulating Member]

Next, there will be explained a doctor blade 45 serving as the toner regulating member.

Figure 19:
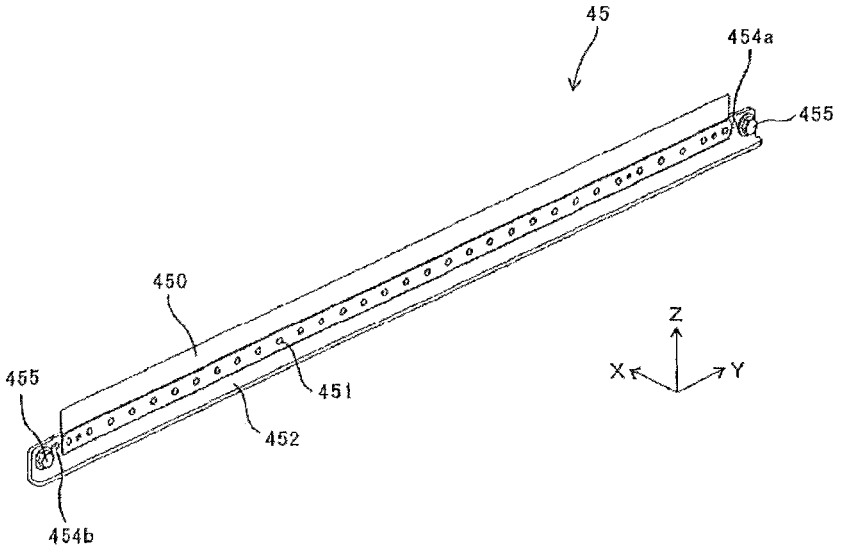
FIG. 19 is a schematic perspective view of one exemplary doctor blade.
Figure 20:
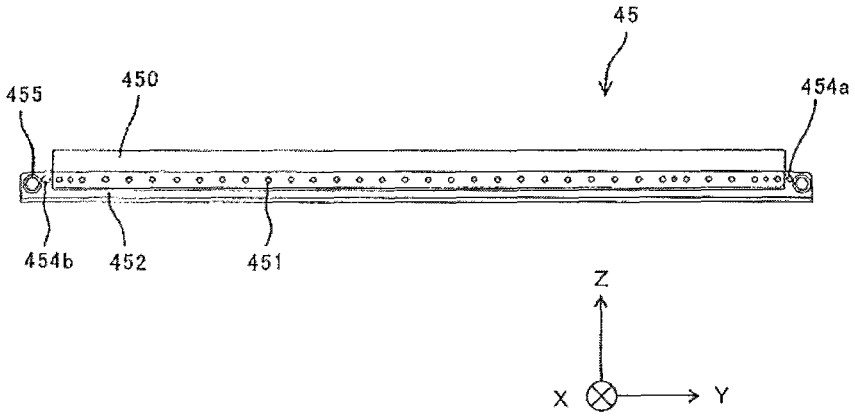
FIG. 20 is a schematic side view of one exemplary doctor blade.

FIG. 19 is a schematic perspective view of the doctor blade 45. FIG. 20 is a schematic side view of the doctor blade 45.

As shown in FIGS. 8 to 13, the doctor blade 45 is provided in the middle case 412 which is located in lower region of the developing roller 42 and inside the lower case 413.

The doctor blade 45 includes a blade member 450 which is a thin-plate like metal and a metal base portion 452 to which one end of the blade member 450 is fastened. In addition, the doctor blade 45 is configured that the other end of the blade member 450 comes into contact with the developing roller 42. The developing roller 42 may come into contact with the blade member 450 at an apical thereof (apical-contact state) or at a side-surface closer to the base portion (side-contact state). However, the apical-contact state is more preferred in that the toner located on a top surface of the convex portion 42*a* can be scraped off and only the toner located within the concave portion 42*b* is conveyed to the developing region α, which makes it possible to convey an even amount of the toner to the developing region α.

Figure 21:
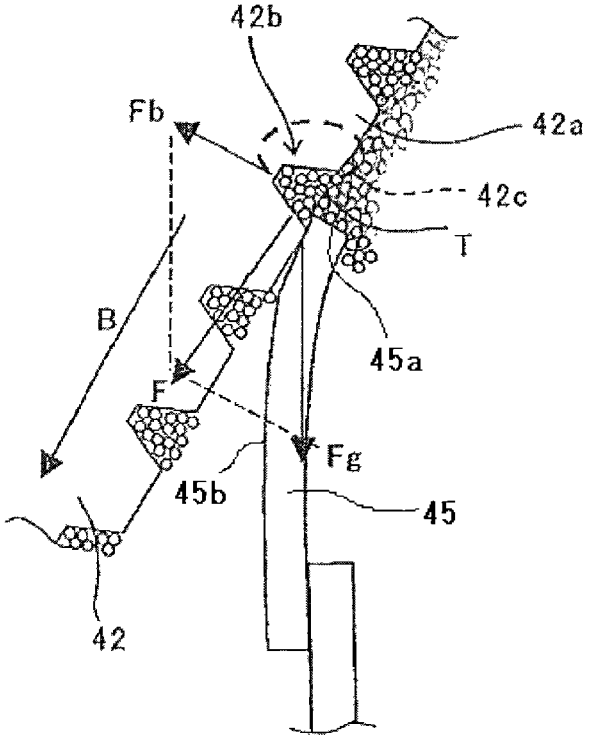
FIG. 21 is a schematic view of a state in which an apical of a doctor blade is in contact with a developing roller (apical-contact state).

In the apical-contact state, as shown in FIG. 21, an edge of the doctor blade 45 is in contact with the developing roller 42 (edge-contact state). The edge-contact state is a state in which an edge portion forming an edge between a facing surface 45*b* and an apical surface 45*a* of the doctor blade 45 is in contact with the surface of the developing roller 42 (top surface of the convex portion).

At the edge portion forming the edge, the edge may be rounded or chamfered.

Specifically, the edge portion have any shape, so long as a corner, which may be rounded or chamfered, located closer to the developing roller at an apical in a free end side of the platelike doctor blade can come into contact with the convex portion of the developing roller.

It is also possible to allow a bended portion formed by bending the blade to come into contact with the developing roller. However, the apical-contact state is more preferred from the viewpoint of a toner-scraping effect.

As shown in FIGS. 5 and 21, in the developing device 4 of the present embodiment, the developing roller 42 which rotates in the direction indicated by the arrow B in the figures moves in a downward direction at a doctor portion. In such a case, a downward force (Fg) is applied to the toner T due to its own weight, so that there can be reduced a compressive force (F) against the toner resulting from a stress (Fb) of the doctor blade 45. Therefore, the toner can be prevented from aggregating at a downstream region of the convex portion 42*a* on the developing roller 42 in the surface-moving direction of the developing roller 42 (region 42*c* in FIG. 21), which can prevent toner filming and prevent fluctuation of q/m values and m/a values on the developing roller 42.

The blade member 450 of the doctor blade 45 is fastened on the base portion 452 with a plurality of rivets 451. The base portion 452 is made of metal having a thickness of greater than that of the blade member 450 and serves as a support for fastening the blade member 450 to the main body of the developing device 4 (side-surface of the middle case 412). Two pin holes are provided at both longitudinal direction ends of the base portion 452. One is a main-location hole 454*a* having a perfect circular shape. The other is a sub-location hole 454*b* having a elliptical shape of which major axis is in a direction of the main-location hole 454*a*. The base portion 452 is positioned against the main body of the developing device 4 by inserting a pin (not shown) into the main-location hole 454*a*. The doctor blade is supported at the sub-location hole 454*b*. The blade member 450 is fastened to the developing device 4 by fastening the base portion 452 to which the blade member 450 has been fastened to the main body of the developing device 4 (middle case 412) with a doctor fastening screw 455.

The doctor member 450 of the doctor blade 45 is produced using a metal flat spring material made of, for example, stainless or phosphor bronze such as SUS304CSP or SUS301CSP.

A free end side of the doctor member 450 is allowed to abut against the surface of the developing roller 42 with pressing force of 10 N/m to 100 N/m. The doctor member 450 regulates the amount of the toner to a predetermined amount by the action of the pressing force and charges the toner through friction. Additionally, a bias is applied to the blade member 450 by a doctor bias power supply 145 in order to help charging through friction.

The blade member 450 of the doctor blade 45 is preferably electroconductive. The electroconductive blade member 450 can decrease an electric charge amount of the toner T having high q/m value (electric charge amount per unit volume) and can allow the q/m values to be uniform, which can prevent the toner T from sticking firmly to the developing roller 42.

The doctor bias power supply 145 may apply to the blade member 450 a DC voltage in a range of 200 V relative to the AC voltage applied to the developing roller 42. Alternatively, doctor bias power supply 145 may control a DC voltage to be applied depending on a usage environment, which can reduce a fluctuation of m/a values (toner amount per unit area on the developing roller) due to an environmental change.

[Paddle]

Next, there will be explained a paddle 46.

Figure 22:
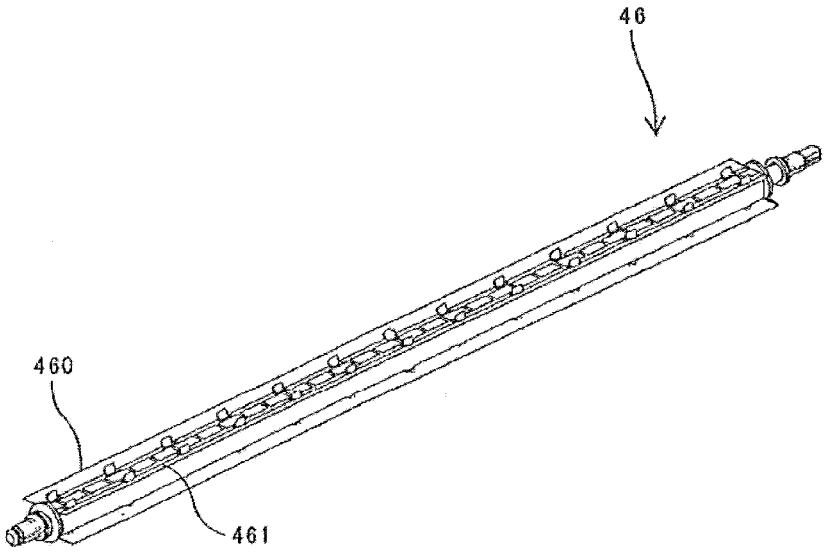
FIG. 22 is a schematic perspective view of one exemplary paddle.
Figure 23:
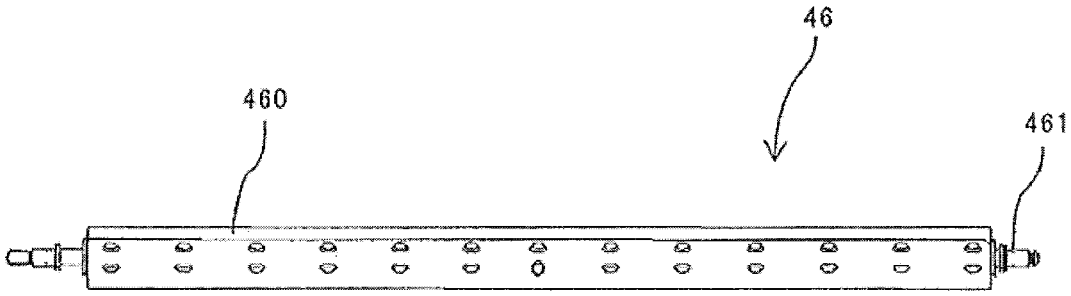
FIG. 23 is a schematic side view of one exemplary paddle.

FIG. 22 is a schematic perspective view of the paddle 46. FIG. 23 is a side view of the paddle 46.

The developing device 4 is provided with the toner storing portion 43 which is configured to store the toner. In the toner storing portion 43, the paddle 46 is rotatably attached to the developing casing 41.

The paddle 46 includes a paddle axis 461 serving as its axis portion and a paddle blade 460 which is a thin blade member made of an elastic sheet material such as MYLAR. The paddle axis 461 has two planar portions facing each other. Each of the planar portions is provided with the paddle blade 460. The two paddle blades 460 are fastened on the planar portions of the paddle axis 461 so as to protrude from the paddle axis 461 in opposite directions to each other.

A joint portion of the paddle blade 460 is provided with a plurality of holes in a row so as to be in parallel with an axis direction of the paddle axis 461. The paddle axis 461 is provided with a plurality of convex portions in a row so as to be in parallel with its axis direction. The paddle blade 460 is fastened to the paddle axis 461 by inserting the convex portions on the paddle axis 461 into the holes on the paddle blade 460, followed by thermal caulking.

The paddle 46 is disposed so that the axis direction of the paddle axis 461 is in parallel with the longitudinal direction of the developing device 4 (Y-axis direction in FIG. 5). Both axis-direction ends of the paddle axis 461 are rotatably attached to the side-wall portions 412*s* of the middle case 412.

In the paddle 46, a protrusion length of the paddle blade 460 is set to the extent that an apical of the paddle blade 460 extending from the paddle axis 461 may contact with an inner-wall surface of the toner storing portion 43. As shown in, for example, FIGS. 5 and 8, a bottom-surface portion 43*b* of the toner storing portion 43 is arc-shaped along a rotation direction of the paddle 46, and is configured that the paddle blade 460 does not get stuck with the bottom-surface portion 43*b* of the toner storing portion 43 by a rubbing action resulting from a rotation of the paddle 46.

On the side close to the developing roller 42 in the toner storing portion 43, a side-wall portion 43*s* is provided which is standing perpendicular to the bottom-surface portion 43*b*. At a position which is as high as or slightly lower than a center of the paddle axis 461, the side-wall portion 43*s* becomes in parallel with an X-axis and horizontal towards the roller, resulting in a step portion 50.

A distance between the side-wall portion 43*s* and the paddle axis 461 is set to be shorter than that of between the bottom-surface portion 43*b* and the paddle axis 461. Therefore, the paddle blade 460 rubs against the bottom-surface portion 43*b*, and then collides with the side-wall portion 43*s* to thereby bend downward to a greater extent. Thereafter, at the time when the apical of the paddle blade 460 has passed through the step portion 50, the paddle blade 460 is released and the apical of the paddle blade 460 bends upward. By such action of the paddle blade 460, the toner is thrown upward, stirred, conveyed, and supplied.

The step portion 50 is a horizontal surface being in parallel with an X-Y plane and extends in the longitudinal direction of the developing device 4 (Y-axis direction in FIG. 8). In the developing device 4 of the present embodiment, the step portions 50 are provided throughout a width direction. However, the step portions 50 may be provided in a part of the developing device 4, so long as the paddle blade 460 can bend upward.

[Supplying Screw]

Next, there will be explained a supplying screw 48.

As shown in FIGS. 8 and 9, the supplying screw 48 is a screw member including a supplying screw axis 481 and a supplying screw blade portion 480 which is a spiral blade portion fastened to the supplying screw axis 481. The supplying screw 48 is rotatable around the supplying screw axis 481, and disposed so that an axis direction of the supplying screw axis 481 is in parallel with the longitudinal direction of the developing device 4 (Y-axis direction in FIG. 8). Both axis-direction ends of the supplying screw axis 481 are rotatably attached to the side-wall portions 412*s* of the middle case 412.

The axis-direction end of the supplying screw 48 is located below a toner supplying port 55 which has been formed in a longitudinal direction end of the developing device 4. Thus, by the action of a rotating the supplying screw 48, the spiral supplying screw blade portion 480 conveys the toner which has supplied from the toner supplying port 55 towards a central portion of the developing device 4 in a longitudinal direction.

[Inlet Seal]

Next, there will be explained an inlet seal 47.

As shown in FIGS. 8 and 10 to 13, a sheet member serving as the inlet seal 47 such as MYLAR is stuck on an edge portion forming the opening 56 of the upper case 411 along the longitudinal direction. The inlet seal 47 is a sheet which has an almost rectangular shape, and in which one short-direction end is stuck on the edge portion of the upper case 411 and the other end is a free-end. The free-end of the inlet seal 47 is configured to protrude inward of the developing device 4 and be in contact with the developing roller 42. An upstream end of the inlet seal 47 in a rotation direction of the developing roller 42 is fastened to the upper case 411. A downstream end of the inlet seal 47 in the rotation direction of the developing roller 42 is a free-end and is disposed so that a surface of the inlet seal 47 is in contact with the developing roller 42. An surface of the upper case 411 facing the developing roller 42 is curved so as to match a shape of an upper portion in the supplying roller 44. A gap between the curved surface of the upper case 411 and the surface of the supplying roller 44 is 1.0 mm.

[Side Seal]

Next, there will be explained a side seal.

As shown in FIGS. 10 to 13, a side seal 59 is stuck on a part of the middle case 412 which is both longitudinal direction ends of the opening 56 in the developing device 4. The side seal 59 is provided in a region which is more inner in the axis direction than the spacers 422 provided in the vicinity of both axis-direction ends of the developing roller 42 and which is superposed with an axis direction end at which the developing roller 42 comes into contact with the doctor blade 45. The side seal 59 can prevent the toner from leaching out of the longitudinal direction end of the opening 56 in the developing casing 41.

In addition, the residual toner sensor 49 provided in the middle case 412 detects an amount of the residual toner stored in the toner storing portion 43.

[Toner Movement]

Next, there will be explained a movement of the toner in the developing device 4 with reference to FIGS. 5, 7 and 8.

As shown in FIG. 8, the toner is supplied from the toner supplying port 55 into the developing device 4, and then, is supplied to the toner storing portion 43 by the supplying screw 48. The supplied toner is stirred with the paddle 46 in the toner storing portion 43. The toner is thrown up and conveyed towards the developing roller 42 and the supplying roller 44 by the paddle 46. The toner which has been supplied to the supplying roller 44 is delivered to the surface of the developing roller 42 at the supplying nip β where the supplying roller 44 comes into contact with the developing roller 42. Among the toner which has been delivered to the surface of the developing roller 42, the toner in excess of a predetermined amount to be conveyed to the developing region α is scraped off the surface of the developing roller 42 by the doctor blade 45.

The toner remaining on the surface of the developing roller 42 after having passed through the region facing the doctor blade 45 is conveyed in the surface-moving direction by the action of the rotation of the developing roller 42 to reach the developing region α where the developing roller 42 faces the latent electrostatic image bearing member 2. The toner which has passed through the developing region α without being used for the development passes through a contact region with the inlet seal 47, and is conveyed to the supplying nip β where the developing roller 42 faces the supplying roller 44. The toner which has reached the supplying nip β by the action of the developing roller 42 is scraped off the surface of the developing roller 42 by the supplying roller 44 and conveyed by the supplying roller 44.

Experiment 1

Three toners were prepared using the same toner base particles and varying additives. Using the image forming apparatus shown in FIG. 4 and the developing unit shown in FIG. 5, 3,500 blank papers (A4 size) were continuously fed through in a transverse direction.

The three toners were as follows.

<Toner A>

A toner in which toner base particles were subjected to an external additive treatment by mixing with silica and titanium oxide using HENSCHEL MIXER.

<Toner B>

A toner produced in the same manner as Toner A, except that, in the external additive treatment, additional oil-treated silica (1.4 parts by mass per 100 parts by mass of the toner base particles) was added.

<Toner C>

A toner produced in the same manner as Toner A, except that, in the external additive treatment, additional oil-treated silica (2.8 parts by mass per 100 parts by mass of the toner base particles) was added.

The toners A to C were evaluated as follows.

<Output of Blank Image>

Three thousands and fifty hundreds blank Images were outputted without using any toner. Although it is most unlikely to output 3,500 blank images in reality, the above outputting was performed in order to evaluate in a short time a behavior when the toner has been deteriorated.

Other conditions were as follows.

Linear velocity of latent electrostatic image bearing member: 150 mm/s

Outer diameter of developing roller: 16 mm

Surface-shape of developing roller: shape shown in FIG. 24

Linear velocity ratio: 2.0

Rotation direction of supplying roller and developing roller: opposite direction Linear velocity ratio of supplying roller to developing roller: 0.7

Doctor blade: phosphor bronze with thickness of 120 μm

Contact of developing roller with doctor blade: contact at an apical of doctor blade (apical-contact state)

Developing bias: DC-250 (V) superimposed with AC (Vpp 1.7 (vibrational amplitude of AC component, kV) and 5.1 (kHz)).

Potential of doctor blade and supplying roller: equal to that of developing roller Toner amounts per unit area on the developing roller (unit: $mg/cm^2$, hereinafter may be referred to as "m/a on developing roller") and absolute values of electric charge amounts per unit toner amount on the developing roller (unit: μC/g, hereinafter may be referred to as "q/m on developing roller") were evaluated before and after outputting 3,500 blank images.

Figure 25:
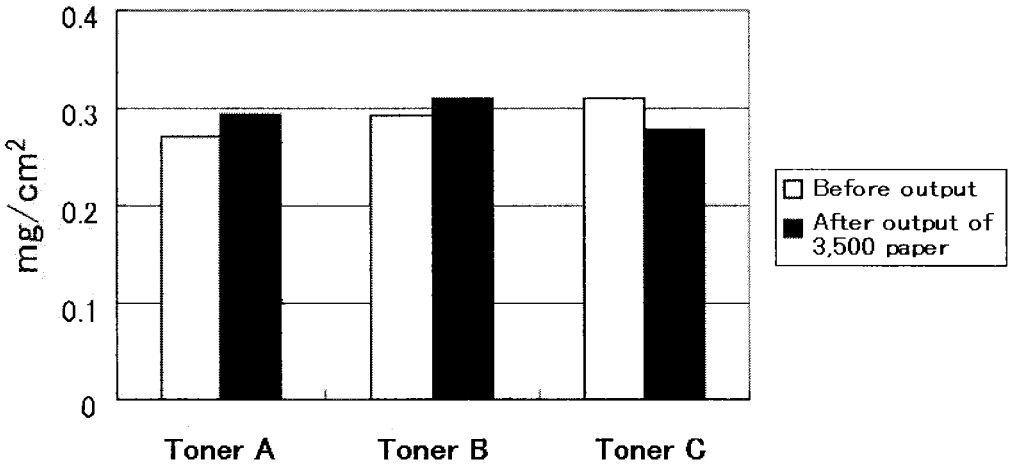
FIG. 25 is a graph representing measurement results of toner amounts per unit area on a developing roller.
Figure 26:
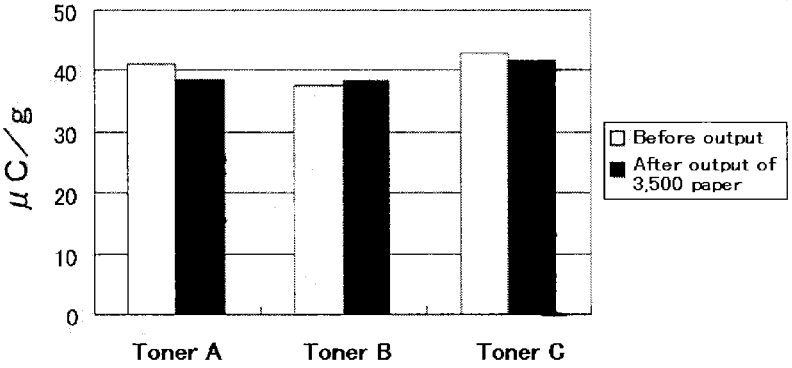
FIG. 26 is a graph representing measurement results of absolute values of electric charge amounts per unit toner amount on a developing roller.

FIG. 25 represents measurement results of toner amounts per unit area on the developing roller. FIG. 26 represents measurement results of absolute values of electric charge amounts per unit toner amount on the developing roller. As can be seen from FIGS. 25 and 26, values of the m/a on developing roller and the q/m on developing roller were approximately equal in three toners and had small fluctuations before and after outputting 3,500 blank images.

<Output of Solid Image>

Figure 27:
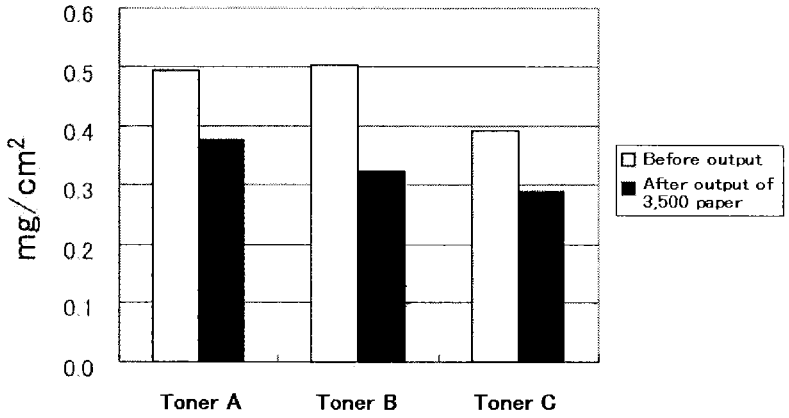
FIG. 27 is a graph representing measurement results of toner amounts per unit area on a latent electrostatic image bearing member.

FIG. 27 represents measurement results of toner amounts per unit area on the latent electrostatic image bearing member (unit: $mg/cm^2$) before and after outputting 3,500 solid patches (solid images).

As can be seen from FIGS. 25 to 27, although values of the m/a on developing roller and the q/m on developing roller had small fluctuations before and after outputting 3,500 solid images, toner amounts per unit area on the latent electrostatic image bearing member were decreased, indicating lowered developability. Additionally, Toner C had low initial-developability as compared to Toners A and B.

Next, there have been examined which properties contribute to developability other than the m/a on developing roller and the q/m on developing roller.

Figure 28:
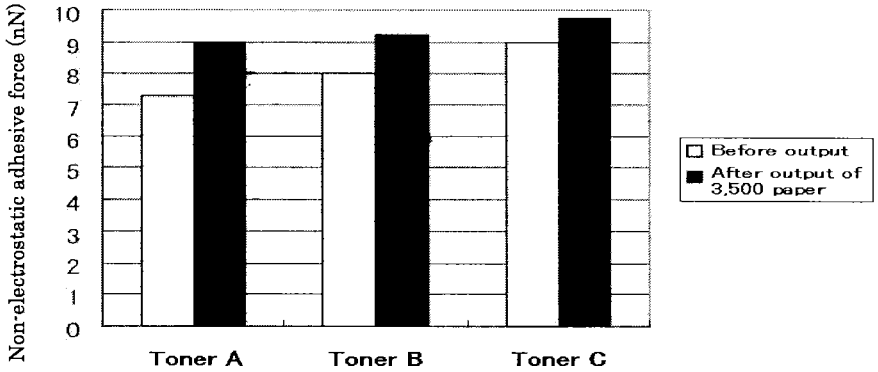
FIG. 28 is a graph representing measurement results of non-electrostatic adhesive forces between toners and toner bearing members.

Non-electrostatic adhesive forces (unit: nN) of the toner to the developing roller were measured before and after outputting 3,500 solid images. Results are shown in FIG. 28. The measurements were performed according to the method described herein.

As can be seen from FIG. 28, the three toners had been different from each other in the non-electrostatic adhesive force before outputting. In addition, the three toners were increased in the non-electrostatic adhesive force after outputting 3,500 solid images.

Figure 29:
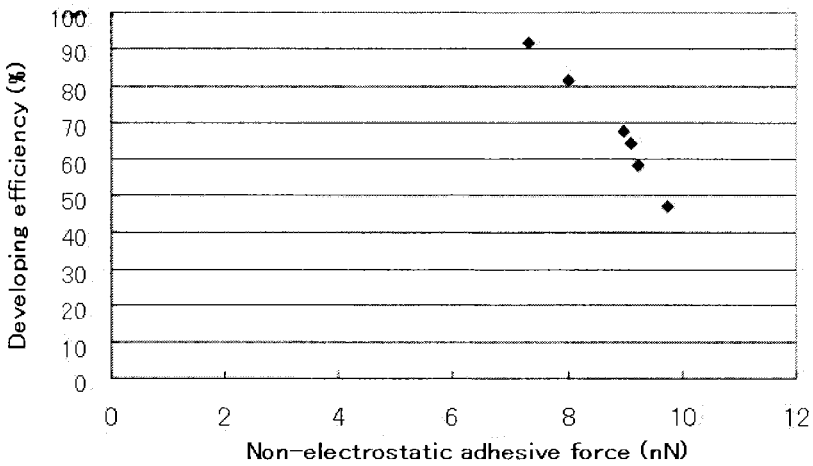
FIG. 29 is a graph representing a relation between non-electrostatic adhesive forces and developing efficiencies.

FIG. 29 represents a relation between non-electrostatic adhesive forces and developing efficiencies.

The developing efficiency is a rate of an amount of the toner which has actually used for developing to an amount of the toner which has passed through the developing nip, and was calculated according to the following expression:

$$\text{Developing efficiency}(\%)=100\times A/(B\times C)$$

In the above expression, A denotes a toner amount per unit area on the latent electrostatic image bearing member, B denotes a developing linear velocity ratio, and C denotes an absolute value of an electric charge amount per unit toner amount on the developing roller.

As can be seen from FIG. 29, the developing efficiency highly correlates with the non-electrostatic adhesive force. An electrostatic adhesive force greatly contributes to developability. However, in this evaluation, a correlation between developability and the non-electrostatic adhesive force can be seen clearly because toner amounts per unit area on the developing roller (m/a) were almost equal to each other in all conditions. Notably, the developing device including the toner bearing member having regularly arranged convex portions on its surface, and the image forming apparatus and image forming method using the developing device are characterized that the toner amounts per unit area on the developing roller (m/a) are almost constant regardless of types of toner.

In this experiment, the electric charge amounts per unit toner amount on the developing roller (q/m) were about −40 (μC/g), which is a desired value. However, high non-electrostatic adhesive force deteriorates developability. The m/a on developing roller is preferably 0.25 mg/cm$^2$ to 0.40 mg/cm$^2$. When using the intermediate transfer member, the total transfer efficiency of the primary transfer and the secondary transfer is 80% or more. Therefore, unless the minimum developing efficiency is 70% or more, an image ID on a recording medium decreases below an acceptable range.

Data in FIG. 29 were subjected to linear approximation to thereby determine a non-electrostatic adhesive force having developing efficiency of 70% or more, which was less than about 9.0 (nN). Therefore, in the image forming apparatus of the present invention, when the following expression is met: $F<9.0$ (nN) (wherein F denotes a non-electrostatic adhesive force between a toner and a surface of a developing roller (toner bearing member), developability can be prevented from decreasing below the acceptable range, and a developing device, an image forming apparatus and an image forming method being excellent in developing efficiency can be achieved.

As described above, on the surface of the developing roller 42 provided in the developing device 4, there are regularly arranged convex portions of which heights (depths of the concave portions) (W3) are uniform.

Example of a conventional one-component developing device includes a developing device in which a surface of a developing roller is subjected to surface-roughening treatment (e.g., sand blasting treatment) to thereby form a concavo-convex shape. Such surface-roughening treatment can improve the developing roller in toner bearing and conveying performance. However, the surface-roughening treatment results in irregularity in heights of convex portions, depths of concave portions and an concavo-convex pattern, which may cause a variation in toner amount born on the surface of the developing roller and, consequently, ununiformity in toner concentration when developing a latent image on a photoconductor. On the other hand, the developing device 4 has uniform heights of the convex portions (depths of the concave portions) (W3) and a regular concavo-convex pattern. Therefore, toner amounts born on the surface of the developing roller 42 are uniform, which can prevent ununiformity in toner concentration upon development.

Figure 33:
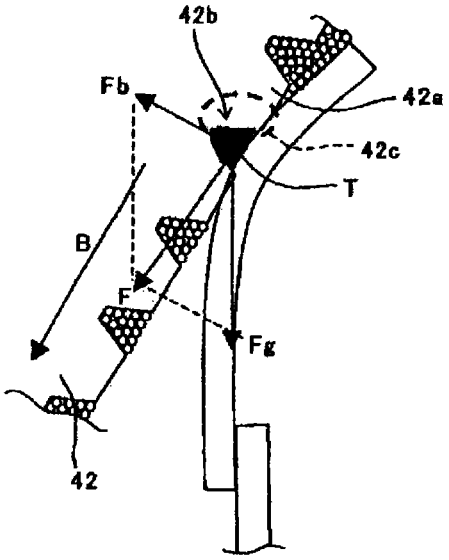
FIG. 33 is an enlarged explanatory view of a doctor part in a state in which a side-surface of the doctor blade is in contact with the developing roller (side-contact state).

As shown in FIGS. 5 and 33, in the developing device 4, the developing roller 42 which rotates in the direction indicated by the arrow B in the figures moves in the downward direction at the doctor portion. In such a case, the downward force (Fg) is applied to the toner T due to its own weight, so that there can be reduced the compressive force (F) against the toner resulting from the stress (Fb) of the doctor blade 45. Therefore, the toner can be prevented from aggregating at the downstream region of the convex portion 42*a* on the developing roller 42 in the surface-moving direction of the developing roller 42 (region 42*c* in FIG. 33), which can prevent toner filming and prevent fluctuation of q/m values and m/a values on the developing roller 42.

Figure 34:
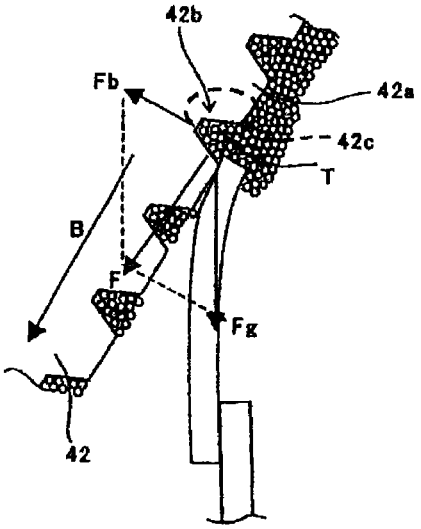
FIG. 34 is an enlarged explanatory view of a doctor part in a state in which an apical of a doctor blade is in contact with a developing roller (apical-contact state).

Using a toner having the accelerated aggregation rate of 40% or more as a developer used for the developing device 4 can make the toner unlikely to be agglomerated at the downstream region of the convex portion 42*a* on the developing roller 42 in the surface-moving direction of the developing roller 42 (area 42*c* in FIG. 33). Notably, at the doctor portion shown in FIG. 33, the side-surface of the doctor blade 45 is in contact with the developing roller 42 (side-contact state). When the doctor blade 45 abuts against the surface of the developing roller 42, the apical-contact state shown in FIG. 34 is more preferred in that the toner located on the top surface 42*t* of the convex portion 42*a* can be scraped off.

Figure 35:
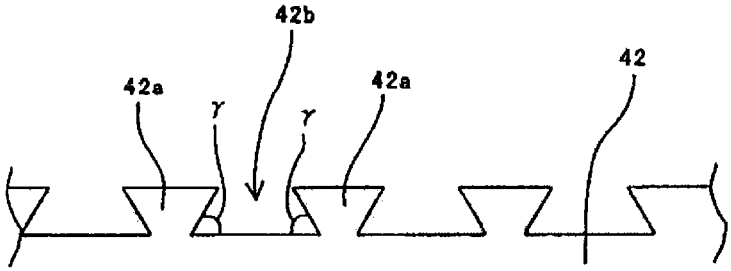
FIG. 35 is an enlarged sectional view of a surface of a developing roller in which angles between convex portions and concave portions are less than 90°.
Figure 36:
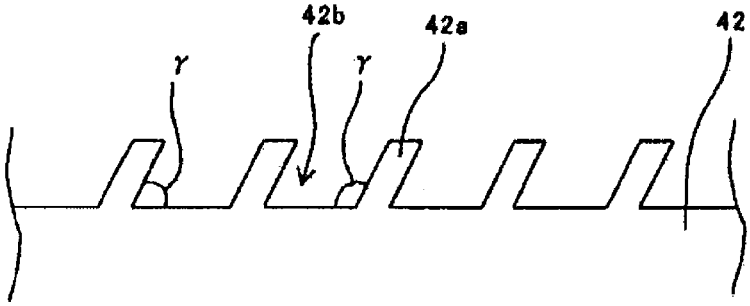
FIG. 36 is an enlarged sectional view of a surface of a developing roller in which some of angles between convex portions and concave portions are less than 90°.

As shown in FIG. 35, when angles between convex portions 42*a* and concave portions 42*b* of the developing roller 42 are less than 90°, the supplying roller 44 becomes less likely to abut against throughout the concave portions 42*b*. Similarly, as shown in FIG. 36, when some of angles between convex portions 42*a* and concave portions 42*b* of the developing roller 42 are less than 90°, the supplying roller 44 becomes less likely to abut against throughout the concave portions 42*b*.

Figure 37:
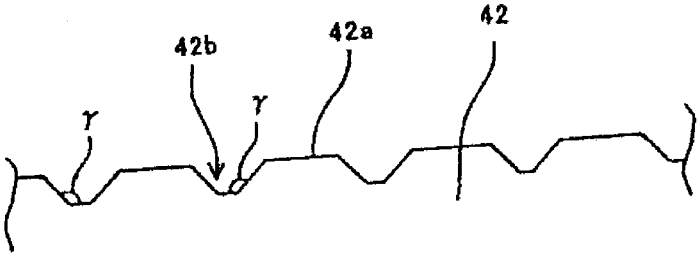
FIG. 37 is an enlarged sectional view of a surface of a developing roller in which angles between convex portions and concave portions are 90° or more.

By contrast, as shown in FIG. 37, in the developing roller 42 provided in the developing device 4, angles γ between convex portions 42*a* and concave portions 42*b* of the developing roller 42 are preferably 90° or more. When the angle γ is 90° or more as shown in FIG. 37, the supplying roller 44 becomes more likely to abut against the toner on the developing roller 42, which improves refreshing property.

Figure 38:
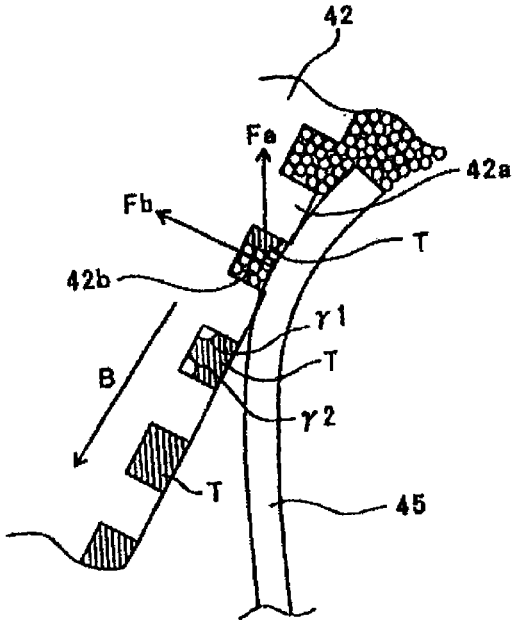
FIG. 38 is an enlarged sectional view of a surface of a developing roller in which angles between convex portions and concave portions are 90°.

FIG. 38 is an explanatory view of a configuration in which, among angles γ between convex portions 42*a* and concave portions 42*b*, an angle γ located at downstream side of the convex portion 42*a* in the surface-moving direction of the developing roller 42 (hereinafter may be referred to as "convex portion-downstream angle γ1") and an angle γ at upstream side of the convex portion 42*a* in the surface-moving direction of the developing roller 42 (hereinafter may be referred to as "convex portion-upstream angle γ2") are both 90°.

As shown in FIG. 38, the stress of the doctor blade 45 is applied in a direction indicated by an arrow Fb in FIG. 38. The surface of the developing roller 42 moves in the direction indicated by the arrow B in FIG. 38, so that, by the action of the stress of the doctor blade 45, compressive force is applied to the toner T which is born in the concave portions 42*b* in a direction indicated by an arrow Fa in FIG. 38. Therefore, unless the toner being in contact with a downstream-side wall of the convex portion 42*a* in the surface-moving direction of the developing roller 42 is replaced with fresh toner, the compressive force is repeatedly applied to a particular toner, possibly leading to toner aggregation.

Figure 39:
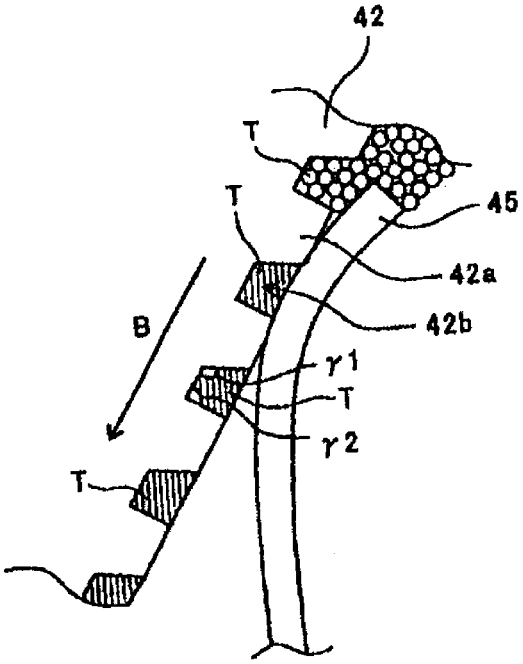
FIG. 39 is an enlarged sectional view of a surface of a developing roller in which some of angles between convex portions and concave portions are obtuse angles (in the case of the side-contact state).

By contrast, as shown in FIG. 39, in the developing roller 42 provided in the developing device 4, among angles γ between convex portions 42*a* and concave portions 42*b*, at least the convex portion-downstream angle γ1 is preferably an obtuse angle. When the convex portion-downstream angle γ1 is the obtuse angle, the toner being in contact with the downstream-side wall of the convex portion 42*a* in the surface-moving direction of the developing roller 42 becomes more likely to be scraped off by the supplying roller 44, which can facilitate toner replacement. The toner replacement at the downstream-side wall can prevent the compressive force from repeatedly being applied to a particular toner and can prevent toner aggregation.

Figure 40:
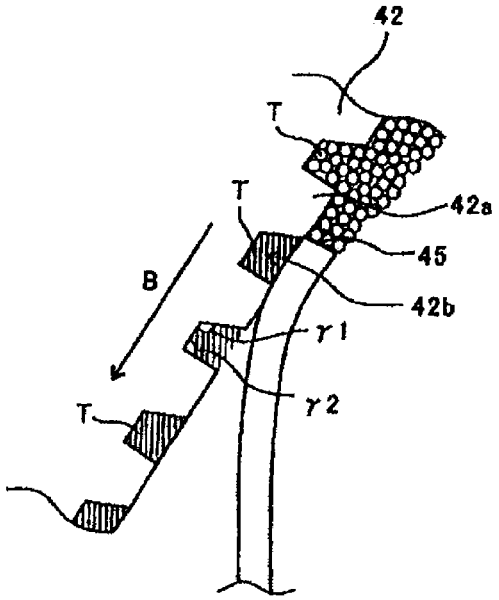
FIG. 40 is an enlarged sectional view of a surface of a developing roller in which some of angles between convex portions and concave portions are obtuse angles (in the case of the apical-contact state).

In the enlarged sectional view of the surface of a developing roller 42 shown in FIG. 39, the side-surface of the doctor blade 45 is in contact with the developing roller 42. When the doctor blade 45 abuts against the surface of the developing roller 42, the apical-contact state shown in FIG. 40 is more preferred in that the toner located on the top surface 42*t* of the convex portion 42*a* can be scraped off.

Figure 41:
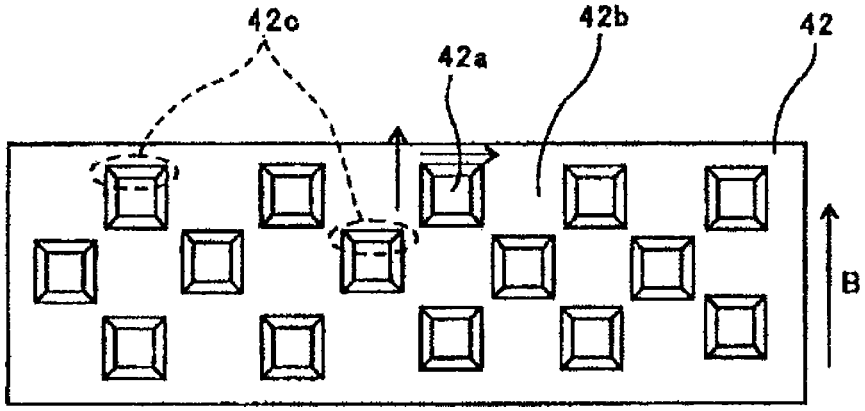
FIG. 41 is an enlarged view of a surface of a developing roller in which two pairs of parallel lines on top faces of convex portions are parallel with a surface-moving direction.

In a configuration in which rhomboid convex portions 42*a* are formed on the surface of the developing roller 42, as shown in FIG. 41, in the case where one of two pairs of parallel lines in the rhomboid top surface 42*t* of the convex portion 42*a* is in parallel with the surface-moving direction of the developing roller 42, the toner becomes more likely to be compressed at the downstream region of the convex portion 42*a* in the surface-moving direction of the developing roller 42 (region 42*c* in FIG. 41), so that toner filming tends to be increased.

By contrast, in the developing roller 42 provided in the developing device 4, as shown in FIG. 24, it is preferred that both of two pairs of parallel lines in the rhomboid top surface 42*t* of the convex portion 42*a* is angled to the surface-moving direction of the developing roller 42. Two pairs of parallel lines in the rhomboid top surface 42*t* of the convex portion 42*a* (sides of the rhomboid top surface 42*t* of the convex portion 42*a*) are angled to a rubbing direction of the doctor blade 45 coming into contact therewith, which makes the toner less likely to be compressed at the downstream region of the convex portion 42*a* in the surface-moving direction of the developing roller 42 (region 42*c* in FIG. 16B). In the developing device 4, an angle between a side in the rhomboid top surface 42*t* of the convex portion 42*a* and the surface-moving direction of the developing roller 42 is preferably 45°.

Next, there will be explained one exemplary characterizing part of the developing device 4.

In the developing device 4, the doctor blade 45 (blade member 450) serving as the regulating member is made of metal.

In the developing device described in Japanese Patent (JP-B) No. 4502146, a rubber regulating member on which a uniform and regular concavo-convex pattern is formed has been used as the regulating member to be come into contact with the developing roller. However, in this developing device, toner amounts on the developing roller may fluctuate when a protrusion length of the regulating member changes due to assembly tolerance upon manufacturing and time-dependent abrasion of the blade. Specifically, the toner amount on the developing roller may be extremely decreased, leading to low image density. Alternatively, on the contrary, the toner amount on the developing roller may be increased to thereby cause insufficient charging, leading to background smear which is smear on the background portion of an image.

By contrast, as in one exemplary developing device 4 of the present invention, using a metal blade as the doctor blade 45 can allow the toner amount on the developing roller 42 to be uniform even when the protrusion length of the doctor blade 45 changes to some extent.

Experiment 2

Next, there will be explained Experiment 2 comparing the metal doctor blade with the rubber doctor blade for a change of the toner amount on the developing roller 42 when varying the protrusion length of the doctor blade 45.

There will be explained a method for varying the protrusion length of the doctor blade 45 with reference to FIGS. 42A to 42C.

At first, the doctor blade 45 is allowed to come into contact with the developing roller 42 in the edge-contact state such that the doctor blade 45 extends in a tangential direction to the developing roller (perpendicular direction in FIGS. 42A to 42C) at an initial contact position Q1. The edge-contact state is a state in which an edge portion forming an edge between a facing surface 45*b* and an apical surface 45*a* of the doctor blade 45 is in contact with the surface of the developing roller 42.

At the edge portion forming the edge, the edge may be rounded or chamfered. That is, the edge portion means a region in the vicinity of a crossing position between an extension of the facing surface 45*b* and an extension of the top surface 45*a* of the doctor blade 45.

Specifically, the edge portion have any shape, so long as a corner, which may be rounded or chamfered, located closer to the developing roller 42 at an apical in a free end side of the platelike doctor blade 45 can come into contact with the convex portion 42*a* of the developing roller 42.

As a method for allowing the doctor blade 45 to come into contact with the developing roller, it is also possible to allow a bended portion formed by bending the blade to come into contact with the developing roller. However, the above method in which the apical in the free end side of the blade member is in contact with the developing roller is more preferred from the viewpoint of a toner-scraping effect.

Figure 42A:
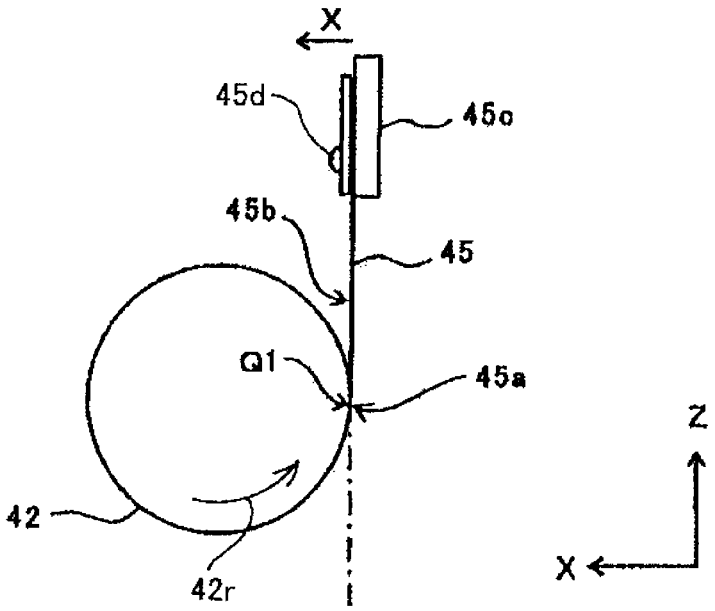
FIG. 42A is an explanatory view of a state in which a blade is in contact with a developing roller in a tangential direction.

Next, a blade holder 45*c* (base portion 452) supporting a bottom portion of the doctor blade 45 is allowed to move towards the developing roller along a normal direction of the developing roller 42 at the initial position Q1 (direction indicated by an arrow X in FIG. 42A). Thus, as shown in FIG. 42B, as a contact position with the developing roller 42 in the doctor blade 45 moves towards the bottom portion, the doctor blade 45 bends and becomes contact with the developing roller 42 in the side-contact state. The side-contact state is a state in which the developing roller 42 is in contact with the facing surface 45*b* facing the developing roller 42 of the doctor blade 45, but not the edge portion. In this state, a contact position Q with the doctor blade 45 on the surface of the developing roller 42 has been moved upward from the initial contact position Q1 in FIG. 42A.

Figure 42B:
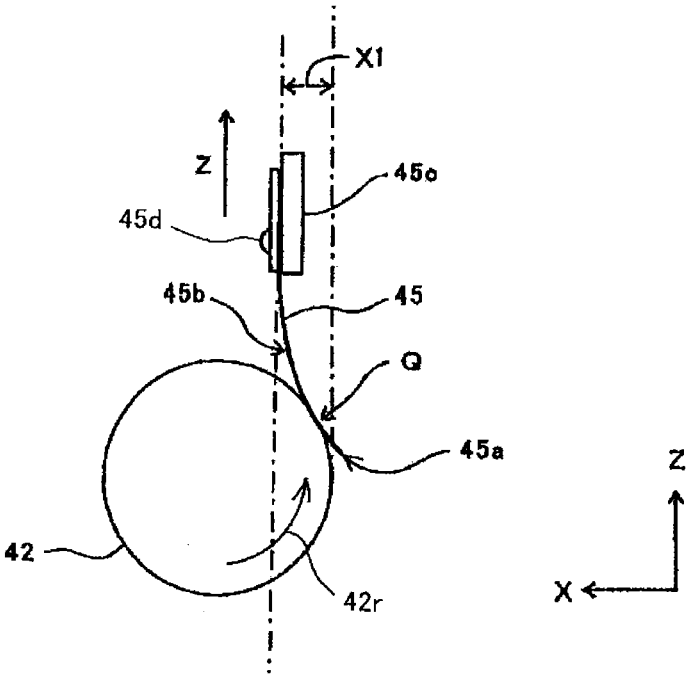
FIG. 42B is an explanatory view of a state in which a blade holder has been moved to a normal direction from a state shown in FIG. 42A.

As the blade holder 45*c* moves from the position shown in FIG. 42B in a direction away from the developing roller 42 (direction indicated by an arrow Z in FIG. 42B) along a direction perpendicular to the normal direction at the initial contact position Q1 (perpendicular direction in FIG. 42B), the protrusion length gradually decreases. Then, as shown in FIG. 42C, the doctor blade 45 come into the edge-contact state with being bended. When the blade holder 45*c* moves in the Z-direction from the state shown in FIG. 42C so as to gradually decrease the protrusion length, the bended degree of the doctor blade 45 decreases and the edge-contact state is maintained until the doctor blade 45 is spaced from the developing roller 42.

A portion 45*d* at which the doctor blade 45 is fastened to the blade holder 45*c* is located downstream of a position (portion) Q at which the doctor blade 45 is in contact with the developing roller 42 in a rotation direction of the developing roller 42 (direction indicated by an arrow 42*r*). That is, the apical at the free-end of the doctor blade 45 (apical surface 45*a*) is configured to collide with (face) the developing roller in a rotation direction of the developing roller 42. This collision direction is an edge-contact direction of the doctor blade 45.

Figure 42C:
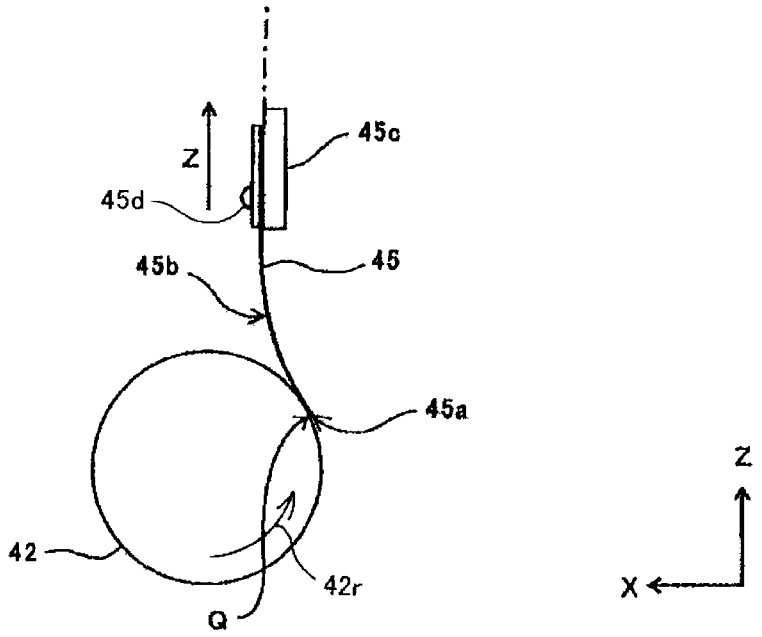
FIG. 42C is an explanatory view of a state in which a blade holder has been moved to a tangential direction from a state shown in FIG. 42B.
Figure 43:
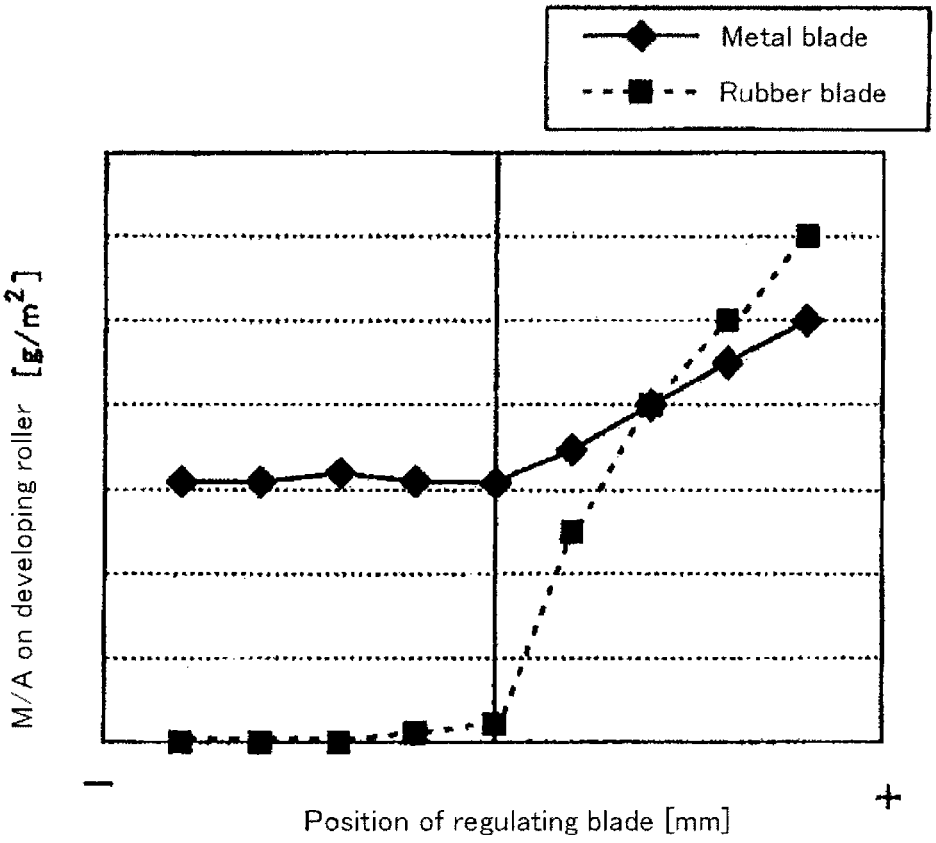
FIG. 43 is a graph representing results of Experiment 2.

FIG. 43 represents experimental result of measuring the change of the toner conveyance amount on the developing roller 42 when varying the protrusion length by the method for varying the protrusion length above-explained with reference to FIGS. 42A to 42C, in the case where the doctor blade 45 is made of metal (phosphor bronze) or urethane rubber.

In the graph shown in FIG. 43, the position of the doctor blade 45 shown in FIG. 42C at which a state of the doctor blade 45 changes from the side-contact state to the edge-contact state is defined as a zero position. The degree of the displacement when the blade holder moves from the zero position in the direction indicated by the arrow Z in FIG. 42C is represented with a minus sign (−), and the degree of the displacement when the blade holder moves from the zero position in the opposite direction to the arrow Z in FIG. 42C is represented with a plus sign (+). That is, in FIG. 43, the protrusion length increases towards the right side.

In FIG. 43, A graph with a dashed line represents an experimental result in the case of the rubber blade, and a graph with a solid line represents an experimental result in the case of the metal blade.

As shown in FIG. 43, when the position of the doctor blade 45 is in a plus (+) direction, as the position moves towards the plus direction, the toner conveyance amount increases in both cases of the metal blade and the rubber blade.

By contrast, when the position of the doctor blade 45 is in a minus (−) direction, in the case of the metal blade (solid line), the toner conveyance amounts are uniform in a certain range of positions as shown in FIG. 43. On the other hand, in the case of the rubber blade (dashed line) which has been used in conventional developing devices, when the position of the doctor blade 45 is in a minus (−) direction, almost no toner was conveyed to the developing roller 42.

Regarding the protrusion length against the developing roller 42 having regularly arranged convex portions on its surface, there could be seen from Experiment 2 with reference to FIG. 43 that the metal doctor blade 45 has a wider protrusion-length range in which the toner amount on the developing roller 42 is desired than the rubber doctor blade 45.

Accordingly, using the metal blade as the doctor blade 45 can allow a design tolerance to be increased in the Z-direction in FIGS. 42A to 42C upon attachment of the doctor blade 45 to thereby improve assembly performance. In addition, a mechanical tolerance can be increased, which makes it possible to manufacture a parts with low cost.

Figure 44:
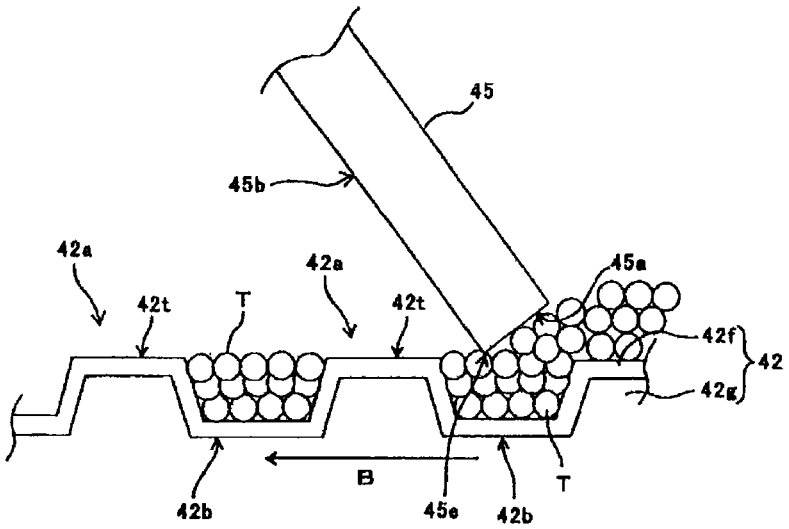
FIG. 44 is an enlarged explanatory view of a state in which an edge of a doctor blade is in contact with a developing roller.

FIG. 44 is an enlarged explanatory view of a contact position Q of the doctor blade 45 with the developing roller 42 in the edge-contact state.

As explained with reference to FIG. 43, when the metal blade is used as the doctor blade 45, contacting of developing roller 42 with the edge portion 45*e*, which is an apical of the doctor blade 45, can result in a certain range of positions in which the toner amounts are uniform. Specifically, as shown in FIG. 44, when the edge portion 45*e* is in contact with the developing roller, the toner T is scraped off by the doctor blade 45 so as to be a thin layered shape. As a result, only the toner T located in the concave portion 42*b* of the developing roller 42 is conveyed. Therefore, the toner amount on the developing roller 42 can be controlled to a desired amount depending on a volume of the concave portion 42*b*, which may allow the conveyance amount of the toner to be uniform. Additionally, the metal blade, due to its some degree of stiffness, has lower possibility than a resin (e.g., rubber) blade to enter into the concave portion 42*b* of the developing roller 42 to thereby scrape the toner out of the concave portion 42*b*, which may allow the conveyance amount of the toner to be uniform.

Experiment 3

Next, there will be explained Experiment 3 in which, by varying moving lengths X1 in a normal direction at the initial contact position Q1 in FIGS. 42A to 42C using the metal blade as the doctor blade 45, a range of positions in which the doctor blade 45 can be maintained in the edge-contact state is determined.

Figure 45:
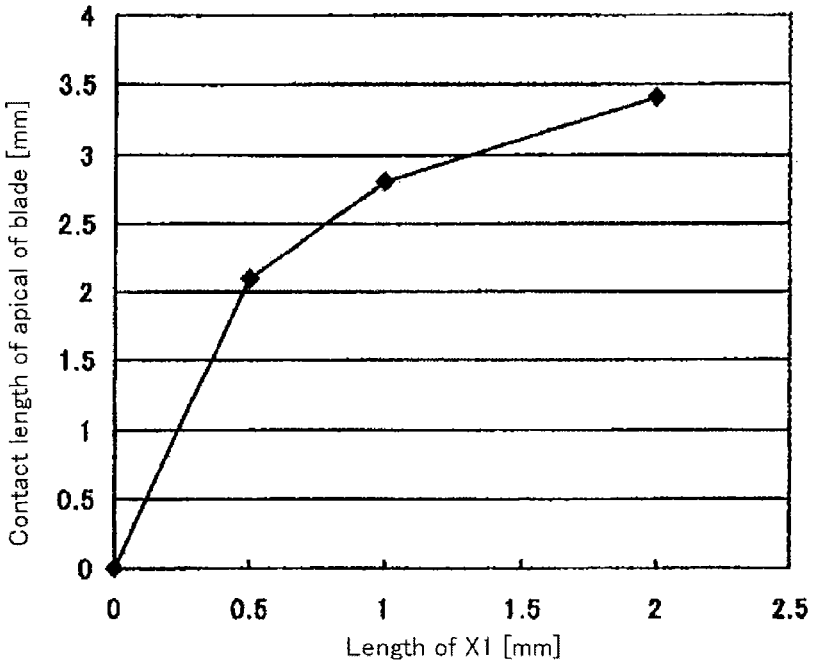
FIG. 45 is a graph representing results of Experiment 3.

FIG. 45 is a graph representing results of Experiment 3.

The graph in FIG. 45, position of the doctor blade at which the contact position Q of the doctor blade 45 is in a tangential direction against the surface of the developing roller 42 is defined as a zero point, and values of moving lengths X1 when the doctor blade 45 moves from the state in FIG. 42A to that of in FIG. 42B are on the horizontal axis. Meanwhile, in the graph in FIG. 45, on the vertical axis, zero point indicates a state shown in FIG. 42C after the blade holder has been moved in the Z-direction in FIG. 42B from a state shown in FIG. 42B. The graph in FIG. 45 has, on the vertical axis, moving lengths of the blade holder in the Z-direction in FIG. 42C until the doctor blade 45 is spaced from the surface of the developing roller 42.

As can be seen from FIG. 45, when the moving length X1 is zero or more, the longer the moving length X1 in the normal direction against the surface of the developing roller 42 at the initial contact position Q1 is, the wider the range in which the doctor blade 45 is maintained in the edge-contact state is. When the moving length X1 is zero or more, the doctor blade 45 is disposed so as to be bended by contacting with the developing roller 42. Such disposition can allow a design tolerance to be increased in the vertical direction in FIGS. 42A to 42C upon attachment 15*s* of the doctor blade 45 to thereby improve assembly performance. In addition, a mechanical tolerance can be increased, which makes it possible to manufacture a parts with low cost.

Experiment 4

Next, occurrence of streaky images was determined in the case where the metal blade as the doctor blade 45 is made of phosphor bronze or stainless (SUS). In this experiment, Vickers hardness of the surface-layer of the developing roller 42 (surface-layer 42*f*) was set to be higher than that of phosphor bronze but lower than that of stainless. Specifically, the developing roller 42 of which surface-layer is made of aluminum was used. Notably, Vickers hardness can be measured according to JIS Z 2244.

Phosphor bronze used in the present experiment has Vickers hardness of 80 Hv. When a metal blade having Vickers hardness of less than 80 Hv is used as the doctor blade 45, the metal blade is thought to have an sticking-inhibitory effect similar to the phosphor bronze doctor blade 45 of the present experiment. Regarding to hardness, Vickers hardness is employed in the present experiment, but Brinell hardness or Rockwell hardness may be used depending on material and shape of the doctor blade.

In Experiment 4, the doctor blade 45 made of phosphor bronze or stainless was disposed as shown in FIG. 42C. The copier 500 shown in FIG. 4 was used to form solid images to thereby determine occurrence of streaky images. As a result of Experiment 4, streaky images were formed in the case of the SUS doctor blade, but not in the case of the phosphor bronze doctor blade.

The doctor blades 45 used in Experiment 4 were examined. As a result, the toner was stuck firmly to the SUS doctor blade 45 with which the streaky image had been formed. Meanwhile, almost no toner was stuck firmly to the phosphor bronze doctor blade 45 with which no streaky image had been formed.

Figure 46:
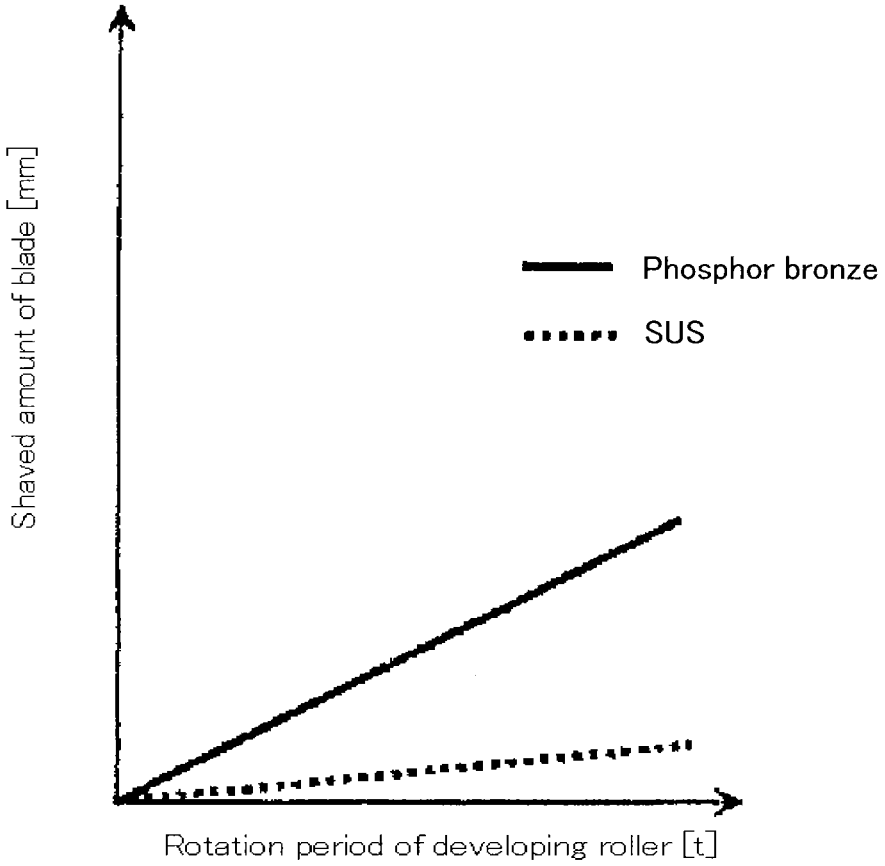
FIG. 46 is a graph comparing shaved amounts of doctor blades made of different materials.

FIG. 46 is a graph representing shaved amounts of the doctor blade 45 versus rotation period of the developing roller 42 for doctor blades 45 made of each material used in Experiment 4. A dashed line in the graph in FIG. 46 represents shaved amounts in the case of the SUS blade. On the other hand, a solid line in the graph in FIG. 46 represents shaved amounts in the case of phosphor bronze blade.

As can be seen from FIG. 46, phosphor bronze is more likely to be shaved off compared to SUS.

When the phosphor bronze doctor blade 45 is used, no problematic streaks appear on images even when the toner is slightly stuck to the doctor blade. It is believed that this is because the toner is shaved off together with the doctor blade to which the toner stuck by the action of rubbing with the developing roller 42 before growth of the stuck toner, which prevents the stuck toner from growing.

When hardness of the surface-layer of the developing roller 42 (surface-layer 42*f*) is set to be harder than that of the abutting position against the doctor blade 45, the doctor blade 45 is shaved off, so that the stuck toner becomes more likely to be removed as described above.

The surface-layer of the developing roller 42 may be plated with nickel in order to increase its hardness. In addition, even when the surface-layer of the developing roller 42 has high hardness, it is believed that phosphor bronze is preferably utilized in order to prevent the toner from sticking to the doctor blade, because phosphor bronze is more likely to be shaved off than stainless. It is also believed that metal having hardness of lower than that of phosphor bronze (Vickers hardness: 80 Hv or lower) has an sticking-inhibitory effect.

As explained in Experiment 4, in the developing device 4, by the action of rubbing with the developing roller 42, the stuck toner is shaved off together with the doctor blade 45 to which the toner stuck slightly in order to prevent streaky images from being formed. Therefore, the stuck toner should be shaved off throughout a width-direction of the doctor blade 45.

At any points in a width-direction (direction perpendicular to the surface-moving surface) on the surface of the convex forming portion 420*a*, which is a surface bearing the toner to be supplied to the latent electrostatic image bearing member 2, the developing roller 42 has one or more top surface 42*t*, the uppermost surface in a height-direction of the convex portion 42*a*, on the periphery of the developing roller 42 in the surface-moving direction.

In order to meet the above condition, on a certain row on the surface of the developing roller 42 (e.g., L11), convex portions 42*a* and concave portions 42*b* are arranged in periodic rows in the width-direction. In addition, on a row adjacent to the above-described row in the surface-moving direction (e.g., L12), convex portions 42*a* and concave portions 42*b* are arranged in periodic rows in the width-direction so as to shift from the pattern on the above-described row in half-cycle (see FIG. 24). In other words, rows L12 and L14 are shifted from rows L11 and L13 adjacent thereto in a rotation direction in half-concavo-convex pattern in the width-direction. Further, an axis direction length W2 on the top surface 42*t* is set so as to be equal to or longer than a half of the pitch width W1. On the surface of the developing roller, such patterns are repeated in the rotation direction of the developing roller 42.

Thus, even when the doctor blade 45 does not contact with the top surface 42*t* of the developing roller 42 at the L1 row, the doctor blade 45 does contact with the top surface 42*t* of the developing roller 42 at the L12 row. Such configuration can enable the top surface 42*t* of the developing roller 42 to contact with the doctor blade 45 at least one time throughout the width direction while the developing roller 42 rotates for one cycle. Therefore, at any points in the width-direction on the surface of the doctor blade 45, the top surface 42*t* of the developing roller 42 can contact with the doctor blade 45 while the developing roller 42 rotates for one cycle. As a result, the doctor blade 45 can be efficiently shaved off to thereby ensure absent of the streaky image due to the stuck toner.

When the development performed by contacting the surface of the developing roller 42 with the latent electrostatic image bearing member 2, both of the developing roller 42 and the latent electrostatic image bearing member 2 are non-elastic, so that a part of the developing roller 42 may not contact with the latent electrostatic image bearing member 2 depending on an accuracy of the developing roller 42 and the latent electrostatic image bearing member 2. In this case, a region where the developing roller 42 has not contacted with the latent electrostatic image bearing member 2 can not be developed with the toner, leading to image loss. In order to prevent the image loss, in the developing device 4, it is preferred that the developing roller 42 is disposed so as to space from the latent electrostatic image bearing member 2, and that a voltage in which a DC bias is superposed with an AC bias is applied to the developing roller 42 by the developing bias power supply 142. By the action of the voltage, the toner T is allowed to jump from the developing roller 42 to the latent electrostatic image bearing member 2, where the latent image is developed with the toner T. Accordingly, the image loss can be prevented regardless of positional accuracy of the developing roller 42 against the latent electrostatic image bearing member 2.

The copier 500 shown in FIG. 4 serving as the image forming apparatus may be provided with an informing system which informs users of a preset replacement time of the developing device 4 depending on working situation of the developing device 4.

Figure 47:
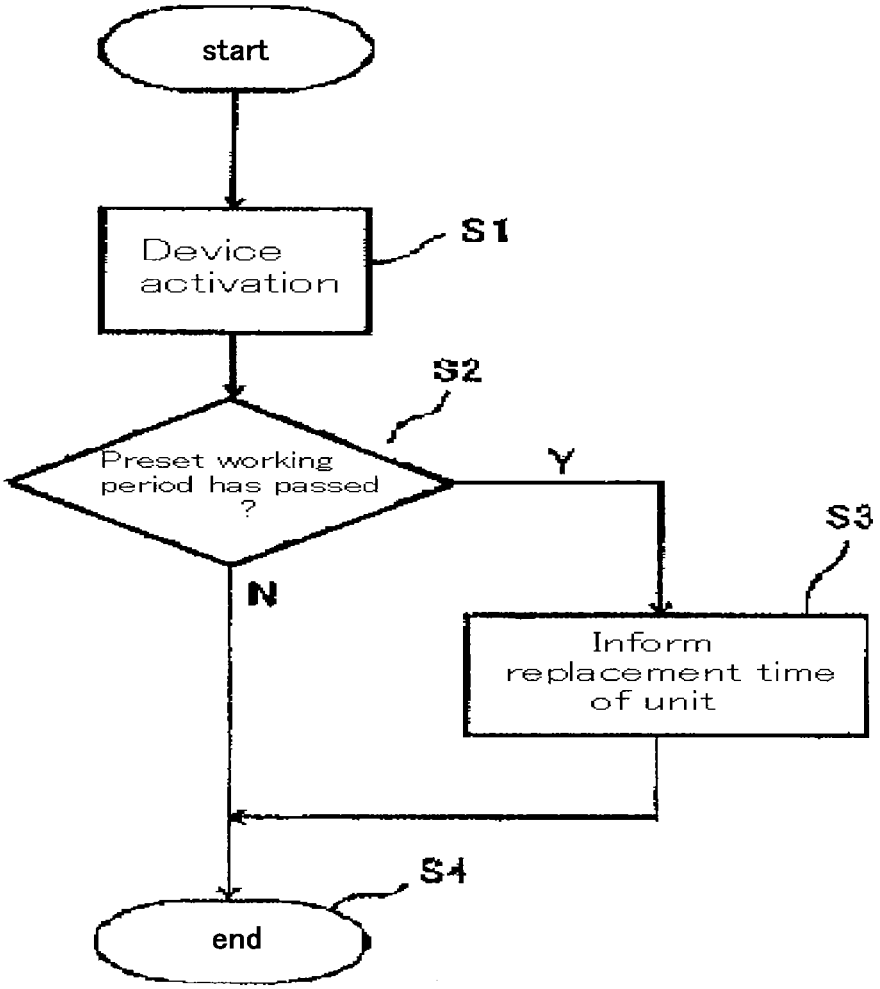
FIG. 47 is a flow-chart of an informing system which informs a replacement time of a developing device.
Figure 48:
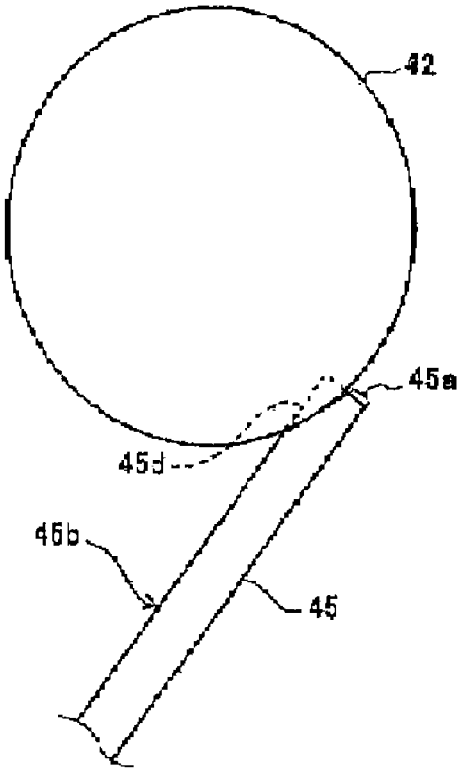
FIG. 48 is an enlarged explanatory view of a doctor blade and a developing roller just before a replacement time.

FIG. 47 is a flow-chart of the informing system which informs the replacement time of the developing device 4. FIG. 48 is an enlarged explanatory view of the doctor blade 45 and the developing roller 42 just before the replacement time.

As shown in FIG. 47, the informing system counts a working period of the developing device 4 (S1). When a preset working period has passed (Y at S1), the informing system considers that the developing device is at the end of its life, and informs users that the developing device 4 should be replaced or that the developing device 4 is at the end of its life via a lamp or a informing equipment (e.g., liquid crystal display) (S3). Examples of parameters used for determining whether the developing device 4 should be replaced include the working period of the developing roller 42, the number of paper fed through, and a weld period to the developing device.

As shown in FIG. 48, the doctor blade 45 of which edge is in contact with the developing roller 42 in the developing device 4 is gradually shaved off at the contact position with the developing roller 42 (region "45*d*" indicated by a dashed line in FIG. 48). The thickness of the doctor blade 45 is preferably set so that a part of the apical surface 45*a* still remains without being shaved off at the time when the informing system informs the replacement time. That is, the thickness should be set so that the apical surface 45*a* can remain even after the parameters for determining the replacement time exceed their threshold. After the apical surface 45*a* has completely shaved off, the contact position of the doctor blade 45 with the developing roller 42 may shift. In addition, a sharpened apical of the doctor blade 45 may dig into the developing roller 42. Therefore, the developing device 4 is preferably replaced before the apical surface 45*a* of the doctor blade 45 has completely shaved off.

Next, there will be explained another example of the present invention in which the present invention is applied to a printer serving as an image forming apparatus (hereinafter may be referred to as a printer 600).

Figure 49:
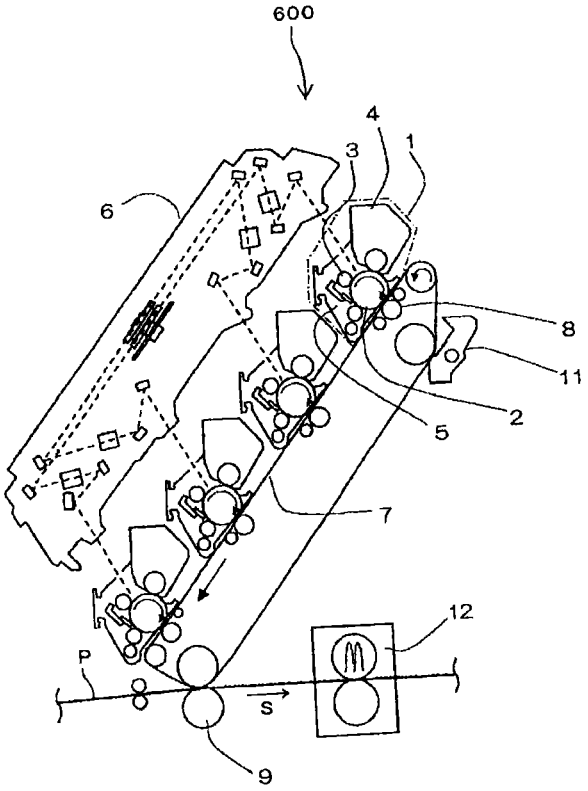
FIG. 49 is a schematic sectional view of essential parts of one exemplary printer.

FIG. 49 is a schematic sectional view of essential parts of the printer 600. As shown in FIG. 49, the printer 600 includes a process cartridge 1 serving as the four process units, an intermediate transfer belt 7 serving as the intermediate transfer member which is stretched by a plurality of stretching rollers to move in a direction indicated by the arrow shown in FIG. 49, an exposing device 6 serving as the exposing member, and a fixing device 12 serving as the fixing unit.

The process cartridge 1 has a unit configuration which integrally supports a latent electrostatic image bearing member 2 having a drum-shape, a charging member 3 serving as the charging unit, a developing device 4 configured to develop a latent image on the latent electrostatic image bearing member 2 with the toner T serving as the developer, and a cleaning device 5 configured to clean the latent electrostatic image bearing member. Each process cartridge 1 can be detached from a main body of printer 600 by removing a stopper (not shown).

The latent electrostatic image bearing member 2 rotates in a clockwise direction, that is, in a direction indicated by an arrow in FIG. 49. The charging member 3, which is a charging roller, is press-contacted with a surface of the latent electrostatic image bearing member 2, and is driven by a rotation of the latent electrostatic image bearing member 2. Upon forming an image, a predetermined bias is applied to the charging member 3 by a high voltage power supply (not shown) to thereby charge the surface of the latent electrostatic image bearing member 2. In the process cartridge 1, a charging member used is the roller-shaped charging member 3 being in contact with the surface of the latent electrostatic image bearing member 2, but not limited thereto. For example, non-contact-type charging utilizing colona discharge may be used.

The exposing device 6 exposes the surface of the latent electrostatic image bearing member 2 to light based on an image information to thereby form the latent electrostatic image on the surface of the latent electrostatic image bearing member 2. The exposing device 6 in the printer 600 adopts a laser beam scanner mode using a laser diode, but other configuration such as those using a LED array may be used as the exposing unit.

The cleaning device 5 cleans a transfer residual toner remaining on the surface of the latent electrostatic image bearing member 2 after the toner has passed through a position facing the intermediate transfer belt 7.

Four process cartridges 1 form toner images of black, yellow, magenta and cyan on the corresponding latent electrostatic image bearing members 2. The four process cartridges 1 are disposed in parallel with each other in a surface-moving direction of the intermediate transfer belt 7, and sequentially transfers the toner images which have been formed on the corresponding latent electrostatic image bearing members 2 to the intermediate transfer belt 7 so as to be superposed on top of one another to thereby form a visible image on the intermediate transfer belt 7.

In FIG. 49, primary transfer rollers 8 serving as the primary transfer unit are disposed at positions facing the latent electrostatic image bearing members 2 across the intermediate transfer belt 7. A primary transfer bias is applied to the primary transfer roller 8 by a high voltage power supply (not shown) to thereby form primary transfer electric fields between the primary transfer rollers 8 and the latent electrostatic image bearing members 2.

By the action of the primary transfer electric fields formed between the latent electrostatic image bearing members 2 and the primary transfer rollers 8, the toner images which have been formed on the surface of the latent electrostatic image bearing member 2 are transferred to the surface of the intermediate transfer belt 7. One of the plurality of the stretching rollers which stretch the intermediate transfer belt 7 is rotated by a drive motor (not shown) to thereby move the surface of the intermediate transfer belt 7 in the direction indicated by the arrow A in FIG. 49. The toner images are sequentially transferred on the moving surface of the intermediate transfer belt 7 so as to be superposed on top of one another to thereby form a full-color image on the surface of the intermediate transfer belt 7.

A secondary transfer roller 9 is disposed downstream of a position where the four process cartridges 1 face the intermediate transfer belt 7 in the surface-moving direction of the intermediate transfer belt 7 so as to face a secondary transfer facing roller, which is one of the stretching rollers, across the intermediate transfer belt 7. Thus, a secondary transfer nip is formed between the secondary transfer roller 9 and the intermediate transfer belt 7. A predetermined voltage is applied between the secondary transfer roller 9 and the secondary transfer facing roller to thereby form a secondary transfer electric field. Thus, at a time when transfer paper P, which is transfer material conveyed in a direction indicated by an arrow B in FIG. 49, passes through the secondary transfer nip, the full-color image which has been formed on the surface of the intermediate transfer belt 7 is transferred to the transfer paper P.

The fixing device 12 is disposed downstream of the secondary transfer nip in a conveying direction of the transfer paper P. The transfer paper P passes through the secondary transfer nip and then reaches the fixing device 12, where the full-color image which has been transferred on the transfer paper P is fixed with heating and pressuring by the fixing device 12. The transfer paper P on which the image has been fixed is discharged out of the printer 600.

Meanwhile, the toner T which has not transferred to the transfer paper P at the secondary transfer nip and remains on the surface of the intermediate transfer belt 7 is collected by the transfer belt-cleaning device 11.

Figure 50:
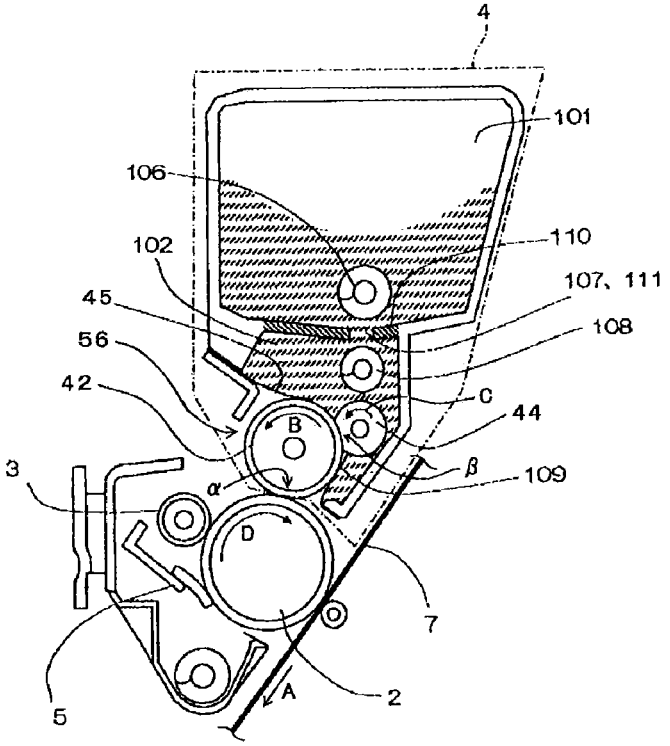
FIG. 50 is an enlarged sectional view of one of four process cartridges provided in the printer shown in FIG. 49.
Figure 51:
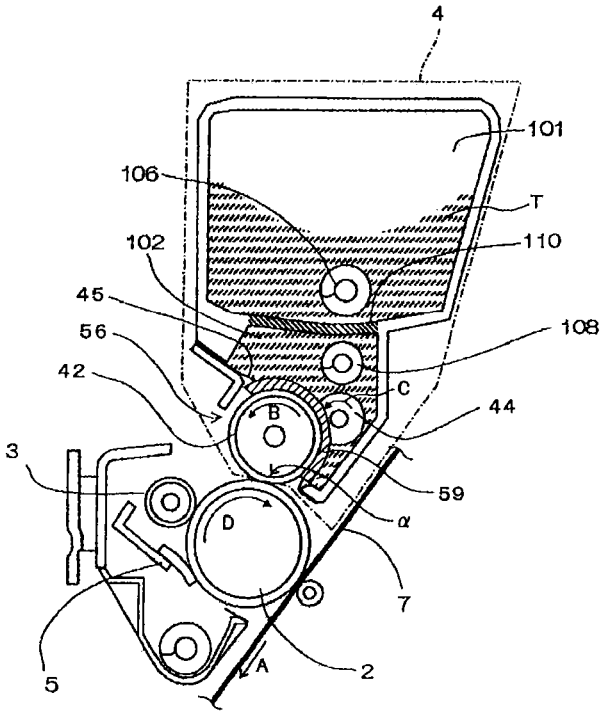
FIG. 51 is an enlarged sectional view of the vicinity of an axial-direction end of the process cartridge shown in FIG. 50.
Figure 52:
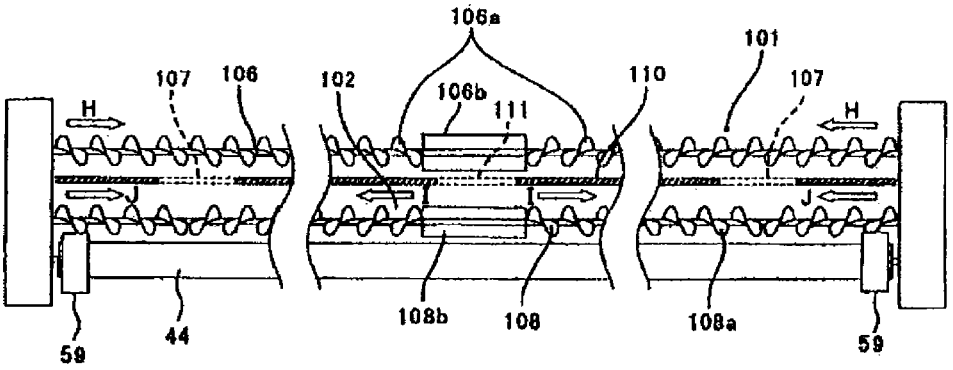
FIG. 52 is a sectional view taken along an axial direction of a developing device provided in the process cartridge shown in FIG. 50.

Next, there will be explained the developing device 4 provided in the process cartridges 1 with reference to FIGS. 50 to 52. FIGS. 50 and 51 are enlarged sectional views of one of four process cartridges. FIG. 50 is an enlarged sectional view of the vicinity of a central part in an axis direction of the developing roller 42. FIG. 51 is a sectional view of a position at which a side seal 59 is disposed and which is in the vicinity of an axis-direction end. FIG. 52 is an explanatory sectional view in the vicinity of a rotation axis of a toner conveying member 106 conveying the toner T, a toner stirring member 108 and a supplying roller 44 which are nearly-linearly arranged in a vertical direction in the developing device 4.

The developing device 4 includes a toner storing chamber 101 configured to store the toner T serving as the developer, and a toner supplying chamber 102 located below the toner storing chamber 101. A partition member 110 is provided so as to partition the toner storing chamber 101 and the toner supplying chamber 102. As shown in FIG. 52, a plurality of openings is provided on the partition member 110. The plurality of openings on the partition member 110 include a supplying port 111 configured to supply the toner T from the toner storing chamber 101 to the toner supplying chamber 102, and a return port 107 configured to return the toner T from the toner supplying chamber 102 to the toner storing chamber 101.

The developing roller 42 serving as a developer bearing member is provided in a lower region of the toner supplying chamber 102. The supplying roller 44 serving as a developer-supplying member which is configured to supply the toner T to the surface of the developing roller 42 is also provided in the toner supplying chamber 102 so as to abut against the surface of the developing roller 42.

In addition, in the toner supplying chamber 102, the doctor blade 45 is provided so as to abut against the surface of the developing roller 42. The doctor blade 45 serves as the regulating member and configured to regulate an amount (layer thickness) of the toner T which has been supplied to the surface of the developing roller 42 by the supplying roller 44 and then directed to a facing portion between the latent electrostatic image bearing member 2 and the developing roller 42.

The developing roller 42 is disposed so as not to contact with the latent electrostatic image bearing member 2. A predetermined bias is applied from a high-voltage power supply (not shown) to the developing roller 42.

The toner conveying member 106 is provided in the toner storing chamber 101 and configured to convey the toner T stored in the toner storing chamber 101 in a direction being in parallel with the rotation axis of the latent electrostatic image bearing member 2 (direction perpendicular to the cross-section shown in FIG. 50).

The toner T stored in the toner storing chamber 101 is produced using the polymerization method. For example, the toner T may have the average particle diameter of 6.5 μm, the circularity of 0.98 and the repose angle of 33°, and contain strontium titanate as the external additive. Notably, the toner T used for the printer 600 is not limited thereto.

As shown in FIG. 52, the toner conveying member 106 provided in the toner storing chamber 101 includes a screw-shaped conveying portion 106*a* and a plate-shaped conveying portion 106*b*, and has a rotation axis. The toner conveying member 106 is configured to be capable of conveying the toner T stored in the toner storing chamber 101 in nearly-horizontal direction being in parallel with the rotation axis of the toner conveying member 106 (direction indicated by an arrow H in FIG. 52) by the rotating action of the screw-shaped conveying portion 106*a*. The developing device 4 includes the screw-shaped conveying portion 106*a* which is configured to convey the toner T in a direction being in parallel with the rotation axis of the toner conveying member 106. However, a developer conveying member is not limited thereto, and other conveying members may be used such as a conveyance belt or a coil-like rotating body. The conveying members may be combined with a agitating member such as a plate-like member (e.g., blade) or a paddle formed by bending wire.

In the developing device 4 of this Embodiment, the toner T is conveyed from the toner storing chamber 101 toward the supplying roller 44 in a nearly-vertical downward direction perpendicular to a rotation axis of the toner conveying member 106. The toner T may be conveyed in nearly-horizontal direction perpendicular to a rotation axis of the toner conveying member 106.

The toner stirring member 108 is disposed in the toner supplying chamber 102 which is located vertically below the partition member 110. As shown in FIG. 52, the toner stirring member 108 includes a screw-shaped stirring portion 108*a* and a plate-shaped stirring portion 108*b*, and has a rotation axis. The toner stirring member 108 is configured to be capable of conveying the toner T stored in the toner supplying chamber 102 by the rotating action of the screw-shaped stirring portion 108*a* in nearly-horizontal direction being in parallel with the rotation axis of the toner stirring member 108 (direction indicated by an arrow I or J in FIG. 52).

As shown in FIG. 52, the screw-shaped stirring portion 108*a* of the toner stirring member 108 is provided with a spiral blade portion so as to convey the toner T outward across the supplying port 111 in an axis direction (direction indicated by an arrow I in FIG. 52). In the screw-shaped conveying portion 108*a* of the toner stirring member 108, the spiral blade is wound in opposite directions about the axis to each other inside and outside of two return ports 107 in the axis direction. Therefore, the toner T which has been supplied through the supplying port 111 to the toner supplying chamber 102 is conveyed outward in an axis direction (direction indicated by an arrow I) by the rotating action of the screw-shaped stirring portion 108*a* of the toner stirring member 108. When the toner T has reached outside of the return port 107, the toner T is conveyed towards the return port 107 (direction indicated by an arrow J) by the action of the screw-shaped stirring portion 108*a* of which spiral blade is wound in opposite direction. The screw-shaped stirring portion 108*a* conveys the toner T in opposite directions inside and outside the return port 107 in the axis direction. In order to direct the toner T towards the return port 107, the toner T is collected from both sides in the axis direction below the return port 107 and pushed up so as to be a mountain shape. Thus, when excess amount of the toner T is supplied from the toner storing chamber 101 through the supplying port 111 or the return port 107 to the toner supplying chamber 102, the toner T is pushed up so as to be a mountain shape at the return port 107 to thereby return from the toner supplying chamber 102 through the return port 107 to the toner storing chamber 101. The toner stirring member 108 stirs the toner T within the toner supplying chamber 102 and supplies the toner T to the supplying roller 44 and the developing roller 42 which are located below the toner supplying chamber 102.

The surface of the supplying roller 44 is coated with foamed material having pores (cells) therein, which can allow the toner within the toner supplying chamber 102 to be efficiently adhered and trapped, and can prevent the toner T from deteriorating due to concentrated pressure at the abutting position against the developing roller 42. Notably, the foamed material is set to have an electric resistance of $10^3\Omega$ to $10^{14}\Omega$. The supplying bias is applied to the supplying roller 44 in order to assist movement of the pre-charged toner T toward the developing roller 42 at the supplying nip β where the supplying roller 44 abuts against the developing roller 42. The supplying roller 44 rotates in a counter clockwise direction in FIG. 50 indicated by an arrow in FIG. 50 to thereby supply the toner T which is adhered on its own surface to the surface of the developing roller 42 as if the surface of the developing roller 42 is coated with the toner T.

The doctor blade 45 serving as the regulating member is disposed so as to contact with the surface of the developing roller 42 at a downstream region of the supplying nip β in the surface-moving direction of the developing roller 42. The toner T which has been supplied from the supplying roller 44 to the surface of the developing roller 42 is conveyed to a position at which the toner T abuts against the doctor blade 45 by the action of rotation of the developing roller 42.

The doctor blade 45 may be made of metal flat spring materials such as SUS304CSP, SUS301CSP and phosphor bronze. The free-end side of the doctor blade 45 is preferably allowed to abut against the surface of the developing roller 42 with pressing force of 10 N/m to 100 N/m. By applying the above pressing force to the toner T on the developing roller 42, the toner T may be a thin-layer and charged through friction. A bias is applied to the doctor blade 45 by a bias power supply (not shown) in order to help charging through friction.

The latent electrostatic image bearing member 2 does not come into contact with the developing roller 42 and rotates in a clockwise direction in FIG. 50. Therefore, at the developing region α where the developing roller 42 faces the latent electrostatic image bearing member 2, the surface of the developing roller 42 moves in the same direction as the surface of the latent electrostatic image bearing member 2.

The thin-layered toner on the developing roller 42 is conveyed to the developing region α by the action of the developing roller 42, and then moved to the surface of the latent electrostatic image bearing member 2 depending on the bias applied to the developing roller 42 and a latent image electric field formed by the latent electrostatic image on the latent electrostatic image bearing member 2, where the latent electrostatic image on the latent electrostatic image bearing member 2 is developed with the toner.

A charge-eliminating seal 109, which is a lower seal member serving as a member for charge-eliminating the developer, is provided so as to abut against the developing roller 42 at a position where the toner remaining on the surface of the developing roller 42 without having been used at the developing region α returns to the toner supplying chamber 102. The charge-eliminating seal 109 prevents the toner T from leaching out of the developing device 4. A bias is applied to the charge-eliminating seal 109 by the bias power supply (not shown) in order to assist the charge-eliminating.

In the above-described developing device 4, the latent image on the latent electrostatic image bearing member 2 is developed with the toner T on the developing roller 42 as follows. The toner T which has been supplied to the surface of the developing roller 42 at the supplying nip β is regulated to a predetermined amount by passing through the doctor blade 45 during being conveyed from the supplying nip β to the developing region α by the action of rotation of the developing roller 42. The post-regulated toner T the is further conveyed to the developing region α, where the toner is adhered to the latent electrostatic image region on the surface of the latent electrostatic image bearing member 2 by the action of the developing electric field generated between the developing roller 42 and the latent electrostatic image on the latent electrostatic image bearing member 2. Thus, the development is performed. The developing electric field used is an AC bias alternating between a voltage directing the toner towards the latent electrostatic image bearing member 2 and a voltage returning the toner to the developing roller 42. In this embodiment, rectangular waves (f=500 Hz to 10,000 Hz, Vpp=500 V to 3,000 V, and Duty=50% to 90%) are used. Thereafter, the toner without having been used for development is further conveyed and returned to the toner supplying chamber 102 by the action of the rotation of the developing roller 42 to thereby repeatedly be used.

In the developing device 4 of this embodiment, the surface of the developing roller 42 is also preferably subjected to any of a vapor deposition treatment, a chemical-conversion treatment and resin coating.

Aspect of the present invention are, for example, as follows.

<1> A developing device including:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, and wherein a non-electrostatic adhesive force between the toner and the surface of the toner bearing member is less than 9.0 nN.

<2> The developing device according to <1>, wherein the toner is obtained by treating toner base particles with silica and titanium oxide serving as external additives.

<3> The developing device according to <1>, wherein the toner is obtained by treating toner base particles with oil-treated silica serving as an external additive, and wherein the toner contains the oil-treated silica in an amount of 1.4 parts by mass to 2.8 parts by mass per 100 parts by mass of the toner base particles.

<4> The developing device according to <1>, wherein the toner has a volume average particle diameter (Dv) of 3 μm to 8 μm, and wherein a ratio (Dv/Dn) of the volume average particle diameter (Dv) to a number average particle diameter (Dn) of the toner is 1.00 to 1.40.

<5> The developing device according to <1>, wherein the toner has a shape factor SF-1 of 100 to 180, and has a shape factor SF-2 of 100 to 180.

<6> The developing device according to <1>, wherein when a shape of the toner is defined by a long axis r1, a short axis r2, and a thickness r3, where r1≥r2≥r3, a ratio of the short axis r2 to the long axis r1 (r2/r1) falls within a range of 0.5 to 1.0 and a ratio of the thickness r3 to the short axis r2 (r3/r2) falls within a range of 0.7 to 1.0.

<7> The developing device according to <1>, wherein the surface of the toner bearing member is provided with a film by a treatment which is a vapor deposition treatment, a chemical-conversion treatment or resin coating.

<8> The developing device according to <7>, wherein the treatment is the vapor deposition treatment, and wherein the film is a diamond like carbon film.

<9> The developing device according to <7>, wherein the treatment is a molybdic acid treatment.

<10> The developing device according to <7>, wherein the treatment is the resin coating, and wherein the film contains lubricant powder.

<11> The developing device according to <7>, wherein the treatment is the resin coating, and wherein the film is a resin film containing polytetrafluoroethylene dispersed therein.

<12> The developing device according to <1>, wherein the regulating member includes a blade having a first end held by a blade holder and a second end that contacts the convex portions formed in the surface of the toner bearing member, and wherein the blade is made of metal.

<13> An image forming apparatus including:

a latent electrostatic image bearing member; and a developing unit containing a toner and configured to develop, with the toner, a latent electrostatic image formed on the latent electrostatic image bearing member, to thereby form a visible image, wherein the developing device includes:

a toner bearing member configured to bear the toner on a surface of the toner bearing member and configured such that the surface thereof is rotated to supply the toner to and develop the latent electrostatic image on a surface of the latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, and wherein a non-electrostatic adhesive force between the toner and the surface of the toner bearing member is less than 9.0 nN.

<14> The image forming apparatus according to <13>, wherein the toner is obtained by treating toner base particles with silica and titanium oxide serving as external additives.

<15> The image forming apparatus according to <13>, wherein the toner is obtained by treating toner base particles with oil-treated silica serving as an external additive, and wherein the toner contains the oil-treated silica in an amount of 1.4 parts by mass to 2.8 parts by mass per 100 parts by mass of the toner base particles.

<16> The image forming apparatus according to <13>, wherein the toner has a volume average particle diameter (Dv) of 3 μm to 8 μm, and wherein a ratio (Dv/Dn) of the volume average particle diameter (Dv) to a number average particle diameter (Dn) of the toner is 1.00 to 1.40.

<17> The image forming apparatus according to <13>, wherein the surface of the toner bearing member is provided with a film by a treatment which is a vapor deposition treatment, a chemical-conversion treatment or resin coating.

<18> The image forming apparatus according to <13>, wherein the regulating member includes a blade having a first end held by a blade holder and a second end that contacts the convex portions formed in the surface of the toner bearing member, and wherein the blade is made of metal.

This application claims priority to Japanese application Nos. 2012-028432, filed on Feb. 13, 2012, and 2012-060876, filed on Mar. 16, 2012, and incorporated herein by reference.

What is claimed is:

1. A developing device comprising:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, a height of the convex portions being greater than a volume average particle diameter of the toner, wherein the surface of the toner bearing member is provided with a film by a treatment which is a vapor deposition treatment, wherein the film is a diamond like carbon film, wherein the toner has a volume average particle diameter (Dv) of 3 μm to 8 μm, and wherein a ratio (Dv/Dn) of the volume average particle diameter (Dv) to a number average particle diameter (Dn) of the toner is 1.00 to 1.40.

2. The developing device according to claim 1, wherein the toner is obtained by treating toner base particles with silica and titanium oxide serving as external additives.

3. The developing device according to claim 1, wherein the toner is obtained by treating toner base particles with oil-treated silica serving as an external additive, and wherein the toner comprises the oil-treated silica in an amount of 1.4 parts by mass to 2.8 parts by mass per 100 parts by mass of the toner base particles.

4. The developing device according to claim 1, wherein the regulating member comprises a blade having a first end held by a blade holder and a second end that contacts the convex portions formed in the surface of the toner bearing member, and wherein the blade is made of metal.

5. A developing device comprising:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, a height of the convex portions being greater than a volume average particle diameter of the toner, wherein the surface of the toner bearing member is provided with a film by a treatment which is a vapor deposition treatment, wherein the film is a diamond like carbon film, and wherein the toner has a shape factor SF-1 of 100 to 180, and has a shape factor SF-2 of 100 to 180.

6. The developing device according to claim 5, wherein the toner is obtained by treating toner base particles with silica and titanium oxide serving as external additives.

7. The developing device according to claim 5, wherein the toner is obtained by treating toner base particles with oil-treated silica serving as an external additive, and wherein the toner comprises the oil-treated silica in an amount of 1.4 parts by mass to 2.8 parts by mass per 100 parts by mass of the toner base particles.

8. The developing device according to claim 5, wherein the regulating member comprises a blade having a first end held by a blade holder and a second end that contacts the convex portions formed in the surface of the toner bearing member, and wherein the blade is made of metal.

9. A developing device comprising:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, a height of the convex portions being greater than a volume average particle diameter of the toner, wherein the surface of the toner bearing member is provided with a film by a treatment which is a vapor deposition treatment, wherein the film is a diamond like carbon film, and wherein when a shape of the toner is defined by a long axis r1, a short axis r2, and a thickness r3, where r1≥r2≥r3, a ratio of the short axis r2 to the long axis r1 (r2/r1) falls within a range of 0.5 to 1.0 and a ratio of the thickness r3 to the short axis r2 (r3/r2) falls within a range of 0.7 to 1.0.

10. The developing device according to claim 9, wherein the toner is obtained by treating toner base particles with silica and titanium oxide serving as external additives.

11. The developing device according to claim 9, wherein the toner is obtained by treating toner base particles with oil-treated silica serving as an external additive, and wherein the toner comprises the oil-treated silica in an amount of 1.4 parts by mass to 2.8 parts by mass per 100 parts by mass of the toner base particles.

12. The developing device according to claim 9, wherein the regulating member comprises a blade having a first end held by a blade holder and a second end that contacts the convex portions formed in the surface of the toner bearing member, and wherein the blade is made of metal.

13. A developing device comprising:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, a height of the convex portions being greater than a volume average particle diameter of the toner, wherein the surface of the toner bearing member is provided with a film by a treatment which is a vapor deposition treatment, a chemical-conversion treatment or resin coating, wherein the treatment is the resin coating, and wherein the film contains lubricant powder.

14. The developing device according to claim 13, wherein the toner is obtained by treating toner base particles with silica and titanium oxide serving as external additives.

15. The developing device according to claim 13, wherein the toner is obtained by treating toner base particles with oil-treated silica serving as an external additive, and wherein the toner comprises the oil-treated silica in an amount of 1.4 parts by mass to 2.8 parts by mass per 100 parts by mass of the toner base particles.

16. The developing device according to claim 13, wherein the toner has a volume average particle diameter (Dv) of 3 μm to 8 μm, and wherein a ratio (Dv/Dn) of the volume average particle diameter (Dv) to a number average particle diameter (Dn) of the toner is 1.00 to 1.40.

17. The developing device according to claim 13, wherein the toner has a shape factor SF-1 of 100 to 180, and has a shape factor SF-2 of 100 to 180.

18. The developing device according to claim 13, wherein when a shape of the toner is defined by a long axis r1, a short axis r2, and a thickness r3, where r1≥r2≥r3, a ratio of the short axis r2 to the long axis r1 (r2/r1) falls within a range of 0.5 to 1.0 and a ratio of the thickness r3 to the short axis r2 (r3/r2) falls within a range of 0.7 to 1.0.

19. The developing device according to claim 13, wherein the regulating member comprises a blade having a first end held by a blade holder and a second end that contacts the convex portions formed in the surface of the toner bearing member, and wherein the blade is made of metal.

20. A developing device comprising:

a toner bearing member configured to bear a toner on a surface of the toner bearing member and configured such that the surface thereof is rotated to supply the toner to and develop a latent electrostatic image on a surface of a latent electrostatic image bearing member in a developing region which faces the latent electrostatic image bearing member; and a regulating member configured to regulate an amount of the toner to be moved towards the developing region, wherein the surface of the toner bearing member has regularly arranged convex portions, a height of the convex portions being greater than a volume average particle diameter of the toner, wherein the surface of the toner bearing member is provided with a film by a treatment which is a vapor deposition treatment, a chemical-conversion treatment or resin coating, wherein the treatment is the resin coating, and wherein the film is a resin film comprising polytetrafluoroethylene dispersed therein.

21. The developing device according to claim 20, wherein the toner is obtained by treating toner base particles with silica and titanium oxide serving as external additives.

22. The developing device according to claim 20, wherein the toner is obtained by treating toner base particles with oil-treated silica serving as an external additive, and wherein the toner comprises the oil-treated silica in an amount of 1.4 parts by mass to 2.8 parts by mass per 100 parts by mass of the toner base particles.

23. The developing device according to claim 20, wherein the toner has a volume average particle diameter (Dv) of 3 μm to 8 μm, and wherein a ratio (Dv/Dn) of the volume average particle diameter (Dv) to a number average particle diameter (Dn) of the toner is 1.00 to 1.40.

24. The developing device according to claim 20, wherein the toner has a shape factor SF-1 of 100 to 180, and has a shape factor SF-2 of 100 to 180.

25. The developing device according to claim 20, wherein when a shape of the toner is defined by a long axis r1, a short axis r2, and a thickness r3, where r1≥r2≥r3, a ratio of the short axis r2 to the long axis r1 (r2/r1) falls within a range of 0.5 to 1.0 and a ratio of the thickness r3 to the short axis r2 (r3/r2) falls within a range of 0.7 to 1.0.

26. The developing device according to claim 20, wherein the regulating member comprises a blade having a first end held by a blade holder and a second end that contacts the convex portions formed in the surface of the toner bearing member, and wherein the blade is made of metal.

* * * * *